US010427014B2

(12) United States Patent
Taylor et al.

(10) Patent No.: US 10,427,014 B2
(45) **Date of Patent: *Oct. 1, 2019**

(54) GOLF CLUB

(71) Applicant: Taylor Made Golf Company, Inc., Carlsbad, CA (US)

(72) Inventors: Scott Taylor, Bonita, CA (US); Peter L. Larsen, San Marcos, CA (US); Bret H. Wahl, Escondido, CA (US); Joshua J. Dipert, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/718,824

(22) Filed: Sep. 28, 2017

(65) Prior Publication Data

US 2018/0071595 A1 Mar. 15, 2018

Related U.S. Application Data

(63) Continuation of application No. 15/226,853, filed on Aug. 2, 2016, now Pat. No. 9,802,091, which is a (Continued)

(51) Int. Cl.
*A63B 53/04* (2015.01)
*A63B 60/52* (2015.01)
(Continued)

(52) U.S. Cl.
CPC ..... *A63B 53/0475* (2013.01); *A63B 53/047* (2013.01); *A63B 60/52* (2015.10);
(Continued)

(58) Field of Classification Search
CPC ... A63B 53/0475; A63B 53/047; A63B 60/52; A63B 60/54; A63B 2053/0408;
(Continued)

(56) References Cited

U.S. PATENT DOCUMENTS 2,034,936 A * 3/1936 Barnhart ..... A63B 53/04 473/329
4,398,965 A * 8/1983 Campau ..... A63B 53/04 148/522

(Continued)

FOREIGN PATENT DOCUMENTS

JP H07-299165 11/1995
JP 2004-187710 7/2004

(Continued)

OTHER PUBLICATIONS

Japanese Office Action for JP Patent Application No. 2014-246435, dated Sep. 19, 2018, 20 pages (with English translation).

*Primary Examiner* — Sebastiano Passaniti
(74) *Attorney, Agent, or Firm* — Klarquist Sparkman, LLP

(57) ABSTRACT

A golf club head includes a club body including a heel portion, a sole portion, a toe portion, a top-line portion, and a face portion. In some embodiments, the face portion has an ideal striking location and at least one channel defined in the face. In some embodiments, the golf club head has a striking face and at least one channel defined in the striking face. In some embodiments, the golf club head has an ideal striking location and at least one non-ideal striking location.

15 Claims, 56 Drawing Sheets

Related U.S. Application Data continuation of application No. 14/145,761, filed on Dec. 31, 2013, now Pat. No. 9,492,722.

(60) Provisional application No. 61/903,185, filed on Nov. 12, 2013.

(51) Int. Cl.
*A63B 60/54* (2015.01)
*A63B 53/00* (2015.01)

(52) U.S. Cl.
CPC ..... *A63B 60/54* (2015.10); *A63B 2053/005* (2013.01); *A63B 2053/0408* (2013.01); *A63B 2053/0412* (2013.01); *A63B 2053/0433* (2013.01); *A63B 2053/0445* (2013.01); *A63B 2053/0458* (2013.01); *A63B 2209/00* (2013.01)

(58) Field of Classification Search
CPC ..... A63B 2053/005; A63B 2053/0445; A63B 2209/00; A63B 2053/0433; A63B 2053/0412; A63B 2053/0458
USPC ..... 473/324–350, 287–292
See application file for complete search history.

(56) References Cited

U.S. PATENT DOCUMENTS 5,282,625 A * 2/1994 Schmidt ..... A63B 53/04 473/350
5,346,219 A * 9/1994 Pehoski ..... A63B 53/0487 473/325
5,586,947 A * 12/1996 Hutin ..... A63B 53/04 473/324
6,042,486 A 3/2000 Gallagher
6,471,602 B1 * 10/2002 D'Orazio ..... A63B 53/047 473/324
7,582,024 B2 9/2009 Shear
7,651,412 B2 1/2010 Meyer
7,704,162 B2 * 4/2010 Rice ..... A63B 60/00 473/329
7,857,711 B2 * 12/2010 Shear ..... A63B 53/0466 473/329
8,083,612 B2 * 12/2011 Stites ..... A63B 53/0466 473/345
8,206,241 B2 * 6/2012 Boyd ..... A63B 53/0466 473/332
8,545,343 B2 * 10/2013 Boyd ..... A63B 53/04 473/288
8,632,419 B2 1/2014 Tang
8,827,826 B2 * 9/2014 Stites ..... A63B 53/0466 473/291
9,044,653 B2 6/2015 Wahl
9,079,081 B2 * 7/2015 Shimazaki ..... A63B 53/047
9,320,948 B2 * 4/2016 Fossum ..... A63B 53/0466
9,468,819 B2 * 10/2016 Rice ..... A63B 53/0466
9,492,722 B2 * 11/2016 Taylor ..... A63B 53/047
9,802,091 B2 * 10/2017 Taylor ..... A63B 53/047
9,937,395 B2 * 4/2018 Taylor ..... A63B 53/047
10,065,082 B2 * 9/2018 James ..... A63B 53/0466
2004/0083596 A1 5/2004 Willet
2008/0051215 A1 * 2/2008 Rae ..... A63B 53/0466 473/345
2009/0088271 A1 4/2009 Beach et al.
2012/0028727 A1 * 2/2012 Roach ..... A63B 53/04 473/291
2012/0184394 A1 * 7/2012 Boyd ..... A63B 53/0466 473/342

FOREIGN PATENT DOCUMENTS

JP 2008-194116 8/2008
JP 2013-255779 12/2013

* cited by examiner

COR FACE MAP RESULTS
BEFORE/AFTER MACHINING
HEEL TO TOE

GOLF CLUB

This application is a continuation of U.S. patent application Ser. No. 15/226,853, entitled "GOLF CLUB", filed Aug. 2, 2016, which is a continuation of U.S. patent application Ser. No. 14/145,761, entitled "GOLF CLUB", filed Dec. 31, 2013, which application claims the benefit of U.S. Provisional Application No. 61/903,185, entitled "GOLF CLUB," filed Nov. 12, 2013, which applications are incorporated herein by reference in their entireties. This application also references U.S. patent application Ser. No. 13/830,293, entitled "IRON TYPE GOLF CLUB HEAD," filed Mar. 14, 2013, which claims priority to U.S. Provisional Application No. 61/657,675, entitled "IRON TYPE GOLF CLUB HEAD," filed Jun. 8, 2012, both of which are hereby incorporated by reference herein in their entireties. This application also references U.S. Pat. No. 8,353,786, entitled "GOLF CLUB HEAD," filed Dec. 28, 2007, which is incorporated by reference herein in its entirety and with specific reference to discussion of variable face thickness of golf club heads.

TECHNICAL FIELD

The present disclosure relates to golf club heads, golf clubs, and sets of golf clubs. More specifically, the present disclosure relates to golf club heads for iron type golf clubs, and golf clubs and sets of golf clubs including such golf club heads.

BACKGROUND

A golf club set includes various types of clubs for use in different conditions or circumstances in which a ball is hit during a golf game. A set of clubs typically includes a "driver" for hitting the ball the longest distance on a course. A fairway "wood" can be used for hitting the ball shorter distances than the driver. A set of irons is used for hitting the ball within a range of distances typically shorter than the driver or woods. Every club has an ideal striking location or "sweet spot" that represents the best hitting zone on the face for maximizing the probability of the golfer achieving the best and most predictable shot using the particular club.

An iron has a flat face that normally contacts the ball whenever the ball is being hit with the iron. Irons have angled faces for achieving lofts ranging from about 18 degrees to about 64 degrees. The size of an iron's sweet spot is generally related to the size (i.e., surface area) of the iron's striking face, and iron sets are available with oversize club heads to provide a large sweet spot that is desirable to many golfers. Most golfers strive to make contact with the ball inside the sweet spot to achieve a desired ball speed, distance, and trajectory.

Conventional "blade" type irons have been improved upon by so-called "perimeter weighted" irons, which include "cavity-back" and "hollow" iron designs. Cavity-back irons have a cavity directly behind the striking plate which permits club head mass to be distributed about the perimeter of the striking plate, and such clubs tend to be more forgiving to off-center hits. Hollow irons have features similar to cavity-back irons, but the cavity is enclosed by a rear wall to form a hollow region behind the striking plate. Perimeter weighted, cavity back, and hollow iron designs permit club designers to redistribute club head mass to achieve intended playing characteristics associated with, for example, placement of club head center of mass or a moment of inertia. These designs also permit club designers to provide striking plates that have relatively large face areas that are unsupported by the main body of the golf club head.

SUMMARY

A golf club head includes a club body including a heel portion, a sole portion, a toe portion, a top-line portion, and a face portion. In some embodiments, the face portion has an ideal striking location and at least one channel defined in the face. In some embodiments, the golf club head has a striking face and at least one channel defined in the striking face. In some embodiments, the golf club head has an ideal striking location and at least one non-ideal striking location.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1A:
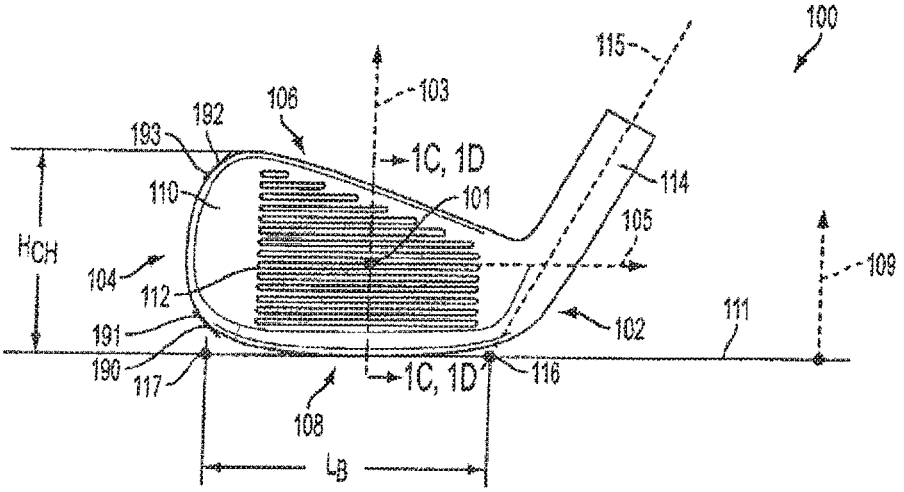
FIG. 1A is a front view of an embodiment of a golf club head.

The present disclosure describes iron type golf club heads typically including a head body and a striking plate. The head body includes a heel portion, a toe portion, a topline portion, a sole portion, and a hosel configured to attach the club head to a shaft. In various embodiments, the head body defines a front opening configured to receive the striking plate at a front rim formed around a periphery of the front opening. In various embodiments, the striking plate is formed integrally (such as by casting) with the head body.

Various embodiments and aspects will be described with reference to details discussed below, and the accompanying drawings will illustrate the various embodiments. The following description and drawings are illustrative and are not to be construed as limiting on the scope of the disclosure. Numerous specific details are described to provide a thorough understanding of various embodiments of the present disclosure. However, in certain instances, well-known or conventional details are not described in order to provide a concise discussion of the various embodiments described herein.

As used herein, the terms "coefficient of restitution," "COR," "relative coefficient of restitution," "relative COR," "characteristic time," and "CT" are defined according to the following. The coefficient of restitution (COR) of an iron club head is measured according to procedures described by the USGA Rules of Golf as specified in the "Interim Procedure for Measuring the Coefficient of Restitution of an Iron Club head Relative to a Baseline Plate," Revision 1.2, Nov. 30, 2005 (hereinafter "the USGA COR Procedure"). Specifically, a COR value for a baseline calibration plate is first determined, then a COR value for an iron club head is determined using golf balls from the same dozen(s) used in the baseline plate calibration. The measured calibration plate COR value is then subtracted from the measured iron club head COR to obtain the "relative COR" of the iron club head.

To illustrate by way of an example: following the USGA COR Procedure, a given set of golf balls may produce a measured COR value for a baseline calibration plate of 0.845. Using the same set of golf balls, an iron club head may produce a measured COR value of 0.825. In this example, the relative COR for the iron club head is 0.825−0.845=−0.020. This iron club head has a COR that is 0.020 lower than the COR of the baseline calibration plate, or a relative COR of −0.020.

The characteristic time (CT) is the contact time between a metal mass attached to a pendulum that strikes the face center of the golf club head at a low speed under conditions prescribed by the USGA club conformance standards.

As used herein, the term "volume" when used to refer to a golf club head refers to a club head volume measured according to the procedure described in Section 5.0 of the "Procedure For Measuring the Club head Size of Wood Clubs," Revision 1.0.0, published Nov. 21, 2003 by the United States Golf Association (the USGA) and R&A Rules Limited. The foregoing procedure includes submerging a club head in a large volume container of water. In the case of a volume measurement of a hollow iron type club head, any holes or openings in the walls of the club head are to be covered or otherwise sealed prior to lowering the club head into the water.

Some embodiments of the iron type golf club heads include a flexible boundary structure (hereinafter "FBS") provided at one or more locations on the club head. The flexible boundary structure may include, in various embodiments, a slot, a channel, a gap, a thinned or weakened region, or other structure that enhances the capability of an adjacent or related portion of the golf club head to flex or to deflect and, thereby, to provide a desired improvement in the performance of the golf club head. As used herein, the terms "channel", "FBS", "slot", and "FBS feature" may utilized interchangeably as would be understood by one of skill in the art, among other terms located herein.

In a first aspect, a club head for an iron-type golf club includes a body having a heel portion, a sole portion, a toe portion, a top-line portion, and a face portion, with the sole portion extending rearwardly from a lower end of the face portion. The face portion includes an ideal striking location (or strike location) that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. In various embodiments, the body includes a central region in which $-25\ \text{mm}<x<25\ \text{mm}$. In various embodiments, the sole portion that is contained within the central region includes a forward sole region located adjacent to the face portion and a sole bar located rearward of the forward sole region, with the forward sole region defining a wall having a minimum forward sole thickness $T_{FS}$ and the sole bar defining a body having a maximum sole bar thickness $T_{SB}$, such that $0.05<T_{FS}/T_{SB}<0.4$. In various embodiments, the sole bar defines a first channel extending in a substantially heel-to-toe direction of the sole portion and having a first channel opening located on a bottom surface of the sole bar.

In various embodiments, the first channel has a first channel length including the distance between a part of the first channel nearest the toe portion and a part of the first channel nearest the heel region, with the first channel length being from about 15 mm to about 85 mm. In some additional embodiments, the first channel length is from about 30 mm to about 57 mm.

In various embodiments, the first channel has a first channel depth comprising a vertical distance between the ground plane and an uppermost point of the first channel, with an average of the first channel depth within the central region being from about 5 mm to about 25 mm. In some additional embodiments, the first channel depth is substantially constant within the central region.

In various embodiments, the body includes a toe side region wherein the x-axis coordinate is less than −25 mm, and a heel side region wherein the x-axis coordinate is greater than 25 mm, and the first channel has an average depth in the central region that is less than an average depth of the first channel in the toe side region. In various embodiments, the first channel has an average depth in the central region that is less than an average depth of the first channel in the heel side region. Still further, in various embodiments, the first channel has an average depth in the central region that is less than an average depth of the first channel in the toe side region and that is less than an average depth of the first channel in the heel side region. In various embodiments, the first channel has an average depth in the central region that is greater than an average depth of the first channel in the toe side region. In various embodiments, the first channel has an average depth in the central region that is greater than an average depth of the first channel in the heel side region. In various embodiments, the first channel has an average depth in the central region that is greater than an average depth of the first channel in the toe side region and that is greater than an average depth of the first channel in the heel side region.

In various embodiments, the sole bar defines a second channel extending in a substantially heel-to-toe direction of the sole bar and having a second channel opening located on an upper surface of the sole bar, the second channel having a second channel length, a second channel depth, and a second channel width.

In various embodiments, the central region of the body is defined as: $-20\text{ mm}<x<20\text{ mm}$. In various embodiments, the central region of the body is defined as: $-15\text{ mm}<x<15\text{ mm}$.

In various embodiments, $0.8\text{ mm}<T_{FS}<3.0\text{ mm}$. In various embodiments, $1.0\text{ mm}<T_{FS}<2.5\text{ mm}$.

In various embodiments, the first channel has a first channel length L1, the body has a sole length $L_B$, and a ratio of the first channel length to the sole length satisfies the following inequality: $0.35<L1/L_B<0.67$.

In various embodiments, the first channel defines a first channel depth H1 that comprises the vertical distance from the ground plane to the uppermost point of the first channel, the body defines a body height $H_{CH}$ that comprises the vertical distance from the ground plane to the uppermost point of the body, and a ratio of an average value of the first channel depth H1 within the central region to the body height $H_{CH}$ satisfies the following inequality: $0.07<H1_{AVG}/H_{CH}<0.50$.

In various embodiments, the first channel defines a first channel centerline and the face portion defines a face plane. In these embodiments, projections of the first channel centerline and the face plane onto the ground plane define a face to channel distance D1, the sole portion defines a sole width D3, and a ratio of an average value of the face to channel distance D1 within the central region to an average value of the sole width D3 within the central region satisfies the following inequality: $0.15<D1/D3<0.71$.

In various embodiments, the body defines an interior cavity, and the body has a volume V that satisfies the following inequality: $10\text{ cc}<V<120\text{ cc}$. In some of these embodiments, the body has a volume V that satisfies the following inequality: $40\text{ cc}<V<90\text{ cc}$. In some of these embodiments, the body has a volume V that satisfies the following inequality: $60\text{ cc}<V<80\text{ cc}$.

In various embodiments, the body defines a club head depth, $D_{CH}$ that satisfies the following inequality: $15\text{ mm}<D_{CH}<100\text{ mm}$. In some of these embodiments, the body has a club head depth that satisfies the following inequality: $30\text{ mm}<D_{CH}<80\text{ mm}$. In some of these embodiments, the body has a club head depth that satisfies the following inequality: $40\text{ mm}<D_{CH}<70\text{ mm}$.

In various embodiments, a filler material is located in the first channel. In various embodiments, a filler material is located in more than one channel.

In a second aspect, a club head for an iron-type golf club includes a body having a heel portion, a sole portion, a toe portion, a top-line portion, and a face portion, with the sole portion extending rearwardly from a lower end of the face portion. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. In various embodiments, the body includes a central region in which $-25\text{ mm}<x<25\text{ mm}$. The sole portion that is contained within the central region includes a forward sole region located adjacent to the face portion and a sole bar located rearward of the forward sole region, the sole bar defining a first channel extending in a substantially heel-to-toe direction of the sole portion and having a first channel opening located on a bottom surface of the sole bar. The first channel defines a first channel centerline and the face portion defines a face plane, such that projections of the first channel centerline and the face plane onto the ground plane define a face to channel distance D1. The sole portion defines a sole width D3. A ratio of an average value of the face to channel distance D1 within the central region to an average value of the sole width D3 within the central region satisfies the following inequality: $0.15<D1/D3<0.71$.

In various embodiments, the forward sole region defines a wall having a minimum forward sole thickness $T_{FS}$ and the sole bar defines a body having a maximum sole bar thickness $T_{SB}$, such that $0.05<T_{FS}/T_{SB}<0.4$.

In various embodiments, $0.8\text{ mm}<T_{FS}<3.0\text{ mm}$. In various embodiments, $1.0\text{ mm}<T_{FS}<2.5\text{ mm}$.

In various embodiments, the first channel has a first channel length L1, the body has a sole length $L_B$, and a ratio of the first channel length to the sole length satisfies the following inequality: $0.35<L1/L_B<0.67$.

In various embodiments, the first channel defines a first channel depth H1 that comprises the vertical distance from the ground plane to the uppermost point of the first channel, the body defines a body height $H_{CH}$ that comprises the vertical distance from the ground plane to the uppermost point of the body, and a ratio of an average value of the first channel depth H1 within the central region to the body height $H_{CH}$ satisfies the following inequality: $0.07<H1_{AVG}/H_{CH}<0.50$.

In various embodiments, the body defines an interior cavity, and the body has a volume V that satisfies the following inequality: $10\text{ cc}<V<120\text{ cc}$. In some of these embodiments, the body has a volume V that satisfies the following inequality: $40\text{ cc}<V<90\text{ cc}$. In some of these embodiments, the body has a volume V that satisfies the following inequality: 60 cc<V<80 cc.

In various embodiments, the body defines a club head depth, $D_{CH}$ that satisfies the following inequality: 15 mm<$D_{CH}$<100 mm. In some of these embodiments, the body has a club head depth that satisfies the following inequality: 30 mm<$D_{CH}$<80 mm. In some of these embodiments, the body has a club head depth that satisfies the following inequality: 40 mm<$D_{CH}$<70 mm.

In various embodiments, a filler material is located in the first channel. In various embodiments, a filler material is located in more than one channel.

In various embodiments, a club head for an iron-type golf club includes a body having a heel portion, a sole portion, a toe portion, a top-line portion, and a face portion, with the sole portion extending rearwardly from a lower end of the face portion. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The sole portion includes a forward sole region located adjacent to the face portion and a sole bar located rearward of the forward sole region, with the sole bar defining a first channel extending in a substantially heel-to-toe direction of the sole portion and having a first channel opening located on a bottom surface of the sole bar. The first channel has a first channel length L1, the body has a sole length $L_B$, and a ratio of the first channel length to the sole length satisfies the following inequality: 0.35<L1/$L_B$<0.67.

In various embodiments, the forward sole region defines a wall having a minimum forward sole thickness $T_{FS}$ and the sole bar defines a body having a maximum sole bar thickness $T_{SB}$, such that 0.05<$T_{FS}/T_{SB}$<0.4.

In various embodiments, 0.8 mm<$T_{FS}$<3.0 mm. In various embodiments, 1.0 mm<$T_{FS}$<2.5 mm.

In various embodiments, the first channel defines a first channel depth H1 that includes the vertical distance from the ground plane to the uppermost point of the first channel, the body defines a body height $H_{CH}$ that includes the vertical distance from the ground plane to the uppermost point of the body, and a ratio of an average value of the first channel depth H1 within the central region to the body height $H_{CH}$ satisfies the following inequality: 0.07<$H1_{AVG}/H_{CH}$<0.50.

In various embodiments, the body defines an interior cavity, and the body has a volume V that satisfies the following inequality: 10 cc<V<120 cc. In some of these embodiments, the body has a volume V that satisfies the following inequality: 40 cc<V<90 cc. In some of these embodiments, the body has a volume V that satisfies the following inequality: 60 cc<V<80 cc.

In various embodiments, the body defines a club head depth, $D_{CH}$ that satisfies the following inequality: 15 mm<$D_{CH}$<100 mm. In some of these embodiments, the body has a club head depth that satisfies the following inequality: 30 mm<$D_{CH}$<80 mm. In some of these embodiments, the body has a club head depth that satisfies the following inequality: 40 mm<$D_{CH}$<70 mm.

In various embodiments, a filler material is located in the first channel. In various embodiments, a filler material is located in more than one channel.

In various embodiments, a club head for an iron-type golf club includes a body having a heel portion, a sole portion, a toe portion, a top-line portion, and a face portion, with the sole portion extending rearwardly from a lower end of the face portion. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The body includes a central region in which −25 mm<x<25 mm. The sole portion that is contained within the central region includes a forward sole region located adjacent to the face portion and a sole bar located rearward of the forward sole region, the sole bar defining a first channel extending in a substantially heel-to-toe direction of the sole portion and having a first channel opening located on a bottom surface of the sole bar. The first channel defines a first channel depth H1 that comprises the vertical distance from the ground plane to the uppermost point of the first channel, the body defines a body height $H_{CH}$ that comprises the vertical distance from the ground plane to the uppermost point of the body, and a ratio of an average value of the first channel depth H1 within the central region to the body height $H_{CH}$ satisfies the following inequality: 0.07<$H1_{AVG}/H_{CH}$<0.50.

In various embodiments, the forward sole region defines a wall having a minimum forward sole thickness $T_{FS}$ and the sole bar defines a body having a maximum sole bar thickness $T_{SB}$, such that 0.05<$T_{FS}/T_{SB}$<0.4.

In various embodiments, 0.8 mm<$T_{FS}$<3.0 mm. In various embodiments, 1.0 mm<$T_{FS}$<2.5 mm.

In various embodiments, the first channel has a first channel length L1, the body has a sole length $L_B$, and a ratio of the first channel length to the sole length satisfies the following inequality: 0.35<L1/$L_B$<0.67.

In various embodiments, the body defines an interior cavity, and the body has a volume V that satisfies the following inequality: 10 cc<V<120 cc. In some of these embodiments, the body has a volume V that satisfies the following inequality: 40 cc<V<90 cc. In some of these embodiments, the body has a volume V that satisfies the following inequality: 60 cc<V<80 cc.

In various embodiments, the body defines a club head depth, $D_{CH}$ that satisfies the following inequality: 15 mm<$D_{CH}$<100 mm. In some of these embodiments, the body has a club head depth that satisfies the following inequality: 30 mm<$D_{CH}$<80 mm. In some of these embodiments, the body has a club head depth that satisfies the following inequality: 40 mm<$D_{CH}$<70 mm.

In various embodiments, a filler material is located in the first channel. In various embodiments, a filler material is located in more than one channel.

In various embodiments, a set of iron-type golf clubs includes a first subset of at least one iron-type golf club and a second subset of at least one iron-type golf club. The first subset includes at least one club head with a loft that is less than or equal to 30°, a face portion, a heel portion, a toe portion, a sole portion, and a top-line portion, with the sole portion defining a flexible boundary structure comprising a slot or a channel having a length of from about 15 mm to about 85 mm. The second subset includes at least one club head with a loft that is greater than 30°, a face portion, a heel portion, a toe portion, a sole portion, and a top-line portion, with the sole portion having no flexible boundary structure comprising a slot or a channel having a length of from about 15 mm to about 85 mm.

In various embodiments, the first subset includes at least two golf clubs, at least three golf clubs, at least four golf clubs, or at least five golf clubs. In various embodiments, the second subset includes at least two golf clubs, at least three golf clubs, at least four golf clubs, or at least five golf clubs.

In various embodiments, each of the golf clubs of the first subset includes a body having a heel portion, a sole portion, a toe portion, a top-line portion, and a face portion, with the sole portion extending rearwardly from a lower end of the face portion. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The body includes a central region in which $-25$ mm$<x<25$ mm. The sole portion that is contained within the central region includes a forward sole region located adjacent to the face portion and a sole bar located rearward of the forward sole region, with the forward sole region defining a wall having a minimum forward sole thickness $T_{FS}$ and the sole bar defining a body having a maximum sole bar thickness $T_{SB}$, such that $0.05<T_{FS}/T_{SB}<0.4$. The sole bar defines a first channel extending in a substantially heel-to-toe direction of the sole portion and having a first channel opening located on a bottom surface of the sole bar.

In various embodiments, 0.8 mm$<T_{FS}<$3.0 mm. In various embodiments, 1.0 mm$<T_{FS}<$2.5 mm.

In various embodiments, the first channel has a first channel length L1, the body has a sole length $L_B$, and a ratio of the first channel length to the sole length satisfies the following inequality: $0.35<L1/L_B<0.67$.

In various embodiments, the first channel defines a first channel depth H1 that comprises the vertical distance from the ground plane to the uppermost point of the first channel, the body defines a body height $H_{CH}$ that comprises the vertical distance from the ground plane to the uppermost point of the body, and a ratio of an average value of the first channel depth H1 within the central region to the body height $H_{CH}$ satisfies the following inequality: $0.07<H1_{AVG}/H_{CH}<0.50$.

In various embodiments, the first channel defines a first channel centerline and the face portion defines a face plane. In these embodiments, projections of the first channel centerline and the face plane onto the ground plane define a face to channel distance D1, the sole portion defines a sole width D3, and a ratio of an average value of the face to channel distance D1 within the central region to an average value of the sole width D3 within the central region satisfies the following inequality: $0.15<D1/D3<0.71$.

In various embodiments, the body defines an interior cavity, and the body has a volume V that satisfies the following inequality: 10 cc$<V<$120 cc. In some of these embodiments, the body has a volume V that satisfies the following inequality: 40 cc$<V<$90 cc. In some of these embodiments, the body has a volume V that satisfies the following inequality: 60 cc$<V<$80 cc.

In various embodiments, the body defines a club head depth, $D_{CH}$ that satisfies the following inequality: 15 mm$<D_{CH}<$100 mm. In some of these embodiments, the body has a club head depth that satisfies the following inequality: 30 mm$<D_{CH}<$80 mm. In some of these embodiments, the body has a club head depth that satisfies the following inequality: 40 mm$<D_{CH}<$70 mm.

In various embodiments, a club head for an iron-type golf club includes a body having a heel portion, a sole portion, a toe portion, a top-line portion, and a face portion, wherein said sole portion extends rearwardly from a lower end of said face portion, the body further defining a rear void. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The body includes a central region in which $-25$ mm$<x<25$ mm. The sole portion that is contained within the central region includes a forward sole region located adjacent to the face portion and a sole bar located rearward of the forward sole region, with the forward sole region defining a wall having a minimum forward sole thickness $T_{FS}$ and the sole bar defining a body having a maximum sole bar thickness $T_{SB}$, such that $0.05<T_{FS}/T_{SB}<0.4$. The sole portion includes a slot extending in a substantially heel-to-toe direction of the sole portion, the slot defining a portion of a path that extends through the sole portion and into the rear void.

In various embodiments, the slot has a slot length comprising the distance between a part of the slot nearest the toe portion and a part of the slot nearest the heel region, with the slot length being from about 15 mm to about 85 mm.

In various embodiments, 0.8 mm$<T_{FS}<$3.0 mm.

In various embodiments, the slot has a slot length L1, the body has a sole length $L_B$, and a ratio of the slot length to the sole length satisfies the following inequality: $0.35<L1/L_B<0.67$.

In various embodiments, the body defines an interior cavity, and the body has a volume V that satisfies the following inequality: 10 cc$<V<$120 cc.

In various embodiments, a filler material is located in the slot. In various embodiments, a filler material is located in more than one channel.

In various embodiments, the face portion defines a face plane and the path includes a lower path portion having a length of at least 1 mm and defining a lower path angle that is within 30° of being parallel with said face plane, an intermediate path portion having a length of at least 1 mm and defining an intermediate path angle that is within 30° of being perpendicular to said face plane, and an upper path portion having a length of at least 1 mm and defining an upper path angle that is within 30° of being parallel with said face plane.

In various embodiments, a club head for an iron-type golf club includes a body having a heel portion, a sole portion, a toe portion, a top-line portion, and a face portion, wherein said sole portion extends rearwardly from a lower end of said face portion, the body further defining a rear void. The face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane. In the coordinate system, a positive x-axis extends toward the heel portion from the origin, a positive y-axis extends rearwardly from the origin, and a positive z-axis extends upwardly from the origin. The body includes a central region in which −25 mm<x<25 mm. The sole portion that is contained within the central region includes a forward sole region located adjacent to the face portion and a sole bar located rearward of the forward sole region, with the forward sole region defining a wall having a minimum forward sole thickness $T_{FS}$ and the sole bar defining a body having a maximum sole bar thickness $T_{SB}$. The sole portion includes a slot extending in a substantially heel-to-toe direction of the sole portion, the slot defining a portion of a path that extends through the sole portion and into the rear void, with the path including a lower path portion having a length of at least 1 mm and defining a lower path angle that is within 30° of being parallel with said face plane, an intermediate path portion having a length of at least 1 mm and defining an intermediate path angle that is within 30° of being perpendicular to said face plane, and an upper path portion having a length of at least 1 mm and defining an upper path angle that is within 30° of being parallel with said face plane.

In various embodiments, the slot has a slot length comprising the distance between a part of the slot nearest the toe portion and a part of the slot nearest the heel region, with the slot length being from about 15 mm to about 85 mm.

In various embodiments, 0.8 mm<$T_{FS}$<3.0 mm.

In various embodiments, the slot has a slot length L1, the body has a sole length $L_B$, and a ratio of the slot length to the sole length satisfies the following inequality: $0.35<L1/L_B<0.67$.

In various embodiments, the body defines an interior cavity, and the body has a volume V that satisfies the following inequality: 10 cc<V<120 cc.

In various embodiments, a filler material is located in the slot. In various embodiments, a filler material is located in more than one channel.

In various embodiments, flexible boundary structures may be found in various locations on the golf club head, including defined within the striking face, defined within the sole portion, and defined within the perimeter of the golf club head. Various performance characteristics may be altered by location, size, and arrangement of various channels. Various relief features may be utilized to provide durability and performance of the various flexible boundary structures. In various embodiments, flexible boundary structures may alter auditory profile of the golf club head thereby allowing for the isolation of preferred auditory profile of the golf club head.

The foregoing and other features and advantages of the golf club heads described herein will become more apparent from the following detailed description, which proceeds with reference to the accompanying figures.

Iron Type Golf Club Heads

FIG. 1A illustrates an iron type golf club head 100 including a body 113 having a heel 102, a toe portion 104, a sole portion 108, a top line portion 106, and a hosel 114. The golf club head 100 is shown in FIG. 1A in a normal address position with the sole portion 108 resting upon a ground plane 111, which is assumed to be perfectly flat. As used herein, "normal address position" means the club head position wherein a vector normal to the center of the club face substantially lies in a first vertical plane (i.e., a vertical plane is perpendicular to the ground plane 111), a centerline axis 115 of the hosel 114 substantially lies in a second vertical plane, and the first vertical plane and the second vertical plane substantially perpendicularly intersect. The center of the club face is determined using the procedures described in the USGA "Procedure for Measuring the Flexibility of a Golf Club head," Revision 2.0, Mar. 25, 2005.

A lower tangent point 190 on the outer surface of the club head 100 of a line 191 forming a 45° angle relative to the ground plane 111 defines a demarcation boundary between the sole portion 108 and the toe portion 104. Similarly, an upper tangent point 192 on the outer surface of the club head 100 of a line 193 forming a 45° angle relative to the ground plane 111 defines a demarcation boundary between the top line portion 106 and the toe portion 104. In other words, the portion of the club head that is above and to the left (as viewed in FIG. 1A) of the lower tangent point 190 and below and to the left (as viewed in FIG. 1A) of the upper tangent point 192 is the toe portion 104.

The striking face 110 defines a face plane 125 and includes grooves 112 that are designed for impact with the golf ball. It should be noted that, in some embodiments, the toe portion 104 may be understood to be any portion of the golf club head 100 that is toeward of the grooves 112. In some embodiments, the golf club head 100 can be a single unitary cast piece, while in other embodiments, a striking plate can be formed separately to be adhesively or mechanically attached to the body 113 of the golf club head 100.

Figure 1B:
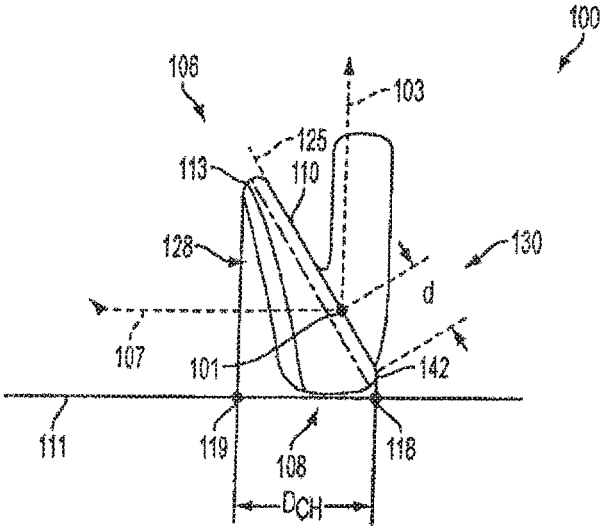
FIG. 1B is an elevated toe perspective view of a golf club head.

FIGS. 1A and 1B also show an ideal striking location 101 on the striking face 110 and respective orthogonal CG axes. As used herein, the ideal striking location 101 is located within the face plane 125 and coincides with the location of the center of gravity (CG) of the golf club head along the CG x-axis 105 (i.e., CG-x) and is offset from the leading edge 142 (defined as the midpoint of a radius connecting the sole portion 108 and the face plane 125) by a distance d of 16.5 mm within the face plane 125, as shown in FIG. 1B. A CG x-axis 105, CG y-axis 107, and CG z-axis 103 intersect at the ideal striking location 101, which defines the origin of the orthogonal CG axes. With the golf club head 100 in the normal address position, the CG x-axis 105 is parallel to the ground plane 111 and is oriented perpendicular to a normal extending from the striking face 110 at the ideal striking location 101. The CG y-axis 107 is also parallel to the ground plane and is perpendicular to the CG x-axis 105. The CG z-axis 103 is oriented perpendicular to the ground plane. In addition, a CG z-up axis 109 is defined as an axis perpendicular to the ground plane 111 and having an origin at the ground plane 111.

In certain embodiments, a desirable CG-y location is between about 0.25 mm to about 20 mm along the CG y-axis 107 toward the rear portion of the club head. Additionally, a desirable CG-z location is between about 12 mm to about 25 mm along the CG z-up axis 109, as previously described.

Figure 1C:
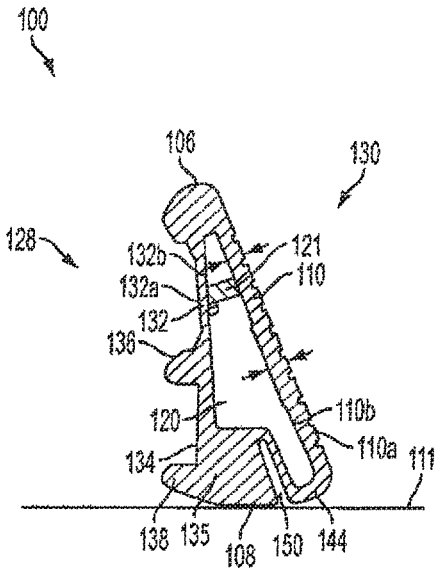
FIG. 1C is a cross-sectional view taken along section lines 1B-1B in FIG. 1A, showing an embodiment of a hollow club head.
Figure 1D:
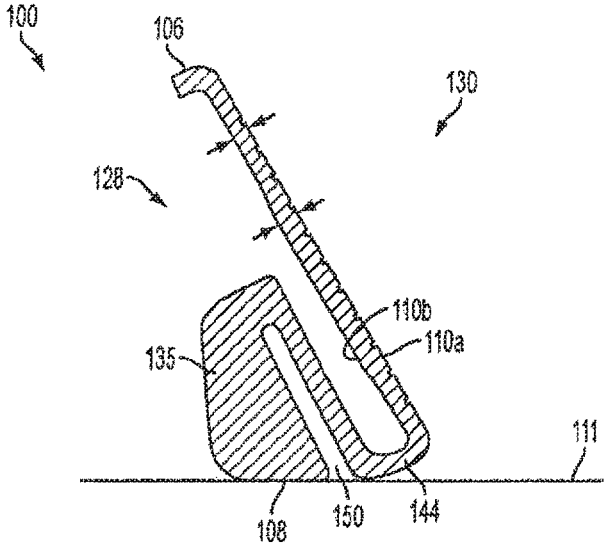
FIG. 1D is a cross-sectional view taken along section lines 1B-1B in FIG. 1A, showing an embodiment of a cavity back club head.

The golf club head may be of solid (also referred to as "blades" and/or "musclebacks"), hollow, cavity back, or other construction. FIG. 1C shows a cross sectional side view along the cross-section lines 1C-1C shown in FIG. 1A of an embodiment of the golf club head having a hollow construction. FIG. 1D shows a cross sectional side view along the cross-section lines 1D-1D of an embodiment of a golf club head having a cavity back construction. The cross-section lines 1C, 1D-1C, 1D are taken through the ideal striking location 101 on the striking face 110. The striking face 110 includes a front surface 110*a* and a rear surface 110*b*. Both the hollow iron golf club head and cavity back iron golf club head embodiments further include a back portion 128 and a front portion 130.

In the embodiments shown in FIGS. 1A-1D, the grooves 112 are located on the striking face 110 such that they are centered along the CG x-axis about the ideal striking location 101, i.e., such that the ideal striking location 101 is located within the striking face plane 125 on an imaginary line that is both perpendicular to and that passes through the midpoint of the longest score-line groove 112. In other embodiments (not shown in the drawings), the grooves 112 may be shifted along the CG x-axis to the toe side or the heel side relative to the ideal striking location 101, the grooves 112 may be aligned along an axis that is not parallel to the ground plane 111, the grooves 112 may have discontinuities along their lengths, or the grooves may not be present at all. Still other shapes, alignments, and/or orientations of grooves 112 on the surface of the striking face 110 are also possible.

In reference to FIG. 1A, the club head 100 has a sole length, $L_B$, and a club head height, $H_{CH}$. The sole length, $L_B$, is defined as the distance between two points projected onto the ground plane 111. A heel side 116 of the sole is defined as the intersection of a projection of the hosel axis 115 onto the ground plane 111. A toe side 117 of the sole is defined as the intersection point of the vertical projection of the lower tangent point 190 (described above) onto the ground plane 111. The distance between the heel side 116 and toe side 117 of the sole is the sole length $L_B$ of the club head. The club head height, $H_{CH}$, is defined as the distance between the ground plane 111 and the uppermost point of the club head as projected in the x-z plane, as illustrated in FIG. 1A.

FIG. 1B illustrates an elevated toe view of the golf club head 100 including a back portion 128, a front portion 130, a sole portion 108, a top line portion 106, and a striking face 110, as previously described. A leading edge 142 is defined by the midpoint of a radius connecting the face plane 125 and the sole portion 108. The club head includes a club head front-to-back depth, $D_{CH}$, which is the distance between two points projected onto the ground plane 111. A forward end 118 of the club head is defined as the intersection of the projection of the leading edge 142 onto the ground plane 111. A rearward end 119 of the club head is defined as the intersection of the projection of the rearward-most point of the club head (as viewed in the y-z plane) onto the ground plane 111. The distance between the forward end 118 and rearward end 119 of the club head is the club head depth $D_{CH}$.

In certain embodiments of iron type golf club heads having hollow construction, such as the embodiment shown in FIG. 1C, a recess 134 is located above the rear protrusion 138 in the back portion 128 of the club head. A back wall 132 encloses the entire back portion 128 of the club head to define an interior cavity 120. The interior cavity 120 may be completely or partially hollow, or it optionally may be filled with a filler material. In the embodiment shown in FIG. 1C, the interior cavity 120 includes a vibration dampening plug 121 that is retained between the rear surface 110*b* of the striking face and the inner surface 132*b* of the back wall. Suitable filler materials and details relating to the nature and materials comprising the plug 121 are described in US Patent Application Publication No. 2011/0028240, which is incorporated herein by reference.

FIG. 1C further shows an optional ridge 136 extending across a portion of the outer back wall surface 132*a* forming an upper concavity and a lower concavity. An inner back wall surface 132*b* defines a portion of the cavity 120 and forms a thickness between the outer back wall surface 132*a* and the inner back wall surface 132*b*. In some embodiments, the back wall thickness varies between a thickness of about 0.5 mm to about 4 mm. A sole bar 135 is located in a low, rearward portion of the club head 100. The sole bar 135 has a relatively large thickness in relation to the striking plate and other portions of the club head 100, thereby accounting for a significant portion of the mass of the club head 100, and thereby shifting the center of gravity (CG) of the club head 100 relatively lower and rearward. A channel 150—described more fully below—is formed in the sole bar 135. Furthermore, the sole portion 108 has a forward portion 144 that is located immediately rearward of the striking face 110. In the embodiment shown in FIG. 1C, the forward portion 144 of the sole is a relatively thin-walled section of the sole that extends within a region between the channel 150 and the striking face 110.

FIG. 1D further shows a sole bar 135 of the cavity back golf club head 100. The sole bar 135 has a relatively large thickness in relation to the striking plate and other portions of the golf club head 100, thereby accounting for a significant portion of the mass of the golf club head 100, and thereby shifting the center of gravity (CG) of the golf club head 100 relatively lower and rearward. The embodiment shown in FIG. 1D also includes a forward portion 144 of the sole that has a reduced sole thickness and that extends within between the sole bar 135 and the striking face 110. A channel 150—described more fully below—is located in a forward region of the sole bar 135.

Figure 1E:
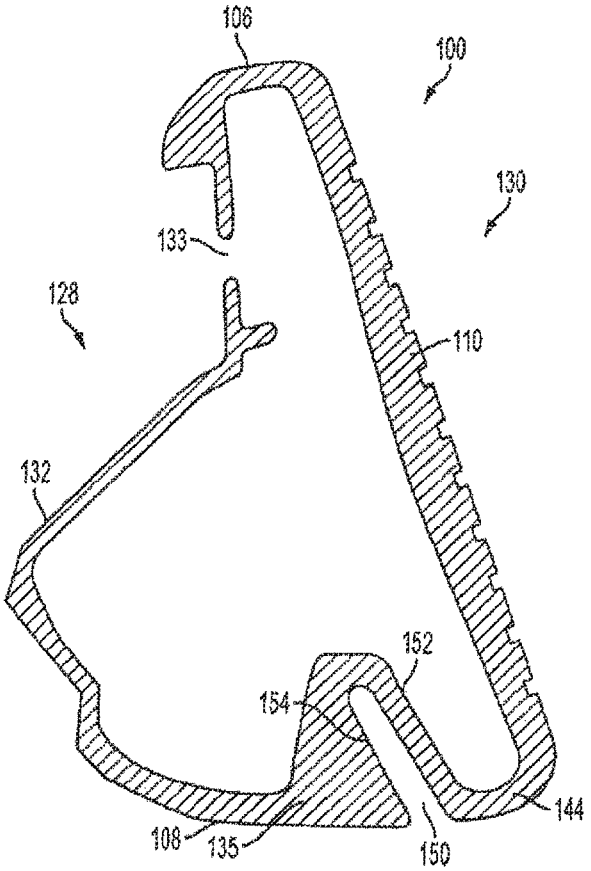
FIG. 1E is a cross-sectional view taken along section lines 1B-1B in FIG. 1A, showing another embodiment of a hollow club head.
Figure 1F:
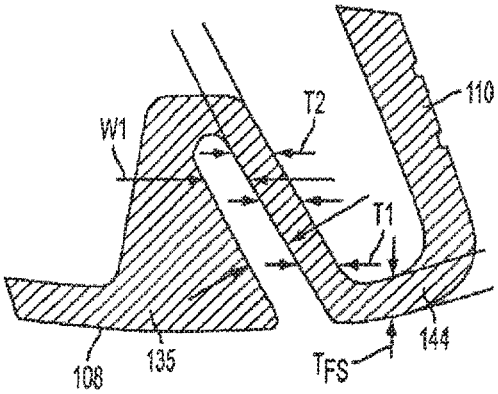
FIG. 1F is a cross-sectional view showing a portion of the embodiment of the hollow club head shown in FIG. 1E.

FIG. 1E shows another embodiment of a hollow iron club head 100 having a channel 150. As with the embodiment shown in FIG. 1C, the club head 100 includes a striking face 110, a top line 106, a sole 108, and a back wall 132. The sole includes a sole bar 135 having a channel 150 defined by a forward wall 152 and rear wall 154. A forward portion 144 of the sole is located between the striking face 110 and the forward wall 152 of the slot. The hollow club head 100 includes an aperture 133 that is suitable for installing a vibration dampening plug 121 like that shown in FIG. 1C, and which is described in more detail in US Patent Application Publication No. 2011/0028240, which is incorporated by reference. Installation of the vibration dampening plug 121 effectively seals the aperture 133.

In some embodiments, the volume of the hollow iron club head 100 may be between about 10 cubic centimeters (cc) and about 120 cc. For example, in some embodiments, the hollow iron club head 100 may have a volume between about 20 cc and about 110 cc, such as between about 30 cc and about 100 cc, such as between about 40 cc and about 90 cc, such as between about 50 cc and about 80 cc, such as between about 60 cc and about 80 cc. In addition, in some embodiments, the hollow iron club head 100 has a club head depth, $D_{CH}$, that is between about 15 mm and about 100 mm. For example, in some embodiments, the hollow iron club head 100 may have a club head depth, $D_{CH}$, of between about 20 mm and about 90 mm, such as between about 30 mm and about 80 mm, such as between about 40 mm and about 70 mm.

In certain embodiments of the golf club head 100 that include a separate striking plate attached to the body 113 of the golf club head, the striking plate can be formed of forged maraging steel, maraging stainless steel, or precipitation-hardened (PH) stainless steel. In general, maraging steels have high strength, toughness, and malleability. Being low in carbon, they derive their strength from precipitation of inter-metallic substances other than carbon. The principle alloying element is nickel (15% to nearly 30%). Other alloying elements producing inter-metallic precipitates in these steels include cobalt, molybdenum, and titanium. In one embodiment, the maraging steel contains 18% nickel.

Maraging stainless steels have less nickel than maraging steels but include significant chromium to inhibit rust. The chromium augments hardenability despite the reduced nickel content, which ensures the steel can transform to martensite when appropriately heat-treated. In another embodiment, a maraging stainless steel C455 is utilized as the striking plate. In other embodiments, the striking plate is a precipitation hardened stainless steel such as 17-4, 15-5, or 17-7.

The striking plate can be forged by hot press forging using any of the described materials in a progressive series of dies. After forging, the striking plate is subjected to heat-treatment. For example, 17-4 PH stainless steel forgings are heat treated by 1040° C. for 90 minutes and then solution quenched. In another example, C455 or C450 stainless steel forgings are solution heat-treated at 830° C. for 90 minutes and then quenched.

In some embodiments, the body 113 of the golf club head is made from 17-4 steel. However another material such as carbon steel (e.g., 1020, 1030, 8620, or 1040 carbon steel), chrome-molybdenum steel (e.g., 4140 Cr—Mo steel), Ni—Cr—Mo steel (e.g., 8620 Ni—Cr—Mo steel), austenitic stainless steel (e.g., 304, N50, or N60 stainless steel (e.g., 410 stainless steel) can be used.

In addition to those noted above, some examples of metals and metal alloys that can be used to form the components of the parts described include, without limitation: titanium alloys (e.g., 3-2.5, 6-4, SP700, 15-3-3-3, 10-2-3, or other alpha/near alpha, alpha-beta, and beta/near beta titanium alloys), aluminum/aluminum alloys (e.g., 3000 series alloys, 5000 series alloys, 6000 series alloys, such as 6061-T6, and 7000 series alloys, such as 7075), magnesium alloys, copper alloys, and nickel alloys.

In still other embodiments, the body 113 and/or striking plate of the golf club head are made from fiber-reinforced polymeric composite materials, and are not required to be homogeneous. Examples of composite materials and golf club components comprising composite materials are described in U.S. Patent Application Publication No. 2011/0275451, which is incorporated herein by reference in its entirety.

The body 113 of the golf club head can include various features such as weighting elements, cartridges, and/or inserts or applied bodies as used for CG placement, vibration control or damping, or acoustic control or damping. For example, U.S. Pat. No. 6,811,496, incorporated herein by reference in its entirety, discloses the attachment of mass altering pins or cartridge weighting elements.

After forming the striking plate and the body 113 of the golf club head, the striking plate and body portion 113 contact surfaces can be finish-machined to ensure a good interface contact surface is provided prior to welding. In some embodiments, the contact surfaces are planar for ease of finish machining and engagement.

Iron Type Golf Club Heads Having a Flexible Boundary Structure

In some embodiments of the iron type golf club heads described herein, a flexible boundary structure ("FBS") is provided at one or more locations on the club head. The flexible boundary structure may comprise, in several embodiments, at least one slot, at least one channel, at least one gap, at least one thinned or weakened region, and/or at least one other structure that enhances the capability of an adjacent or related portion of the golf club head to flex or deflect and to thereby provide a desired improvement in the performance of the golf club head. For example, in several embodiments, the flexible boundary structure is located proximate the striking face of the golf club head in order to enhance the deflection of the striking face upon impact with a golf ball during a golf swing. The enhanced deflection of the striking face may result, for example, in an increase or in a desired decrease in the coefficient of restitution ("COW") of the golf club head. In other embodiments, the increased perimeter flexibility of the striking face may cause the striking face to deflect in a different location and/or different manner in comparison to the deflection that occurs upon striking a golf ball in the absence of the channel, slot, or other flexible boundary structure.

Figure 2A:
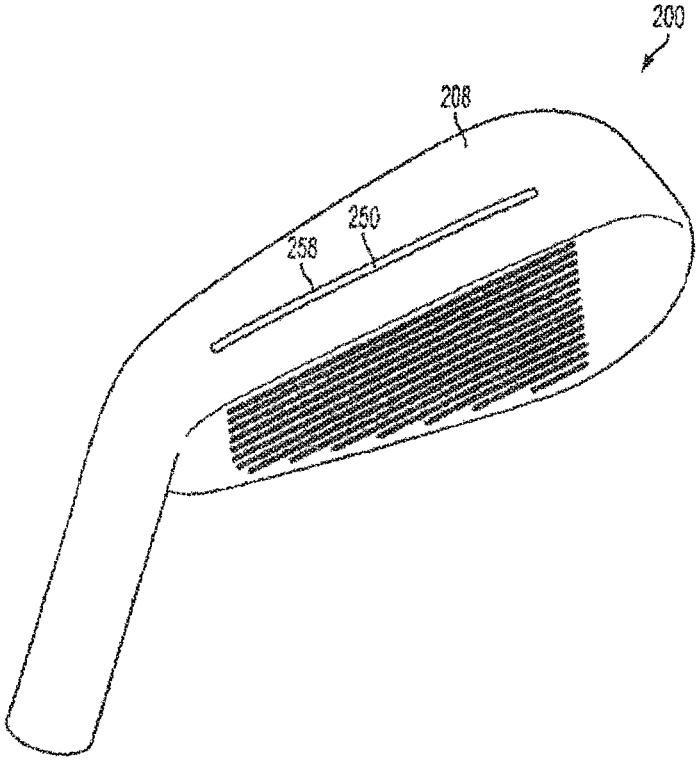
FIG. 2A is a bottom perspective view of an embodiment of a golf club head.
Figure 2B:
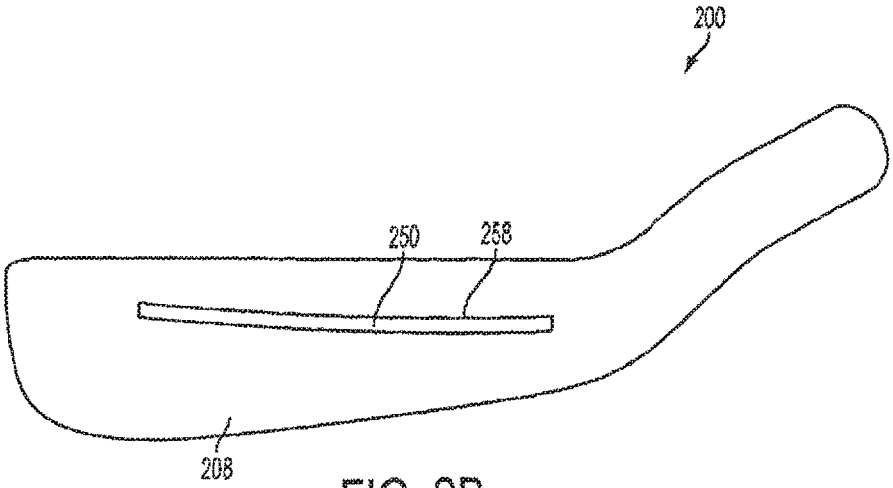
FIG. 2B is a bottom view of the sole of the golf club head shown in FIG. 2A.
Figure 2C:
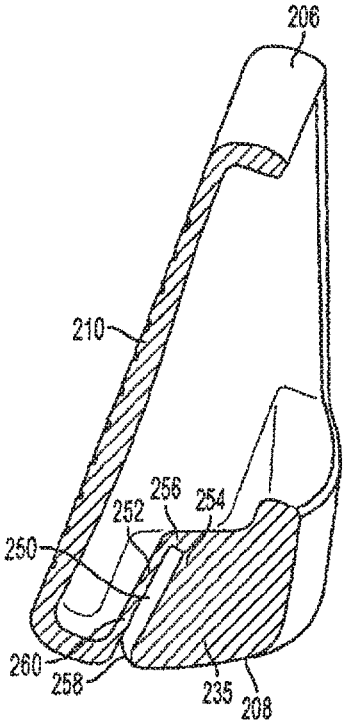
FIG. 2C is a cross-sectional view of the golf club head shown in FIG. 2A.

Turning to FIGS. 2A-2C, an embodiment of a cavity back golf club head 200 having a flexible boundary structure is shown. In the embodiment, the flexible boundary structure is a channel 250 that is located on the sole of the club head. It should be noted that, as described above, the flexible boundary structure may comprise a slot, a channel, a gap, a thinned or weakened region, or other structure. For clarity, however, the descriptions herein will be limited to embodiments containing a channel, such as the channel 250 illustrated in FIGS. 2A-C, or a slot, included in several embodiments described below, with it being understood that other flexible boundary structures may be used to achieve the benefits described herein.

The channel 250 extends over a region of the sole 208 generally parallel to and spaced rearwardly from the striking face plane 225. The channel extends into and is defined by a forward portion of the sole bar 235, defining a forward wall 252, a rear wall 254, and an upper wall 256. A channel opening 258 is defined on the sole portion 208 of the club head. The forward wall 252 further defines, in part, a first hinge region 260 located at the transition from the forward portion of the sole 244 to the forward wall 252, and a second hinge region 262 located at a transition from the upper region of the forward wall 252 to the sole bar 235. The first hinge region 260 and second hinge region 262 are portions of the golf club head that contribute to the increased deflection of the striking face 210 of the golf club head due to the presence of the channel 250. In particular, the shape, size, and orientation of the first hinge region 260 and second hinge region 262 are designed to allow these regions of the golf club head to flex under the load of a golf ball impact. The flexing of the first hinge region 260 and second hinge region 262, in turn, creates additional deflection of the striking face 210.

Several aspects of the size, shape, and orientation of the club head 200 and channel 250 are illustrated in the embodiment shown in FIGS. 2A-H. For example, for each cross-section of the club head defined within the y-z plane, the face to channel distance D1 is the distance measured on the ground plane 211 between a face plane projection point 226 and a channel centerline projection point 227. (See FIG. 2F). The face plane projection point 226 is defined as the intersection of a projection of the striking face plane 225 onto the ground plane 211. The channel centerline projection point 227 is defined as the intersection of a projection of a channel centerline 229 onto the ground plane 211. The channel centerline 229 is determined according to the following.

Figure 2D:
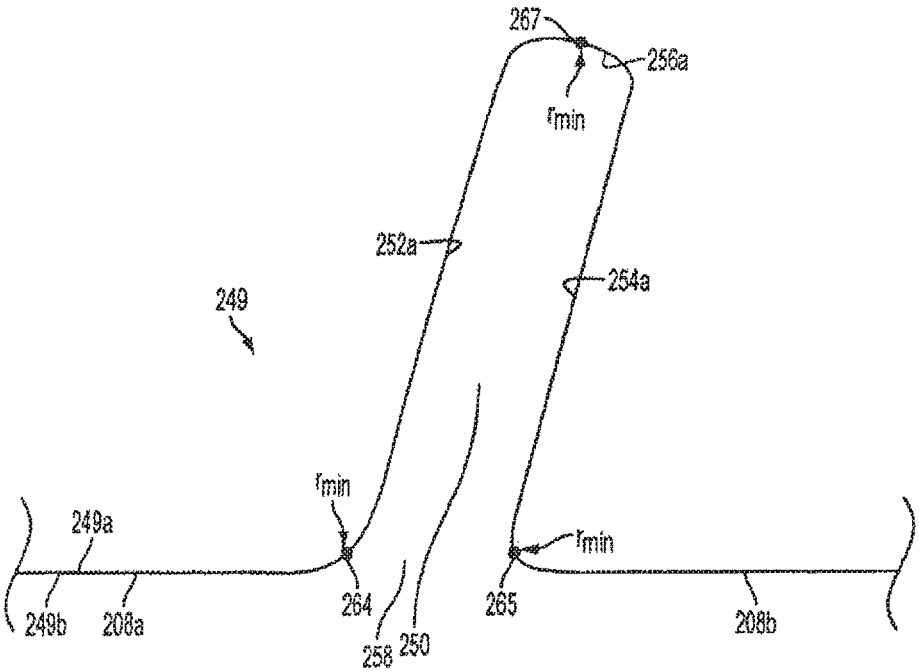
FIGS. 2D-E are schematic representations of a profile of the outer surface of a portion of a club head that surrounds and includes the region of a channel.
Figure 2E:
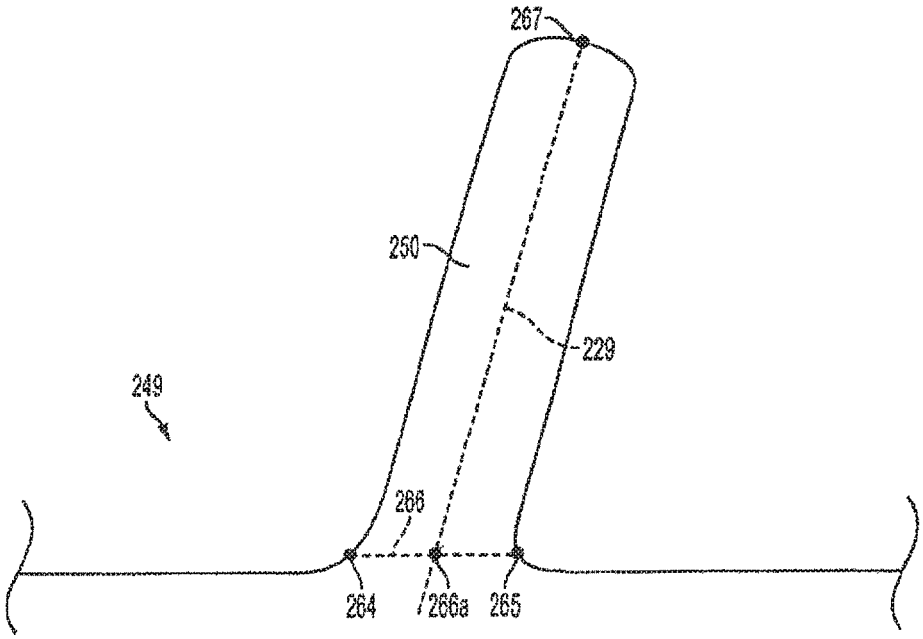
Figure 2F:
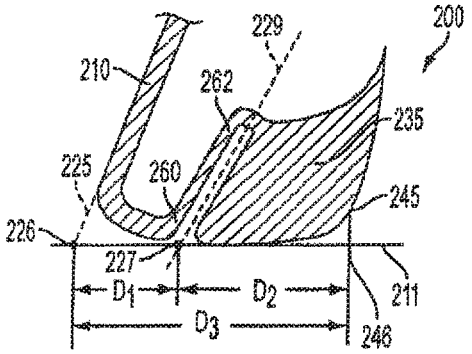
FIGS. 2F-H are cross-sectional views of a channel region of an embodiment of a golf club head.
Figure 2G:
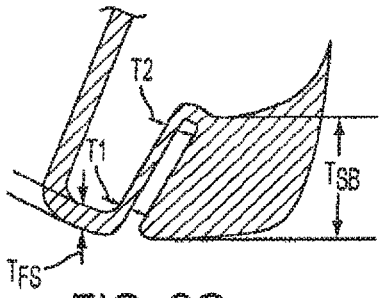
Figure 2H:
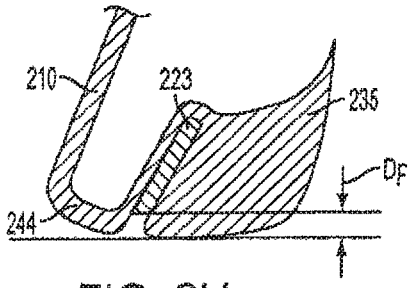

Referring to FIGS. 2D-E, a schematic profile 249 of the outer surface of a portion of the club head 200 that surrounds and includes the region of the channel 250 is shown. The schematic profile has an interior side 249*a* and an exterior side 249*b*. A forward sole exterior surface 208*a* extends on a forward side of the channel 250, and a rearward sole exterior surface 208*b* extends on a rearward side of the channel 250. The channel has a forward wall exterior surface 252*a*, a rear wall exterior surface 254*a*, and an upper wall exterior surface 256*a*. A forward channel entry point 264 is defined as the midpoint of a curve having a local minimum radius ($r_{min}$, measured from the interior side 249*a* of the schematic profile 249) that is located between the forward sole exterior surface 208*a* and the forward wall exterior surface 252*a*. A rear channel entry point 265 is defined as the midpoint of a curve having a local minimum radius ($r_{min}$, also measured from the interior side 249*a* of the schematic profile 249) that is located between the rearward sole exterior surface 208*b* and the rear wall exterior surface 254*a*. An imaginary line 266 that connects the forward channel entry point 264 and the rear channel entry point 265 defines the channel opening 258. A midpoint 266*a* of the imaginary line 266 is one of two points that define the channel centerline 229. The other point defining the channel centerline 229 is an upper channel peak 267, which is defined as the midpoint of a curve having a local minimum radius ($r_{min}$, as measured from the exterior side 249*b* of the schematic profile 249) that is located between the forward wall exterior surface 252*a* and the rear wall exterior surface 254*a*. In an embodiment having one or more flat segment(s) or flat surface(s) located at the upper end of the channel between the forward wall 252 and rear wall 254, the upper channel peak 267 is defined as the midpoint of the flat segment(s) or flat surface(s).

Another aspect of the size, shape, and orientation of the club head 200 and channel 250 is the sole width. For example, for each cross-section of the club head defined within the y-z plane, the sole width, D3, is the distance measured on the ground plane 211 between the face plane projection point 226 and a trailing edge projection point 246. (See FIG. 2F). The face plane projection point 226 is defined above. The trailing edge projection point 246 is the intersection with the ground plane 211 of an imaginary vertical line passing through the trailing edge 245 of the club head 200. The trailing edge 245 is defined as a midpoint of a radius or a point that constitutes a transition from the sole portion 208 to the back wall 232 or other structure on the back portion 228 of the club head.

Still another aspect of the size, shape, and orientation of the club head 200 and channel 250 is the channel to rear distance, D2. For example, for each cross-section of the club head defined within the y-z plane, the channel to rear distance D2 is the distance measured on the ground plane 211 between the channel centerline projection point 227 and a vertical projection of the trailing edge 245 onto the ground plane 211. (See FIG. 2F). As a result, for each such cross-section, D1+D2=D3.

Figure 3A:
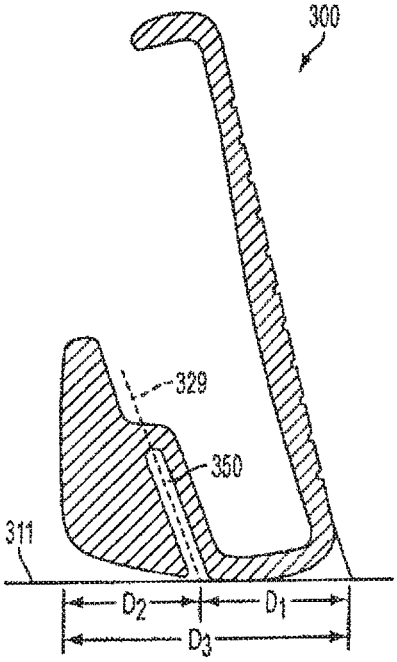
FIGS. 3A-3B, 4A-4B, and 5A-5B, are cross-sectional views of exemplary golf club heads.
Figure 3B:
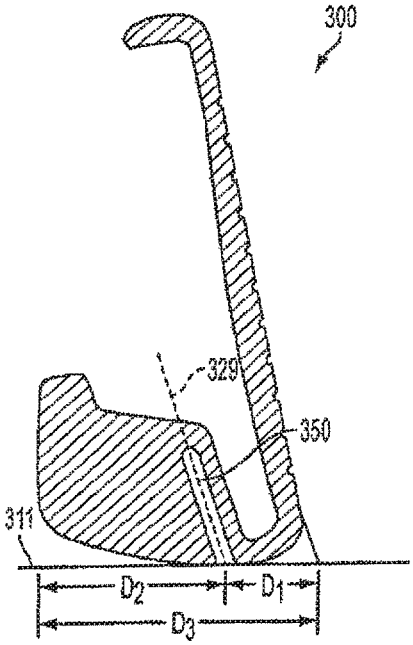

FIGS. 3A-B illustrate two embodiments of golf club heads 300 having a channel 350 that operates as a flexible boundary structure. The two embodiments are similarly designed with the exception of the face to channel distance D1 of each embodiment, as measured at a cross-section taken at the ideal striking location 301. The club head embodiment shown in FIG. 3A includes a face to channel distance D1 that is substantially larger than the face to channel distance D1 of the embodiment shown in FIG. 3B while the sole width D3 (as measured at the same cross-section taken at the ideal striking location 301) of each of the embodiments is the same.

Table 1 below lists several exemplary values for the face to channel distance D1, channel to rear distance D2, sole width D3, and the ratios of D1/D3, D2/D3, and D1/D2 for several examples of club heads that include a channel 350 according to the embodiments described herein. The measurements reported in Table 1 are for the average face to channel distance (D1), average channel to rear distance (D2), and average sole width (D3) over a portion of the club head extending 25 mm to each side (i.e., toe side and heel side) of the ideal striking location 301. As used herein, the terms "average face to channel distance (D1)," "average channel to rear distance (D2)," and "average sole width (D3)" refer to an average of a plurality of D1, D2, or D3 measurements, with the plurality of D1, D2, or D3 measurements being taken within a plurality of imaginary parallel vertical planes that include a first vertical plane passing through the ideal striking location 301 and that contains a vector drawn normal to the striking face 310 at the ideal striking location 301, and a plurality of additional vertical planes that are parallel to the first vertical plane and that are spaced at regular 1 mm increments on each side of the ideal striking location 301.

TABLE 1

| | oft | D1 (mm) | D2 (mm) | D3 (mm) | D1/D3 | D2/D3 | D1/D2 |
|---|---|---|---|---|---|---|---|
| x. 1 | 0-21° | 3.5-17 | 11-24 | 15-28 | 0.13-0.61 | 0.39-0.86 | 0.15-0.71 |
| | | 5.5-14 | 13-22 | 16-27 | 0.20-0.52 | 0.48-0.81 | 0.25-0.64 |
| | | 8-11 | 15-18 | 17-26 | 0.31-0.42 | 0.58-0.69 | 0.44-0.61 |
| x. 2 | 6-28° | 3.5-17 | 11-24 | 15-28 | 0.13-0.61 | 0.39-0.86 | 0.15-0.71 |
| | | 5.5-14 | 13-22 | 16-27 | 0.20-0.52 | 0.48-0.81 | 0.25-0.64 |
| | | 8-11 | 15-18 | 17-26 | 0.32-0.43 | 0.58-0.69 | 0.44-0.61 |

Returning to FIGS. 2A-C, additional aspects of the design of the club head 200 and channel 250 include the channel width W1, channel length L1, and channel depth H1. The channel width W1 is a measure of the distance in a horizontal plane (i.e., a plane that is parallel to the ground plane 211) between the forward wall 252 and rear wall 254 of the channel at a given cross-section of the channel 250. The channel length L1 is generally a measure of the distance on the sole 208 of the club head between the toeward-most point of the channel and the heelward-most point of the channel, without taking into account any curvature of the channel 250. The channel depth H1 is generally a measure of the distance from the ground plane 211 to the highest point (in the y-z plane) of the inner surface of the channel on the channel upper wall 256 when the club head 200 is resting on the ground plane 211. As shown in FIGS. 2A-C, in some embodiments, the channel 250 includes a constant width W1 and constant depth H1 over its full length. In other embodiments, one or more of these three parameters may be varied to achieve desired design and/or performance objectives.

Figure 4A:
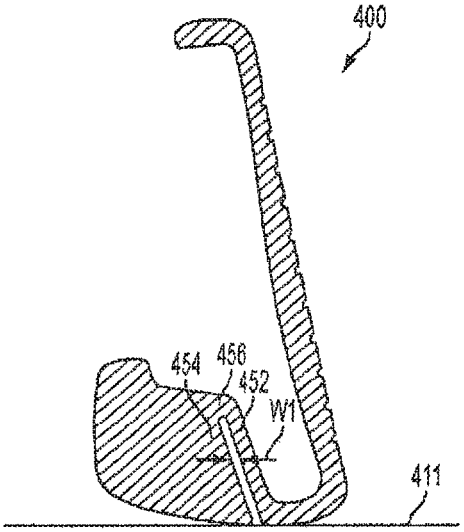
Figure 4B:
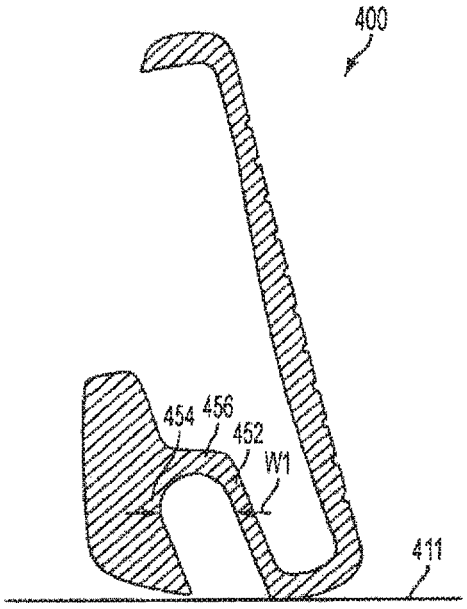

FIGS. 4A-B illustrate two embodiments of golf club heads 400 having a channel 450 that operates as a flexible boundary structure. The two embodiments are similarly designed with the exception of the channel width W1 of each embodiment. The club head embodiment shown in FIG. 4A includes a channel width W1 that is constant, and that is substantially smaller than the (also constant) channel width W1 of the embodiment shown in FIG. 4B. In other embodiments, a channel may have a width W1 that is not constant. In those embodiments, an average channel width W1 may be determined. As used herein, the term "average channel width W1" refers to an average of a plurality of W1 measurements, with the plurality of W1 measurements being taken within a plurality of imaginary parallel horizontal planes that include a first horizontal plane passing through a point that is located at a distance equal to one-half of the channel height H1 above the ground plane 411, and a plurality of additional horizontal planes that are parallel to the first horizontal plane and that are spaced at regular 0.5 mm increments above and below the first horizontal plane. The uppermost imaginary parallel horizontal plane is located at a height that is 80% of the channel height H1 above the ground plane 411, and the lowermost imaginary parallel horizontal plane is located at a height that is at least 20% of the channel height H1 above the ground plane 411. All of the imaginary parallel horizontal planes must include a point located on the forward wall 452 of the channel and the rear wall 454 of the channel. In some embodiments of the club heads described herein, the average channel width W1 may be from about 0.50 mm to about 10.0 mm, such as from about 1.0 mm to about 4.0 mm, such as from about 1.25 mm to about 2.5 mm. In one embodiment, the average channel width W1 is about 1.75 mm.

In some embodiments, the channel width W1 at the channel opening 258 is sufficiently wide that the forward wall 252 and rear wall 254 of the channel do not contact one another when, for example, a golf ball is struck by the club head 200, but the channel width W1 at the channel opening 258 is sufficiently narrow that the amount of dirt, grass, and other materials entering the channel 250 may be reduced relative to a channel having a wider channel opening 258. For example, in some embodiments, the channel width W1 at the channel opening 258 may be from about 0.5 mm to about 5 mm, such as from about 1.0 mm to about 4 mm, such as from about 1.25 mm to about 3 mm.

Figure 5A:
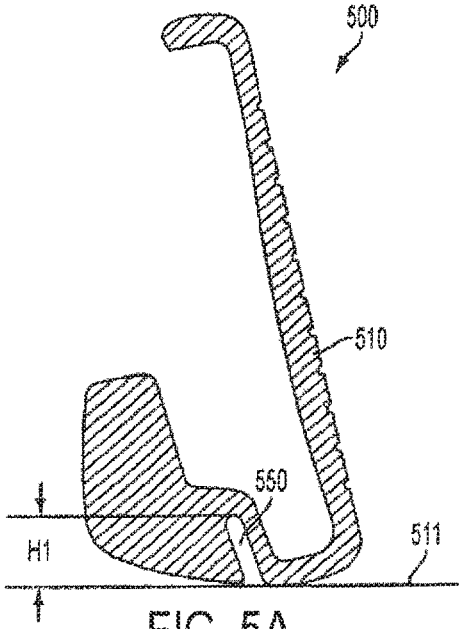
Figure 5B:
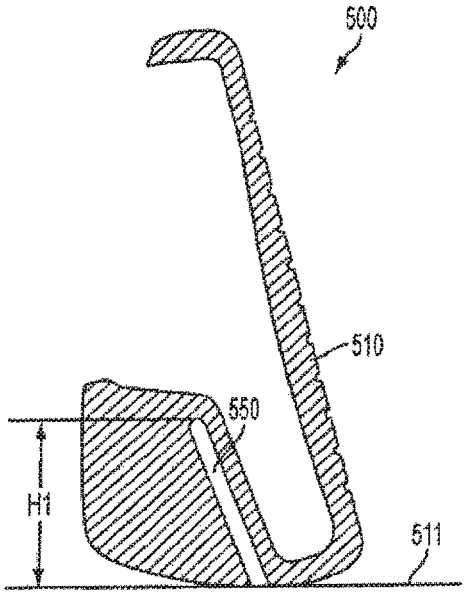

FIGS. 5A-B illustrate two embodiments of golf club heads 500 having a channel 550 that operates as a flexible boundary structure. The two embodiments are similarly designed with the exception of the channel depth H1 of each embodiment. The club head embodiment shown in FIG. 5A includes a constant channel depth H1 that is substantially smaller than the (also constant) channel depth H1 of the embodiment shown in FIG. 5B. In other embodiments, a channel may have a depth H1 that is not constant. In those embodiments, a maximum channel depth $H1_{MAX}$ and an average channel depth $H1_{AVG}$ may be determined. As used herein, the term "maximum channel depth $H1_{MAX}$" refers to a maximum value for the channel depth H1 occurring over the full length of the channel. As used herein, the term "average channel depth $H1_{AVG}$" refers to an average of H1 measurements, with the plurality of H1 measurements being taken within a plurality of imaginary parallel vertical planes that include a first vertical plane passing through the ideal striking location 501 and that contains a vector drawn normal to the striking face 510 at the ideal striking location 501, and a plurality of additional vertical planes that are parallel to the first vertical plane and that are spaced at regular 1 mm increments on each side of the ideal striking location 501.

Table 2 below lists several exemplary values for the average channel depth $H1_{AVG}$, maximum channel depth $H1_{MAX}$, club head height $H_{CH}$, and the ratios of $H1_{AVG}/H_{CH}$ and $H1_{MAX}/H_{CH}$ for several examples of club heads that include a channel according to the embodiments described herein.

TABLE 2

| | Loft | H1AVG (mm) | H1MAX (mm) | HCH (mm) | H1AVG/ HCH | H1MAX/ HCH |
|---|---|---|---|---|---|---|
| x. 1 | 20-21° (4I) | 5.0-25.0 | 5.0-45 | 25-75 | 0.07-0.50 | 0.07-0.70 |
| | | 6.0-14.5 | 6.0-30 | 35-65 | 0.10-0.41 | 0.10-0.60 |
| | | 8.5-13.0 | 8.5-23 | 40-60 | 0.14-0.33 | 0.14-0.50 |
| x. 2 | 26-28° (6I) | 5.0-25.0 | 5.0-45 | 25-75 | 0.07-0.50 | 0.07-0.70 |
| | | 6.0-14.5 | 6.0-30 | 35-65 | 0.10-0.41 | 0.10-0.60 |
| | | 8.5-13.0 | 8.5-23 | 40-60 | 0.14-0.33 | 0.14-0.50 |

Figure 6A:
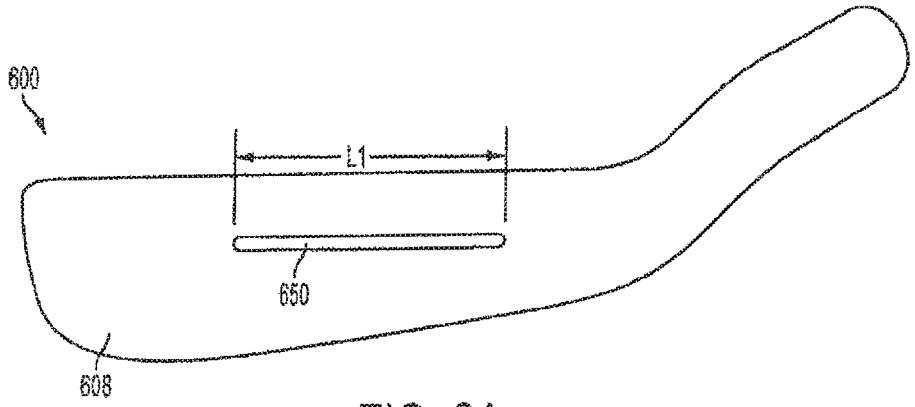
FIGS. 6A-B are bottom views of the soles of exemplary golf club heads.
Figure 6B:
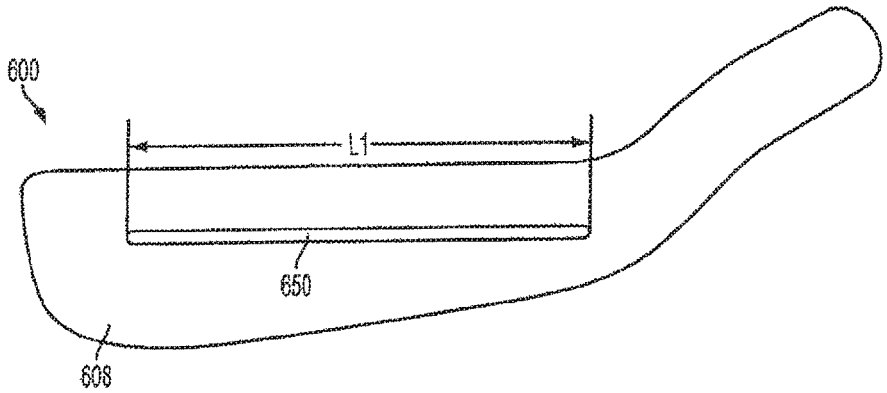

FIGS. 6A-B illustrate two embodiments of golf club heads 600 having a channel 650 that operates as a flexible boundary structure. The two embodiments are similarly designed with the exception of the channel length L1 of each embodiment. The club head embodiment shown in FIG. 6A includes a channel length L1 that is substantially shorter than the channel length L1 of the embodiment shown in FIG. 6B. In some embodiments of the club heads described herein, the channel length L1 may be from about 15 mm to about 62 mm, such as from about 40 mm to about 57 mm, such as from about 45 mm to about 55 mm. In one embodiment, the channel length L1 is about 50 mm.

Table 3 below lists several exemplary values for the channel length L1, sole length $L_B$, and the ratio of $L1/L_B$ for several examples of club heads that include a channel according to the embodiments described herein.

TABLE 3

| | Loft | L1 (mm) | LB (mm) | L1/LB |
|---|---|---|---|---|
| x. 1 | 20-21° (4I) | 15-85 mm | 65-90 mm | 0.17-1.0 |
| | | 30-57 mm | 70-85 mm | 0.35-0.67 |
| | | 45-55 mm | 75-82 mm | 0.55-0.65 |
| x. 2 | 26-28° (6I) | 15-62 mm | 65-90 mm | 0.17-1.0 |
| | | 30-57 mm | 70-85 mm | 0.35-0.67 |
| | | 45-55 mm | 75-82 mm | 0.55-0.65 |

Table 4 below lists several exemplary values for the channel length L1, the average channel depth $H1_{AVG}$, the maximum channel depth $H1_{MAX}$, and the ratios of $H1_{AVG}/L1$ and $H1_{MAX}/L1$ for several examples of club heads that include a channel according to the embodiments described herein.

TABLE 4

| | Loft | H1AVG (mm) | H1MAX (mm) | L1 (mm) | H1AVG/ L1 | H1MAX/ L1 |
|---|---|---|---|---|---|---|
| x. 1 | 20-21° (4I) | 5.0-25.0 | 5.0-45 | 15-85 mm | 0.06-0.50 | 0.06-0.65 |
| | | 6.0-14.5 | 6.0-30 | 30-57 mm | 0.11-0.40 | 0.11-0.50 |
| | | 8.5-13.0 | 8.5-23 | 45-55 mm | 0.18-0.30 | 0.18-0.40 |
| x. 2 | 26-28° (6I) | 5.0-25.0 | 5.0-45 | 15-62 mm | 0.06-0.50 | 0.06-0.65 |
| | | 6.0-14.5 | 6.0-30 | 30-57 mm | 0.11-0.40 | 0.11-0.50 |
| | | 8.5-13.0 | 8.5-23 | 45-55 mm | 0.18-0.30 | 0.18-0.40 |

Returning to FIGS. 2A-H, and specifically to FIG. 2G, still other aspects of the design of the club head 200 and channel 250 include the wall and component thicknesses of at least the following three portions of the club head. A first wall thickness, T1, is a measure of the thickness of the first hinge region 260. A second wall thickness, T2, is a measure of the thickness of the second hinge region 262. A forward sole wall minimum thickness, $T_{FS}$, is a measure of the minimum thickness (measured in a vertical plane) of the forward portion 244 of the sole, i.e., the portion of the sole 208 located between the striking face 210 and the channel 250. A sole bar maximum thickness $T_{SB}$ is a measure of the maximum thickness (measured in a vertical plane) of the portion of the sole bar 235 located rearward of the channel 250. As shown in FIGS. 2A-C, in some embodiments, the club head 200 includes a first hinge region 260, second hinge region 262, and forward portion 244 of the sole that each have a constant thickness over their full lengths. In other embodiments, one or more of these parameters may be varied to achieve desired design and/or performance objectives.

Figure 7A:
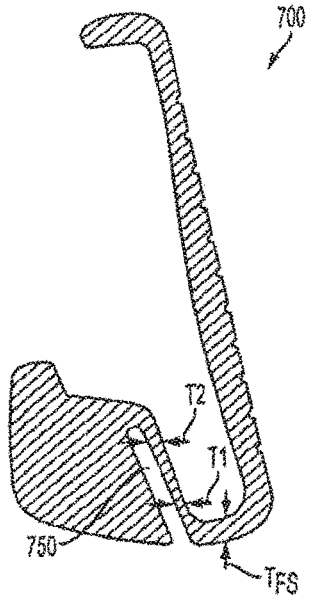
FIGS. 7A-7B, 8A-8B, and 9 are cross-sectional views of exemplary golf club heads.
Figure 7B:
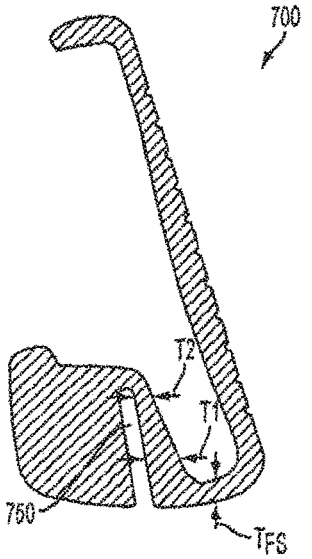

FIGS. 7A-B illustrate two embodiments of golf club heads 700 having a channel 750 that operates as a flexible boundary structure. The two embodiments are similarly designed with the exception of the orientation of the channel 750 and the resultant variation in the thickness, T1, of the first hinge region of each embodiment. The club head embodiment shown in FIG. 7A includes a first hinge region thickness T1 that is substantially smaller/thinner than the first hinge region thickness T1 of the embodiment shown in FIG. 7B. In some embodiments of the club heads described herein, the first hinge region thickness T1 may be from about 0.5 mm to about 5.0 mm, such as from about 1.0 mm to about 3.0 mm, such as from about 1.2 mm to about 2.0 mm. In one embodiment, the first hinge region thickness T1 is about 1.5 mm.

Figure 8A:
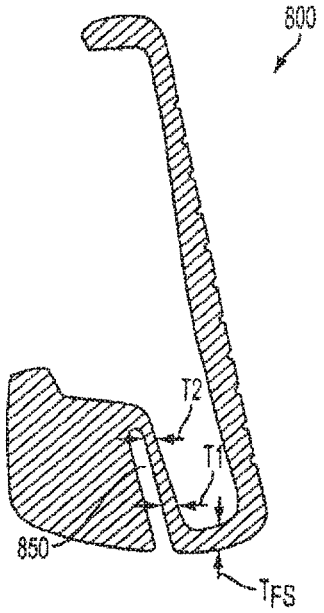
Figure 8B:
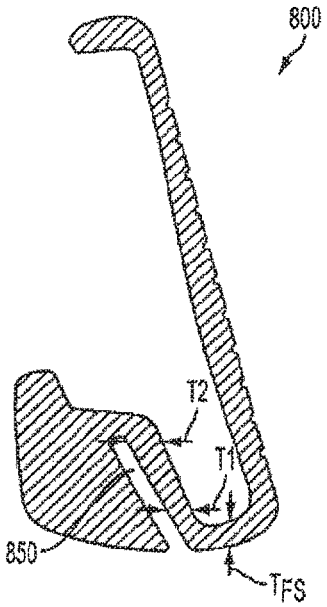

FIGS. 8A-B illustrate two embodiments of golf club heads 800 having a channel 850 that operates as a flexible boundary structure. The two embodiments are similarly designed with the exception of the orientation of the channel 850 and the resultant variation in the thickness, T2, of the second hinge region of each embodiment. The club head embodiment shown in FIG. 8A includes a second hinge region thickness T2 that is substantially smaller/thinner than the second hinge region thickness T2 of the embodiment shown in FIG. 8B. In some embodiments of the club heads described herein, the second hinge region thickness T2 may be from about 0.5 mm to about 5.0 mm, such as from about 1.0 mm to about 2.5 mm, such as from about 1.2 mm to about 2.0 mm. In one embodiment, the second hinge region thickness T2 is about 1.5 mm.

Table 5 below lists several exemplary values for the forward sole minimum thickness $T_{FS}$, sole bar maximum thickness $T_{SB}$, and the ratio of $T_{FS}/T_{SB}$ for several examples of club heads that include a channel according to the embodiments described herein.

TABLE 5

| | Loft | TFS (mm) | TSB (mm) | TFS/ TSB |
|---|---|---|---|---|
| Ex. 1 | 20-21° (4I) | 0.5-5.0 | 4.0-40 | 0.04-0.50 |
| | | 0.8-3.0 | 5.0-30 | 0.05-0.40 |
| | | 1.0-2.5 | 7.0-25 | 0.06-0.35 |
| Ex. 2 | 26-28° (6I) | 0.5-5.0 | 4.0-40 | 0.04-0.50 |
| | | 0.8-3.0 | 5.0-30 | 0.05-0.40 |
| | | 1.0-2.5 | 7.0-25 | 0.06-0.35 |

Figure 9:
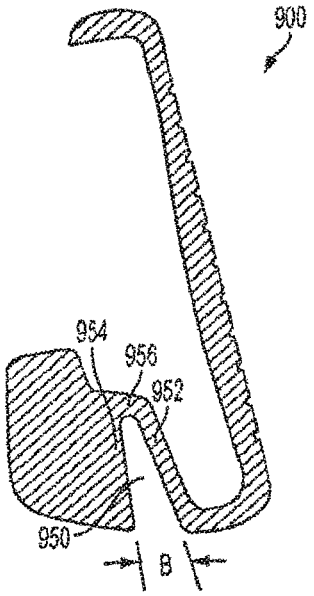

Returning again to FIGS. 2A-C, the channel 250 shown in the illustrated embodiment includes a forward channel wall 252 that is generally parallel to the striking face 210, and that is also generally parallel to the rear channel wall 254. As a result, the channel width W1 is substantially constant over the depth of the channel. In an alternative embodiment, shown in FIG. 9, a club head 900 includes a channel 950 having a forward channel wall 952, rear channel wall 954, and upper channel wall 956. The forward channel wall 952 and rear channel wall 954 are not parallel to one another, defining an included angle β that may be from slightly greater than 0° to about 25° or more.

Channel/Slot Profile Shapes and Orientations

In each of the embodiments described above, the channel is defined by forward, rear, and upper walls, and has a channel opening that is formed on the sole portion of the club head. Accordingly, except for the channel opening, each of the channels described above is closed at its forward, rear, and upper ends. In alternative embodiments, instead of a closed channel, a channel may be provided having one or more openings that extend through one or more of the channel walls, and/or a slot having no upper wall extends fully through the sole portion (or other portion) of the club head in which it is located.

For example, in the embodiments shown in FIGS. 17A-B and 18A-C, a cavity back iron golf club head 1700 includes a channel 1750 that is defined in part by a forward wall 1752, rear wall 1754, and upper wall 1756. The club head also includes a top line 1706, a striking face 1710, a forward portion of the sole 1744, and a sole bar 1735, as described in relation to the embodiments described above. Moreover, in alternative embodiments (not shown in FIGS. 17A-B and 18A-C), the club head 1700 may comprise a hollow iron (see, e.g., FIGS. 1C and 1E).

One or more cutouts or windows 1794 are provided on the forward wall 1752 of the channel. See, e.g., FIGS. 18A-B. Each window 1794 provides increased flexibility to the forward channel wall 1752, thereby increasing the capability of the flexible boundary structure (FBS) provided by the channel 1750 to flex or deflect and to thereby provide a desired improvement in the performance of the golf club head. In the embodiments shown, the forward wall 1752 includes three cutouts or windows 1794 that are generally equally spaced along the heel-to-toe length of the forward wall 1752. In alternative embodiments, fewer (e.g., one or two) or more (e.g., four or more) cutouts or windows 1794 may be provided.

Figure 18A:
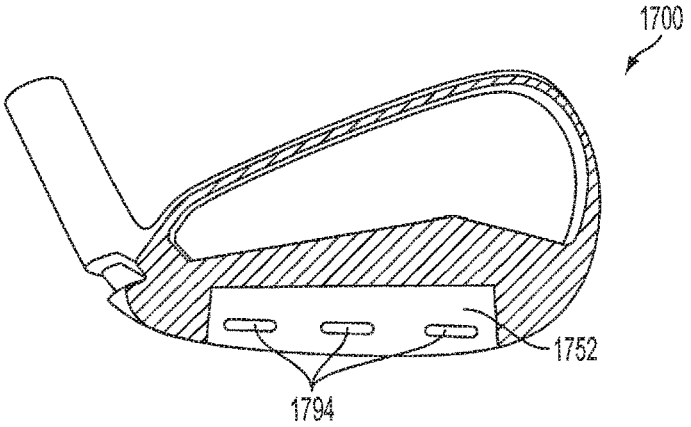
FIGS. 18A-B are cross-sectional views of two embodiments of golf club heads taken along section line 18-18 in FIG. 17B.
Figure 18B:
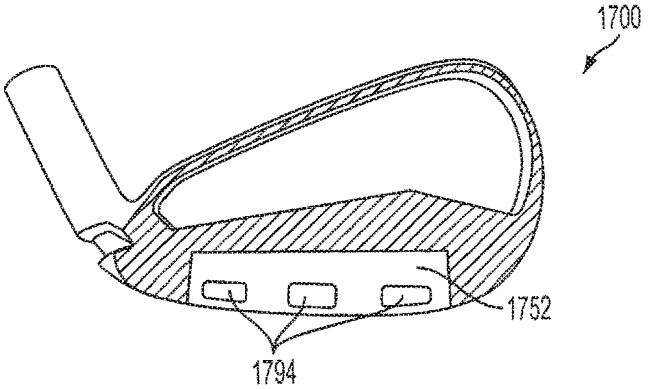
Figure 18C:
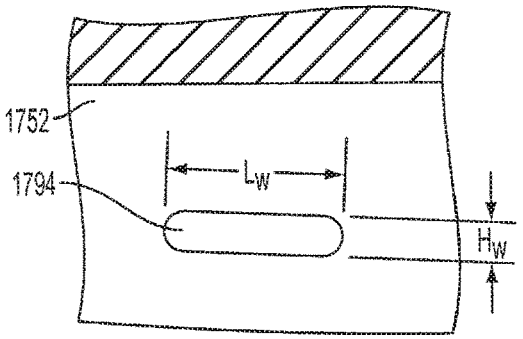
FIG. 18C is a close-up view of a cutout or window of the golf club head shown in FIG. 18A.

Although the example windows 1794 have an oblong shape, other shapes (e.g., round, oval, elliptical, triangular, square, rectangular, trapezoidal, etc.) are also possible. Turning to FIG. 18C, in the example shown, a representative cutout or window 1794 has a length $L_w$ which corresponds to the distance between the toeward-most and heelward-most ends of the window 1794, and a height $H_w$ that corresponds to the distance between the crownward-most and soleward-most ends of the window 1794. The length $L_w$ may be from about 1 mm to as much as the length L1 of the channel 1750, such as up to about 85 mm (e.g., in an embodiment that includes only a single window 1794). In the embodiments shown in FIGS. 18A-B, in which the forward wall includes three windows 1794, the windows each have a length $L_w$ of from about 3 mm to about 18 mm, such as from about 6 mm to about 15 mm, such as from about 8 mm to about 12 mm. The height $H_w$ may be from about 0.5 mm to as much as the height H1 of the channel 1750, such as up to about 25 mm. In the embodiments shown in FIGS. 18A-B, the windows each have a height $H_w$ of from about 0.5 mm to about 15 mm, such as from about 1 mm to about 12 mm, such as from about 1.5 mm to about 8 mm.

Although not shown in the drawings, in alternative embodiments, one or more windows or cutouts may be formed through the channel rear wall 1754 and extending through the sole bar 1735, with an exit port provided on a rearward-facing surface of the club head.

Figure 10A:
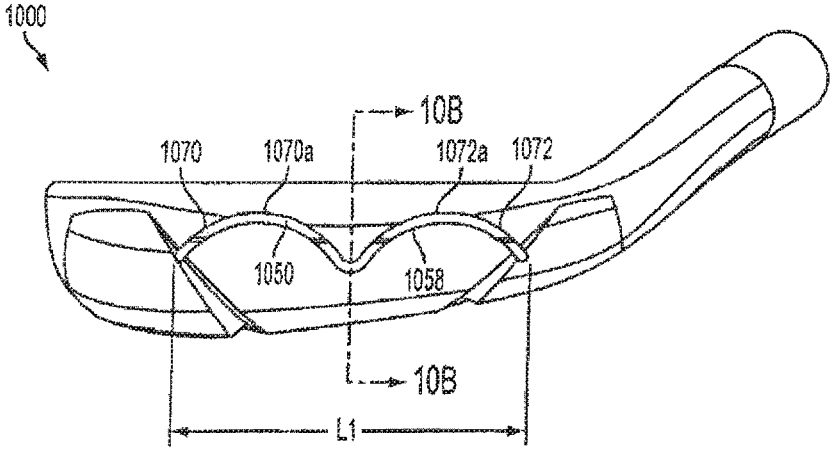
FIG. 10A is a bottom view of the sole of and exemplary golf club head.
Figure 10B:
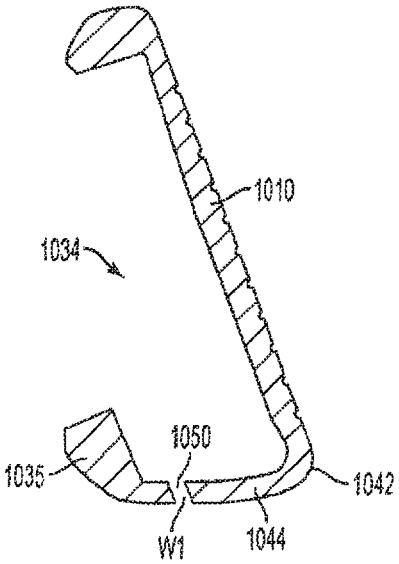
FIG. 10B is a cross-sectional view of the golf club head shown in FIG. 10A.

Turning to FIGS. 10A-B, in another example, a cavity back iron club head 1000 includes a slot 1050 that extends fully through the sole 1008 into the recess 1034 at the back portion of the club head. In an alternative embodiment (not shown in FIGS. 10A-B), a hollow iron (see, e.g., FIG. 1C) may include a slot that extends fully through the sole and into the interior cavity of the club head.

The embodiment shown in FIG. 10A also shows a slot 1050 with an opening 1058 that has a non-straight, curved shape when viewing the sole of the club head. In other embodiments, the slot 1050 may be straight or may have a curved shape that is different from the embodiment shown in FIG. 10A, several of which are described below. In the example shown, the slot opening 1058 is continuous and includes a first curved region 1070 and a second curved region 1072. Each of the first and second curved regions 1070, 1072 defines a generally semi-circular shape. The first curved region 1070 has a peak 1070*a* that represents a point at which the first curved region 1070 is nearest to the leading edge 1042, and that is located on the toeward half of the club head 1000. The second curved region 1072 has a peak 1072*a* that represents a point at which the second curved region 1072 is nearest to the leading edge 1042, and that is located on the heelward half of the club head 1000. A center connecting region 1073 connects the first and second curved regions 1070, 1072, and is typically centered at or near the 0 coordinate of the CG x-axis 105.

The slot 1050 is located rearward of the forward portion 1044 of the sole and forward of the sole bar 1035. The slot 1050 has a face to slot distance, D1, that is variable over the length of the slot 1050 due to the curvature of the first curved region 1070 and second curved region 1072. In the embodiment shown in FIGS. 10A-B, the face to slot distance may be comparable to the ranges for the face to channel distance D1 of the embodiments described above in relation to FIGS. 2A-H and FIGS. 3A-B. The slot 1050 also has a slot length, L1, that may be comparable to the ranges for the channel lengths L1 of the embodiments described above in relation to FIGS. 2A-H and FIGS. 6A-B. The slot 1050 also has a slot width, W1, that may be comparable to the ranges for the channel widths W1 of the embodiments described above in relation to FIGS. 2A-H and FIGS. 4A-B. In addition, in the embodiment shown, the forward portion 1044 of the sole may have a forward sole wall minimum thickness, $T_{FS}$, that may be comparable to the ranges for the forward sole wall minimum thickness $T_{FS}$ of the embodiments described above in relation to FIGS. 2A-H and FIGS. 8A-B.

In some alternative embodiments (not shown in the drawings), an iron club head 1000 may include a slot 1050 that extends fully through the sole 1008, and the forward portion 1044 of the sole may have a forward sole wall minimum thickness, $T_{FS}$, that is larger than the ranges for the forward sole wall minimum thickness $T_{FS}$ of the embodiments described above in relation to FIGS. 2A-H and FIGS. 8A-B. For example, in these alternative embodiments, the forward sole wall minimum thickness, $T_{FS}$, may be from about 5 mm to about 15 mm, such as from about 5 mm to about 12 mm, such as from about 5 mm to about 8 mm.

Turning next to FIGS. 19A-B and 20A-B, examples are shown of a cavity back iron golf club head 1900 having a sole slot 1950. The club head also includes a top line 1906, a striking face 1910, a forward portion of the sole 1944, and a sole bar 1935, as described in relation to the embodiments described above. The slot 1950 defines a passage through the sole 1908 into the recess 1934 at the back portion of the club head 1900. Moreover, in alternative embodiments (not shown in FIGS. 19A-B and 20A-B), the club head 1900 may comprise a hollow iron (see, e.g., FIGS. 1C and 1E), in which case the slot 1950 provides a passage through the sole 1908 into the internal cavity 120 of the club head. The term "rear void" as used herein shall refer to either or both of a recess 1934 of a cavity back iron golf club head or an internal cavity 120 of a hollow golf club head.

The slot 1950 is located in the sole 1908, rearward of the forward portion 1944 of the sole and forward of the sole bar 1935. The slot 1950 has a face to slot distance, D1, that may be comparable to the ranges for the face to channel distance D1 of the embodiments described above in relation to FIGS. 2A-H and FIGS. 3A-B. The slot 1950 also has a slot length, L1, that may be comparable to the ranges for the channel lengths L1 of the embodiments described above in relation to FIGS. 2A-H and FIGS. 6A-B. The slot 1950 also has a slot width, W1, that may be comparable to the ranges for the channel widths W1 of the embodiments described above in relation to FIGS. 2A-H and FIGS. 4A-B. In addition, in the embodiment shown, the forward portion 1944 of the sole may have a forward sole wall minimum thickness, $T_{FS}$, that may be comparable to the ranges for the forward sole wall minimum thickness $T_{FS}$ of the embodiments described above in relation to FIGS. 2A-H and FIGS. 8A-B.

Cross-sectional views of the club head show a profile of the shape of the slot 1950 at a central region of the club head. As shown, for example, in FIGS. 19A-B and 20A-B, the sole bar 1935 includes an overhang member 1996 that extends into the space above the mouth of the slot 1950. In the FIG. 19A-B embodiment, the overhang member 1996 extends over a substantial portion of the height of the forward-facing portion of the sole bar 1935, whereas in the FIG. 20A-B embodiment, the overhang member 1996 comprises a narrow ledge extending from the forward-facing portion of the sole bar 1935 above the mouth of the slot 1950. In some embodiments, the location and weight of the overhang member 1996 may provide a desirable forward shift of the CG relative to a club head that does not include the overhang member 1996. In other embodiments, the overhang member 1996 may provide a backstop that serves to partially trap or retain a viscous filler material that is injected or otherwise inserted into the slot 1950 during manufacture of the club head, as described in more detail below.

The overhang member 1996 and slot 1950 define a non-linear passage through the sole 1908 and into the rear void of the club head, such as into the recess 1934 at the back portion of the club head 1900 (for a cavity back iron club head), or through the sole 1908 into the internal cavity 120 of the club head (for a hollow iron club head). The non-linear passage may be defined by the axial path 1998 illustrated in FIGS. 19B and 20B. The axial path 1998 represents an imaginary line comprising a summation of the midpoints of lines representing the shortest distances between all points on the internal surfaces of the forward sole portion 1944 and rear surface of the striking plate 1910 on a forward side of the club head and opposed points on the internal surfaces of the sole bar 1935 (including the overhang member 1996) on a rearward side of the club head, for a given cross-section such as that shown in FIGS. 19B and 20B.

Figure 19A:
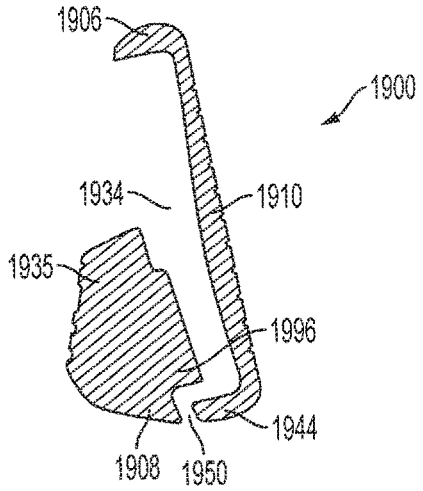
FIG. 19A is a cross-sectional view of another embodiment of a golf club head.
Figure 19B:
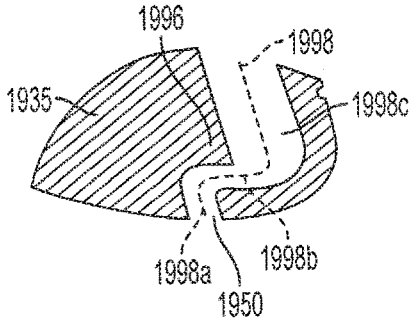
FIG. 19B is a close-up cross-sectional view of a portion of the golf club head shown in FIG. 19A.
Figure 20A:
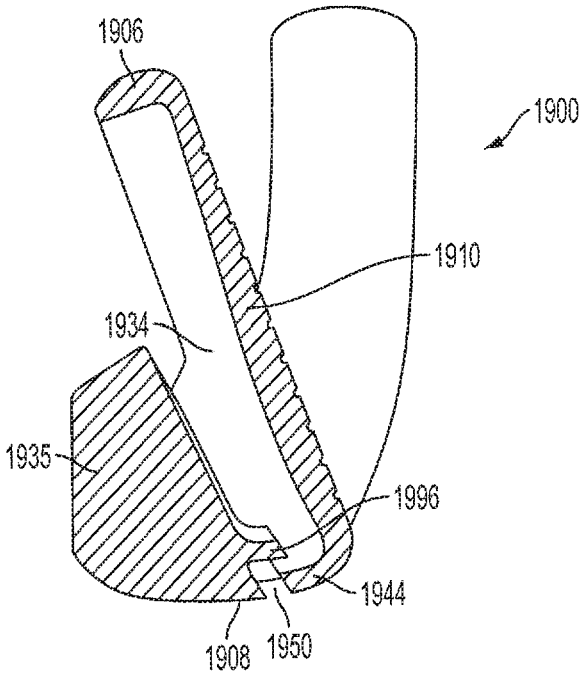
FIG. 20A is a cross-sectional view of another embodiment of a golf club head.
Figure 20B:
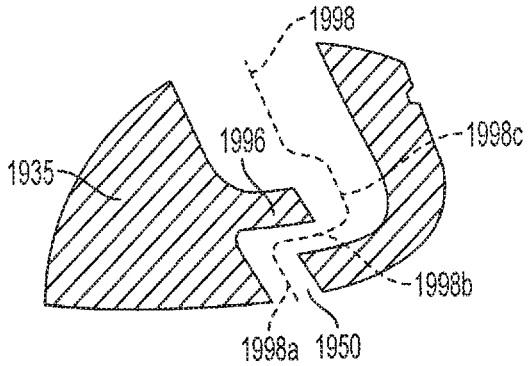
FIG. 20B is a close-up cross-sectional view of a portion of the golf club head shown in FIG. 20A.

In the embodiments shown in FIGS. 19B and 20B, the non-linear axial path 1998 includes at least a lower path region 1998*a* passing through the mouth of the slot 1950, the lower path region 1998*a* having an axial direction that is generally parallel to the face plane 125, an intermediate path region 1998*b* that is axially directed generally perpendicular to the face plane 125, and an upper path region 1998*c* that is axially directed generally parallel to the face plane 125. For example, in some embodiments, the lower path region 1998*a* includes a portion having a length of at least about 1 mm that is within about 30° of being parallel to the face plane 125, such as within about 20° of being parallel to the face plane 125, such as within about 15° of being parallel to the face plane 125. In some embodiments, the intermediate path region 1998*b* includes a portion having a length of at least about 1 mm that is within about 30° of being perpendicular to the face plane 125, such as within about 20° of being perpendicular to the face plane 125, such as within about 15° of being perpendicular to the face plane 125. In some embodiments, the upper path region 1998*c* includes a portion having a length of at least about 1 mm that is within about 30° of being parallel to the face plane 125, such as within about 20° of being parallel to the face plane 125, such as within about 15° of being parallel to the face plane 125.

Turning next to FIGS. 11A-H, several examples of sole channel or sole slot profiles are shown. In each example, a club head 1100 includes a slot 1150 that extends over a portion of the sole 1108 of the club head. In the embodiment shown in FIG. 11A, the slot 1150 is a straight slot having an orientation, shape, and size that is comparable to the channel profile examples described above in relation to FIGS. 2A-C. In the embodiment shown in FIG. 11B, the slot 1150 has a shape of a single continuous curve 1174 having a toe side end 1174*a*, a heel side end 1174*b*, and a single peak 1174*c* that is generally located at a point corresponding with the 0 coordinate of the CG x-axis 105 and/or corresponding with the CG x-axis coordinate of the ideal impact location 101 (see FIG. 1A). Similarly, in the embodiment shown in FIG. 11C, the slot 1150 has a shape of a single continuous curve 1174 having a toe side end 1174*a*, a heel side end 1174*b*, and a single peak 1174*c* that is generally located at a point corresponding with the 0 coordinate of the CG x-axis 105 and/or corresponding with the CG x-axis coordinate of the ideal impact location 101 (see FIG. 1A). In the FIG. 11B embodiment, the single peak 1174*a* is arched toward the front portion 1130 of the club head, i.e., the distance of the single peak 1174*a* to the nearest portion of the leading edge 1142 is less than the distance of each of the toe side and heel side ends 1174*a*, 1174*b* to the nearest portions of the leading edge 1142. In the FIG. 11C embodiment, the single peak 1174*a* is arched toward the back portion 1128 of the club head, i.e., the distance of the single peak 1174*a* to nearest portion of the leading edge 1142 is greater than the distance of each of the toe side and heel side ends 1174*a*, 1174*b* to the nearest portions of the leading edge 1142.

Figure 11A:
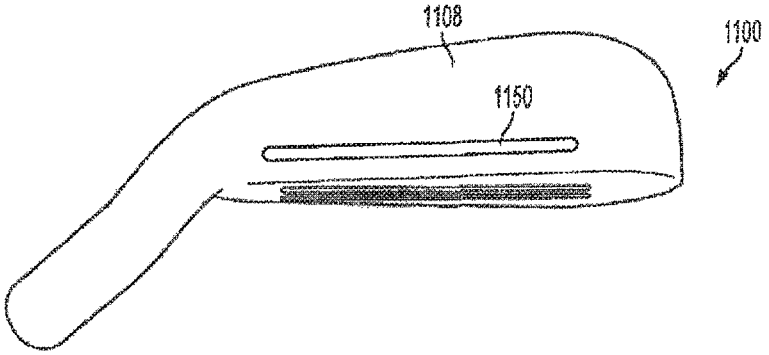
FIGS. 11A-J are bottom views of the soles of exemplary golf club heads.
Figure 11B:
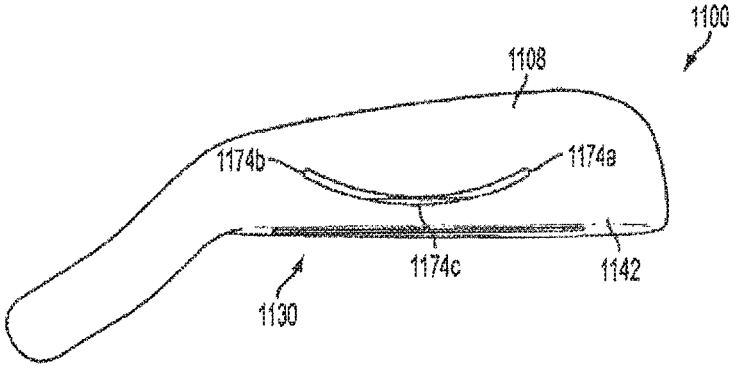
Figure 11C:
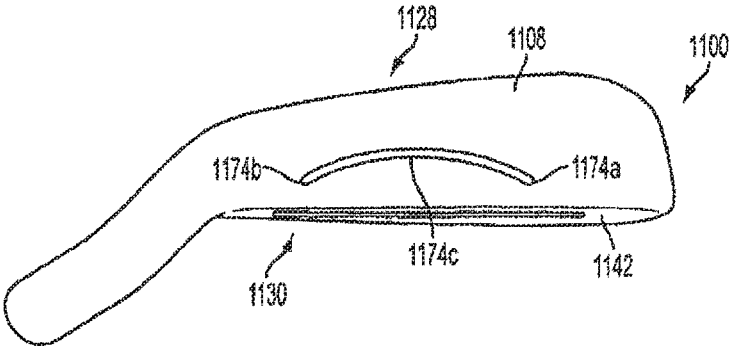
Figure 11D:
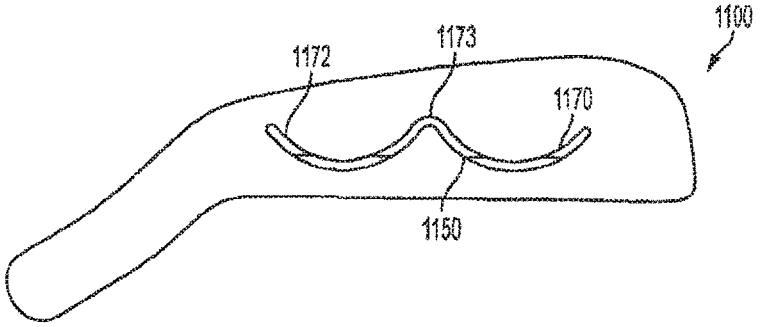
Figure 11E:
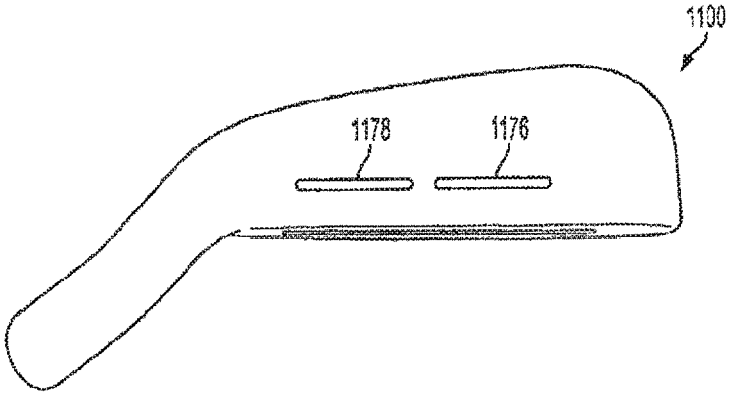
Figure 11F:
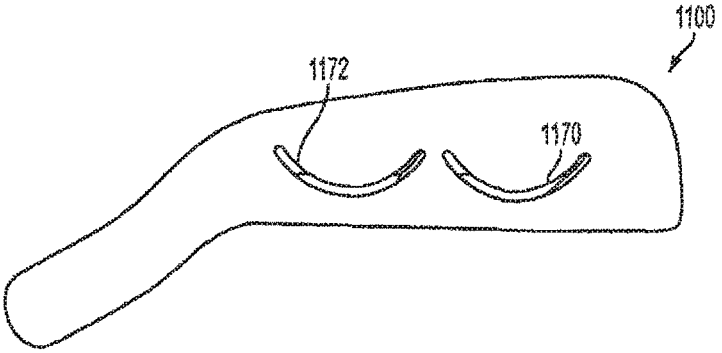

In the embodiment shown in FIG. 11D, the slot 1150 is a continuous curved slot having an orientation, shape, and size that is comparable to the examples described above in relation to FIGS. 10A-B, including a first curved region 1170, a second curved region 1172, and a center connecting region 1173. The club head embodiment shown in FIG. 11F includes a slot 1150 having a first curved region 1170 and a second curved region 1172, but the slot does not include a center connection region. Instead, the slot 1150 shown in FIG. 11F is non-continuous, having two separate sections—the first curved region 1170 and second curved region 1172. Finally, the club head embodiment shown in FIG. 11E includes a slot 1150 that is also non-continuous, comprising a first straight region 1176 and a second straight region 1178 that are separate and not connected to each other.

Figure 11G:
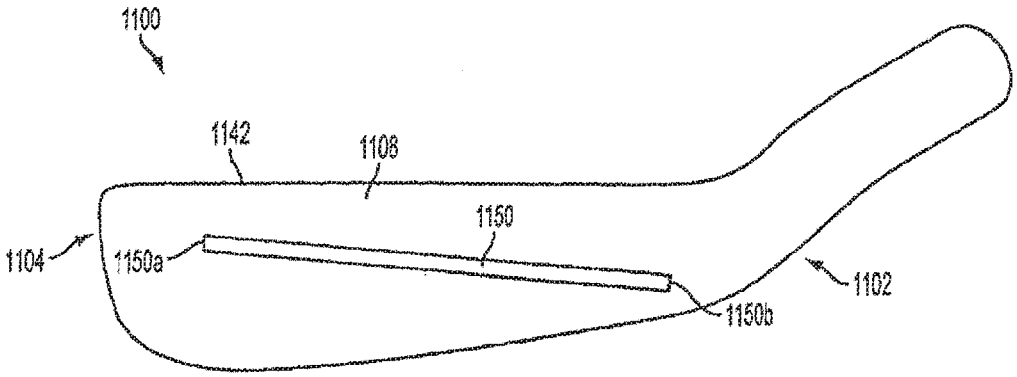

In the embodiment shown in FIG. 11G, a club head 1100 includes a single, continuous, straight slot 1150 that extends over a substantial portion of the length of the sole 1108, extending generally from the heel portion 1102 to the toe portion 1104. The slot 1150 has a skewed or non-parallel orientation relative to the leading edge 1142. In the embodiment shown, the distance from the toe side end 1150*a* of the slot to the leading edge 1142 is less than the distance from the heel side end 1150*b* of the slot to the leading edge 1142.

Figure 11H:
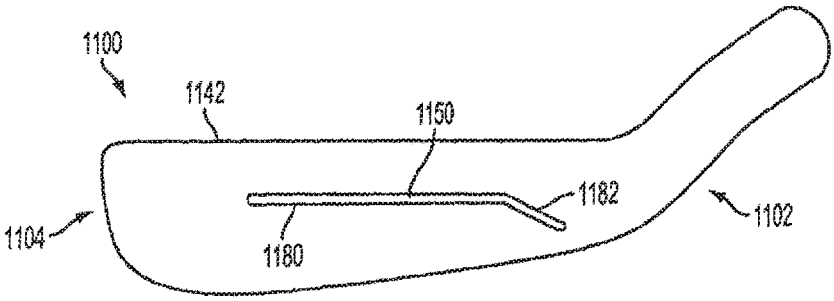

In the embodiment shown in FIG. 11H, a club head 1100 includes a single, continuous slot 1150 that includes a main portion 1180 that is substantially parallel with the leading edge 1142 of the club head, and a secondary portion 1182 near the heel region 1102 that is oriented at an angle away from the leading edge 1142.

Figure 11I:
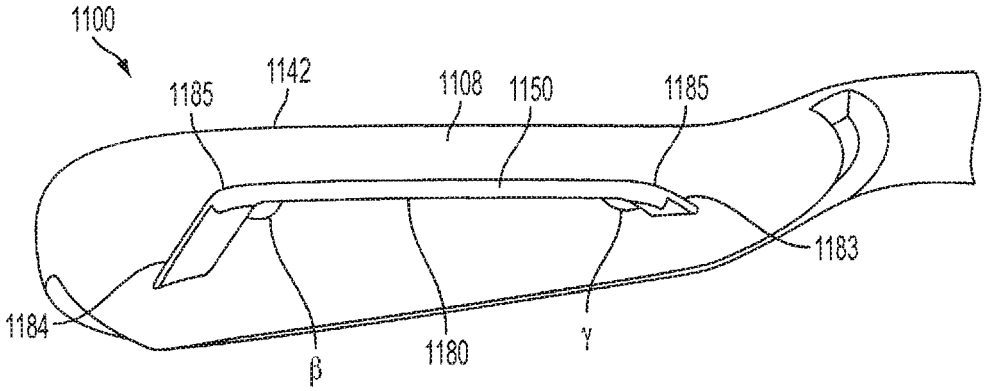

Similarly, in FIG. 11I, a club head 1100 includes a single, continuous slot 1150 that includes a main portion 1180 that is substantially parallel with the leading edge 1142 of the club head, a heel relief portion 1183 and a toe relief portion 1184. In the embodiment shown, each of the heel relief portion 1183 and toe relief portion 1184 is joined with the main portion 1180 of the slot by a radius region 1185 that provides a transition from the leading edge parallel alignment of the main portion 1180 to the rearwardly-directed alignment of the heel relief portion 1183 and toe relief portion 1184. As shown, the heel relief portion 1183 is aligned generally rearward from the main portion 1180, defining a relief angle γ which may be from about 90° to about 150°. Similarly, the toe relief portion 1184 is aligned generally rearward from the main portion 1180, defining a relief angle β which may be from about 90° to about 150°. In some embodiments, the relief angles γ and β are equal or substantially the same, while in other embodiments the relief angles γ and β are different. In some embodiments, the slot width W1 of one or both of the heel relief portion 1183 and/or the toe relief portion 1184 may be larger than the slot width W1 of the main portion 1180, as shown for example in FIG. 11I.

Figure 11J:
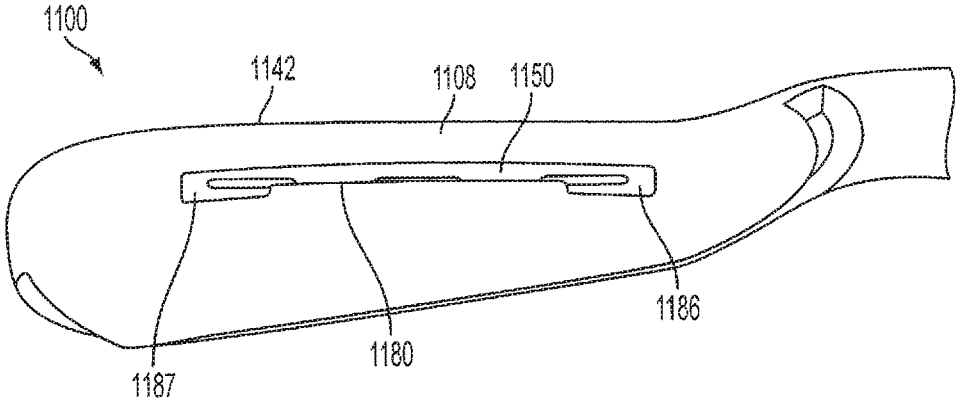

In FIG. 11J, a club head 1100 includes a single, continuous slot 1150 that includes a main portion 1180 that is substantially parallel with the leading edge 1142 of the club head, a heel relief portion 1186 and a toe relief portion 1187. Each of the heel relief portion 1186 and toe relief portion 1187 comprises a widened region of the slot 1150, i.e., the slot widths W1 of the slot 1150 in the regions of the heel relief portion 1186 and toe relief portion 1187 are larger than the width W1 of the slot in the main portion 1180. In some embodiments, the ratio of the slot widths W1 of one or both of the heel relief portion 1186 and/or the toe relief portion 1187 to the slot width W1 of the main portion 1180 may be from about 1.1 to about 5, such as from about 1.1 to about 3, such as from about 1.1 to about 2.

In each of the foregoing embodiments that include a slot 1150 formed in the sole 1108 of the club head, it is further advantageous to provide rounded or tapered edge contours in order to provide stress relief and to enhance the durability of the club head. For example, in the embodiments shown in FIGS. 11I and 11J, it is advantageous to incorporate rounded corners and edges in the heel and toe relief portions, where stress may be concentrated.

It should be noted that each of the sole slot profile embodiments shown in FIGS. 11A-J may be applied in the design of a sole channel as a flexible boundary structure on a club head. In those embodiments, the sole channel will include a forward wall, rear wall, and upper wall in the manner described above in relation to FIGS. 2A-C.

Alternative Channel/Slot Locations

Several of the club head embodiments described above include one or more flexible boundary structures located on the sole portion of the club head. In other, alternative embodiments, a flexible boundary structure may be included on other portions of the club head. For example, in an embodiment shown in FIG. 12A, a club head 1200 includes a flexible boundary structure in the form of a channel 1250 located at a toe region 1204 of the club head. The club head 1200 may be either a cavity back construction having a recess 1234, or the club head 1200 may be a hollow construction having an interior cavity 1220. The channel 1250 is a straight, continuous channel that is generally parallel to the edge of the striking face 1210. The channel 1250 extends into a relatively thick perimeter weighting portion in the toe region 1204 of the club head. In the embodiment shown, the channel 1250 has a channel length, L1, a channel width, W1, and a channel depth, D1.

Figure 12A:
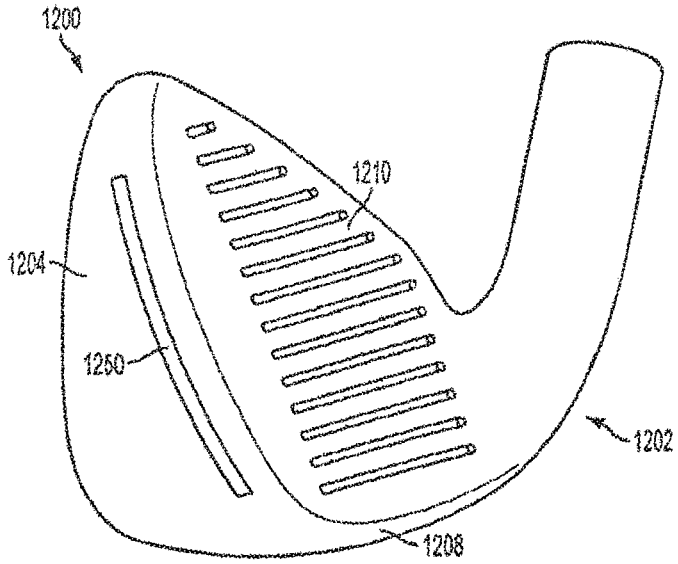
FIGS. 12A-C are elevated toe perspective views of exemplary golf club heads.

In an alternative embodiment, the club head 1200 may include a slot located at or along the toe region 1204, rather than the channel 1250 shown in FIG. 12A. In the alternative embodiment, the slot extends through the toe region 1204 of the club head and into the recess 1234 (in the case of a cavity back club head) or the interior cavity 1220 (in the case of a hollow club head). The slot may have a slot length L1 and a slot width W1.

Figure 12B:
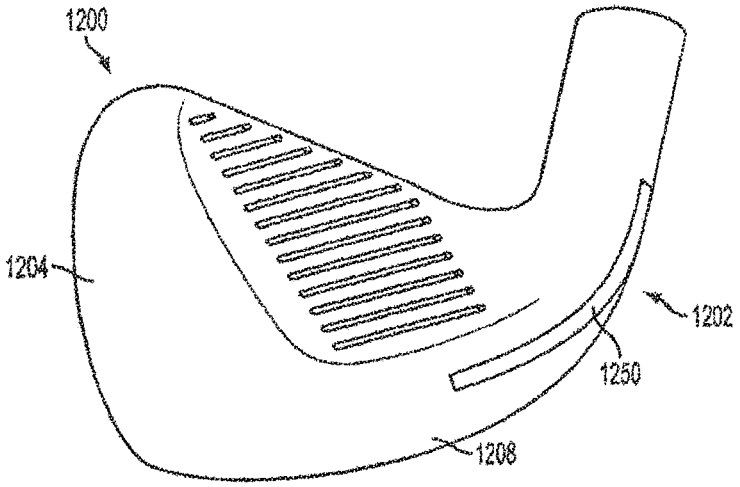
Figure 12C:
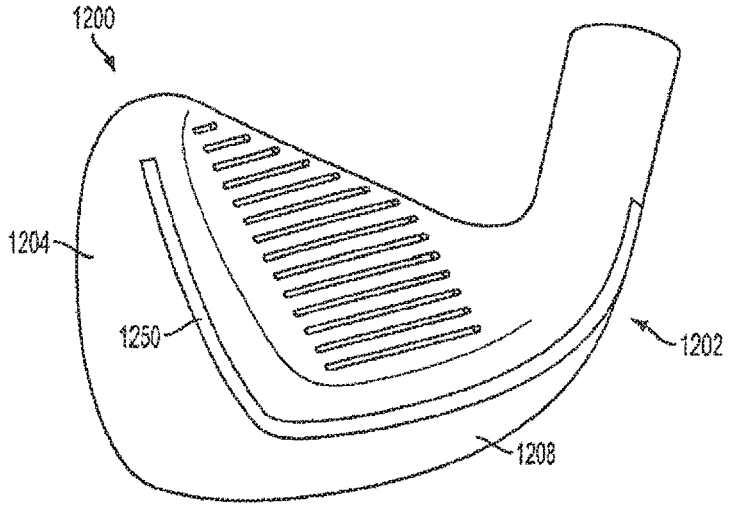

In still other embodiments, a slot, channel, or other flexible boundary structure may be located at the heel portion 102 (see FIGS. 1A-D), the top line portion 106, on the striking face 110, or at another portion of the club head. For example, in an embodiment shown in FIG. 12B, a club head 1200 includes a flexible boundary structure in the form of a channel 1250 located at a heel region 1202 of the club head. Further, in an embodiment shown in FIG. 12C, a club head 1200 includes a flexible boundary structure in the form of a channel 1250 located on the sole 1208 and extending or "wrapped" around to the toe region 1204 and heel region 1202. In those examples having a slot or a channel, the slot or channel profile may be one of the profiles shown, for example, in FIGS. 11A-H, or another profile, shape, or orientation.

Figure 13:
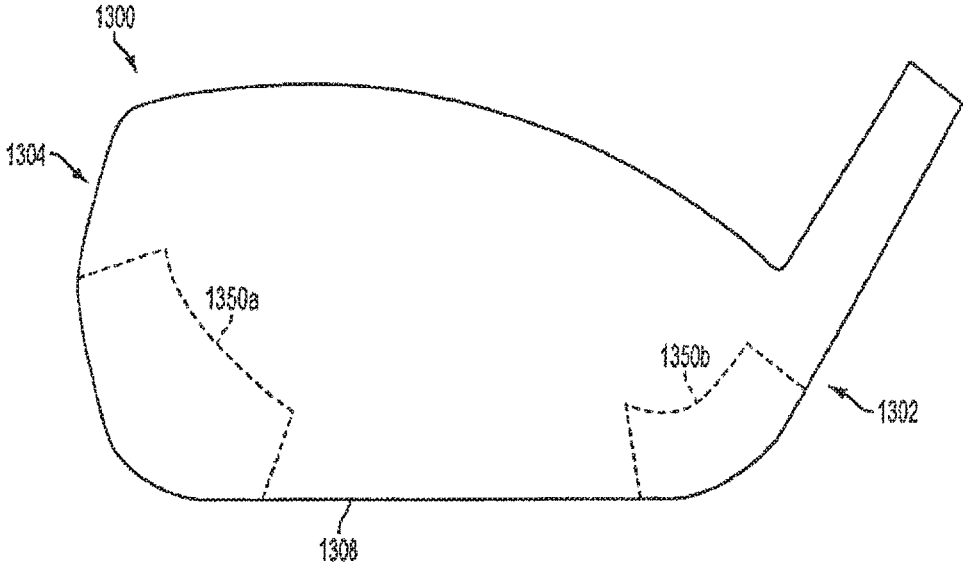
FIG. 13 is a front view of an exemplary golf club head including a schematic representation of the projections of a pair of channels on the striking face.

In still other embodiments, a plurality of flexible boundary structures may be included at separate locations on the club head. For example, another club head embodiment is shown schematically in FIG. 13, in which a first channel 1350*a* is located in the toe region 1304, and a second channel 1350*b* is located in the heel region 1302. In some embodiments, one or both of the first channel 1350*a* and second channel 1350*b* may extend onto the sole region 1308 and wrap around the club head into the toe region 1304 and/or heel region 1302, respectively. In still other embodiments, one or both of the first channel 1350*a* and second channel 1350*b* may be located fully within the toe region 1304 and/or heel region 1302, respectively.

Channel Depth Profiles

In FIGS. 2A-C, the club head 200 includes a channel 250 that has a constant depth, H1, over the full length of the channel. As noted above in the discussion of the embodiments shown in those figures, in some embodiments, the channel depth H1 may be from about 5.0 mm to about 25.0 mm, such as from about 6.0 mm to about 14.5 mm, such as from about 8.5 mm to about 13.0 mm. In one embodiment, the channel depth H1 is about 10.5 mm. In other, alternative embodiments, a club head may have a channel having a non-constant depth in order to achieve desired performance objectives.

Figure 14A:
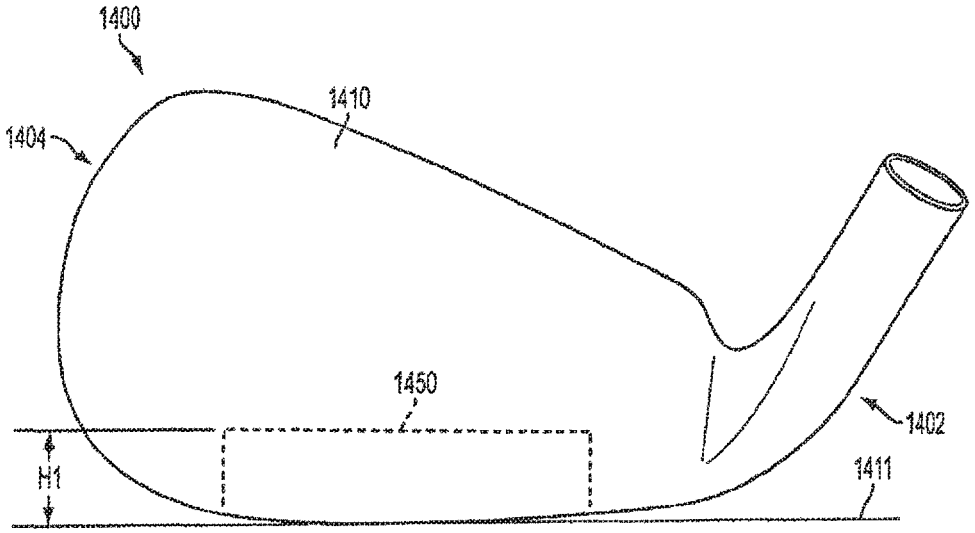
FIGS. 14A-C are front views of additional exemplary golf club heads including schematic representations of the projections of a channel on the striking face.
Figure 14B:
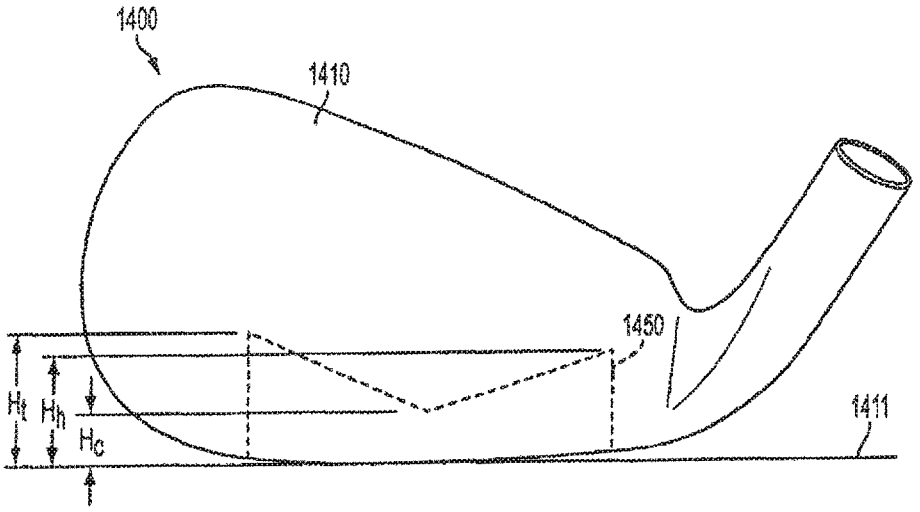
Figure 14C:
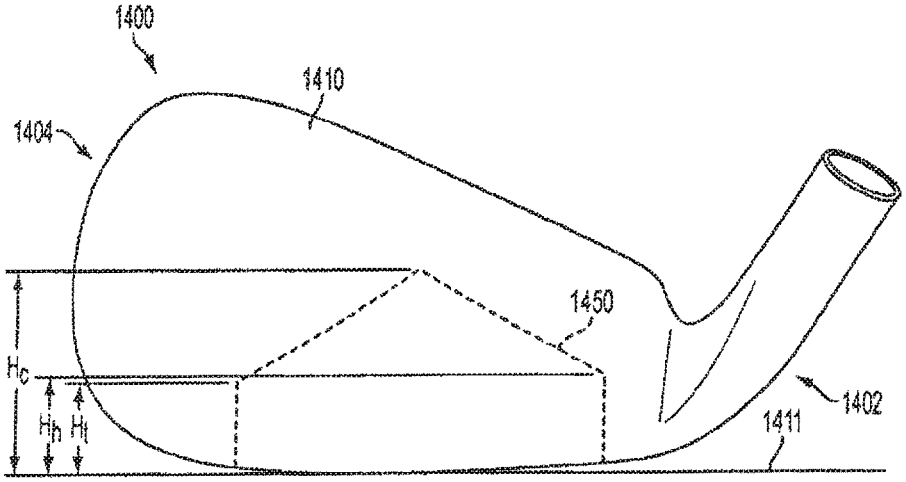

For example, several club head embodiments are shown in FIGS. 14A-C. Each of the illustrated club heads includes a channel 1450 located on the sole 1408 of the club head and extending into a sole bar (not shown) provided on the club head. For clarity, a projection of the depth profile of each of the channels is represented schematically by the dashed lines projected on the striking face 1410 of the illustrated embodiments, with it being understood that the channel 1450 is not actually visible on the striking face 1410 of an actual club head. The projected depth profiles are intended to illustrate the depth and shape of the channel 1450 within the sole bar of the club head.

The embodiment shown in FIG. 14A includes a channel 1450 having a substantially constant depth, H1 over the full heel-side to toe-side length of the channel. The embodiments shown in FIGS. 14B-C, however, include channels 1450 having a non-constant depth profile. For example, the FIG. 14B embodiment includes a channel 1450 having a toe-side depth, Ht, a heel-side depth, Hh, and a center depth, Hc, that satisfy the two inequalities: (1) Ht>Hc, and (2) Hh>Hc. On the other hand, the FIG. 14C embodiment includes a channel 1450 having a toe-side depth, Ht, a heel-side depth, Hh, and a center depth, Hc, that satisfy the two inequalities: (1) Ht<Hc, and (2) Hh<Hc.

In the embodiment shown in FIG. 14B, the peak or largest value for the depth, Ht, of the channel 1450 on the toe-side portion of the channel is located at the toe-side end of the channel, and the peak or largest value for the depth, Hh, of the channel 1450 on the heel-side portion of the channel is located at the heel-side end of the channel. In addition, the depth, Hc, of the channel at the center of the channel is a minimum depth over the full-length of the channel. The channel depth, H1, gradually increases linearly moving in each direction from the center of the channel, toward the toe region 1404 and toward the heel region 1402. In other embodiments, the peak values for the toe-side depth, Ht, and/or heel-side depth, Hh, may be located between the center of the channel and the toe-side and heel-side ends of the channel, respectively. In addition, in some embodiments, the channel depth profile may be non-linear as it progresses from the center of the channel to the ends of the channel.

In the embodiment shown in FIG. 14C the minimum value for the depth, Ht, of the channel 1450 on the toe-side portion of the channel is located at the toe-side end of the channel, and the minimum value for the depth, Hh, of the channel 1450 on the heel-side portion of the channel is located at the heel-side end of the channel. In addition, the depth, Hc, of the channel at the center of the channel is a maximum depth over the full-length of the channel. The channel depth, H1, gradually decreases linearly moving in each direction from the center of the channel, toward the toe region 1404 and toward the heel region 1402. In other embodiments, the minimum values for the toe-side depth, Ht, and/or heel-side depth, Hh, may be located between the center of the channel and the toe-side and heel-side ends of the channel, respectively. In addition, in some embodiments, the channel depth profile may be non-linear as it progresses from the center of the channel to the ends of the channel.

Multiple Channel Design

Figure 15A:
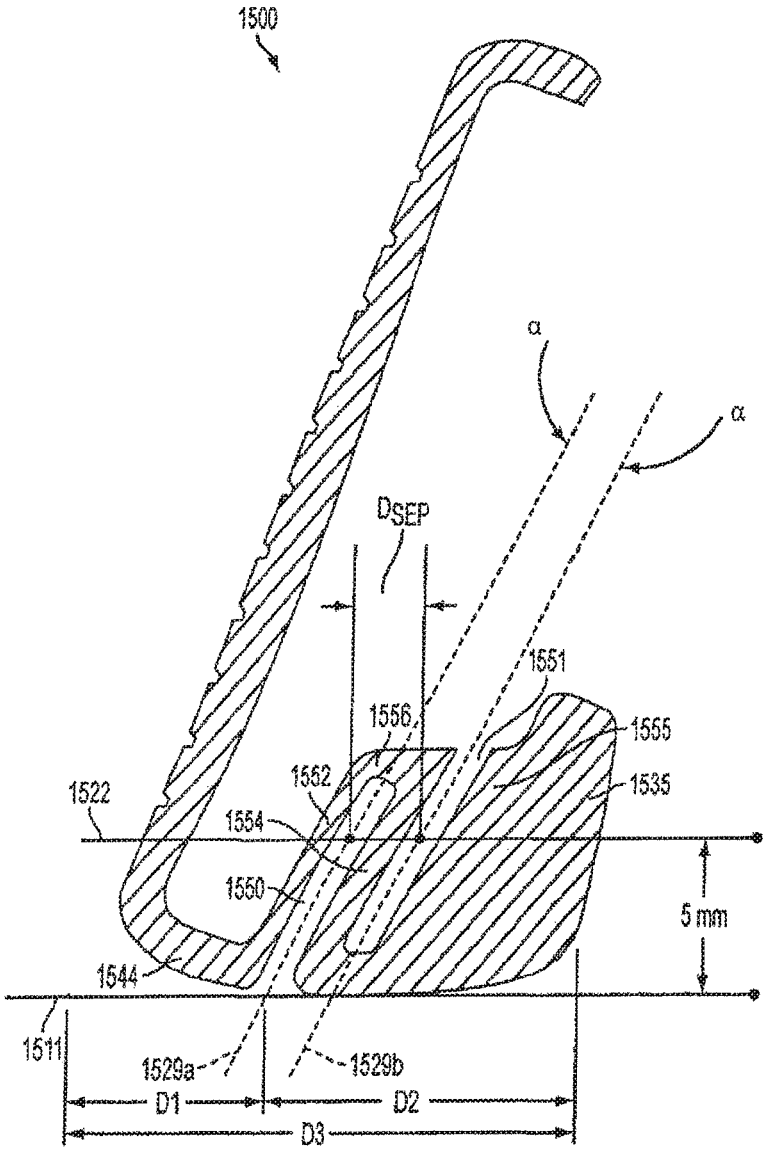
FIGS. 15A-C are cross-sectional views of exemplary golf club heads.
Figure 15B:
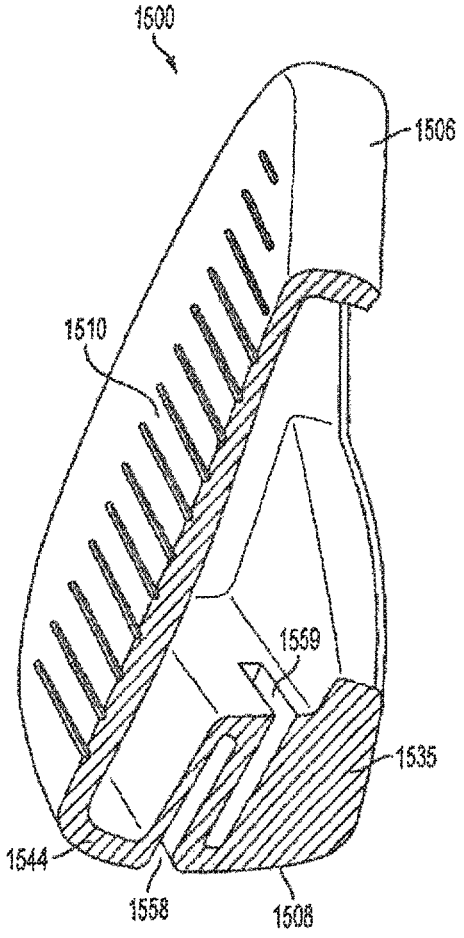

Turning next to FIGS. 15A-B, an embodiment of a club head 1500 includes a first channel 1550 and a second channel 1551 located in a sole bar 1535 of the club head. The first channel 1550 is similar to the channel described above in relation to the embodiments shown in FIGS. 2A-C, having a channel to face distance, D1, a first channel width, W1, a first channel depth, H1, and a first channel length, L1. The forward wall 1552 of the first channel defines a first hinge region 1560 having a first hinge region thickness, T1, and a second hinge region 1562 having a second hinge region thickness, T2. The forward portion 1544 of the sole defines a wall having a forward sole thickness, $T_{FS}$. The first channel 1550 further includes a rear wall 1554 and upper wall 1556. A first channel opening 1558 is located on the sole region 1508 of the club head.

The second channel 1551 is located immediately rearward of (i.e., away from the striking face 1510 from) the first channel 1550, and is defined by the first channel rear wall 1554, a second channel rear wall 1555, and a second channel lower wall 1557. A second channel opening 1559 is located on the upper surface of the sole bar 1535. The second channel 1551 has a second channel width, W2, a second channel depth, H2, and a second channel length, L2. The second channel width, W2, is measured using substantially the same method used to measure the first channel width, W1, adapted based upon the relative orientation of the second channel. The second channel depth, H2, is the vertical distance between a first horizontal plane corresponding with the second channel opening 1559 and a second horizontal plane that contains the lowermost point of the interior of the second channel 1551. The second channel length L2 is a measure of the distance on the sole bar 1535 of the club head between the toeward-most point of the second channel 1551 and the heelward-most point of the second channel 1551, without taking into account any curvature of the channel 1551. The rear wall 1554 of the first channel, which corresponds to a forward wall of the second channel 1551, defines a third hinge region 1564 having a third hinge region thickness, T3, and a fourth hinge region 1562 having a fourth hinge region thickness, T4.

The first channel 1550 and second channel 1551 are separated by a channel separation distance, $D_{SEP}$, that is determined as follows. A first channel centerline 1529*a* and second channel centerline 1529*b* are constructed in the manner described above in relation to the channel centerline shown in FIGS. 2D-E. An imaginary reference line 1522 is drawn parallel to the ground plane 1511 at a height of 5 mm above the ground plane. The distance between the points of intersection of the reference line 1522 and the first channel centerline 1529*a* and second channel centerline 1529*b* defines the channel separation distance $D_{SEP}$.

In some embodiments, the first channel centerline 1529*a* and second channel centerline 1529*b* are parallel to one another. In other embodiments, the first channel centerline 1529*a* and second channel centerline 1529*b* are oriented such that they define a channel centerline angle α therebetween. In some embodiments, the first channel centerline 1229*a* has an orientation that is steeper (i.e., closer to vertical) than the orientation of the second channel centerline 1229*b*. In those embodiments, the channel centerline angle α is oriented "upward" and may have a value ranging from slightly greater than 0° to slightly less than 90°, such as between about 1° and about 15°. In some other embodiments, the first channel centerline 1229*a* has an orientation that is shallower (i.e., closer to horizontal) than the orientation of the second channel centerline 1229*b*. In those embodiments, the channel centerline angle α is oriented "downward" and may have a value ranging from slightly greater than 0° to slightly less than 90°, such as between about 1° and about 15°.

Table 6 below lists several exemplary values for the channel separation distance $D_{SEP}$ and channel centerline angle α for several examples of club heads that include a dual channel design according to the embodiments described herein.

TABLE 6

| | Loft | DSEP (mm) | α (Range) |
|---|---|---|---|
| Ex. 1 | 20-21° | 1.5-8.0 | 0 to 45 deg |
| | (4I) | 2.0-6.0 | 0 to 45 deg |
| | | 2.5-4.0 | 0 to 45 deg |
| Ex. 2 | 26-28° | 1.5-8.0 | 0 to 45 deg |
| | (6I) | 2.0-6.0 | 0 to 45 deg |
| | | 2.5-4.0 | 0 to 45 deg |

Figure 15C:
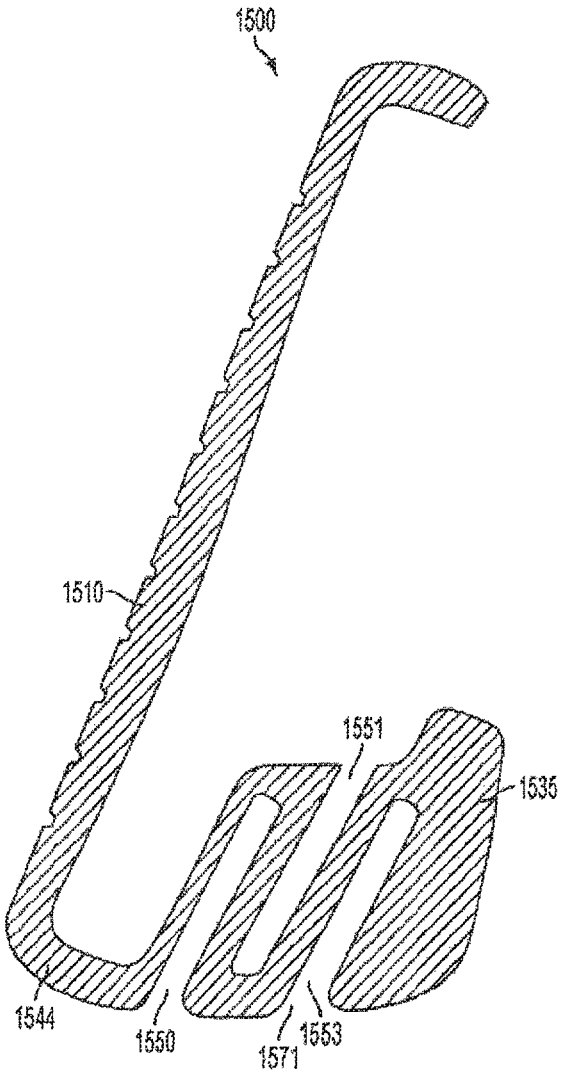

FIG. 15C shows another embodiment of a club head 1500 that includes a first channel 1550, a second channel 1551, and a third channel 1553 located in a sole bar 1535 of the club head. The first channel 1550 and second channel 1551 are similar to the channels described above in relation to the embodiments shown in FIGS. 15A-B, having channel to face distances, D1 and D2, channel widths, W1 and W2, channel depth, H1 and H2, and channel lengths, L1 and L2. The forward wall 1552 of the first channel defines a first hinge region 1560 having a first hinge region thickness, T1, and a second hinge region 1562 having a second hinge region thickness, T2. The forward portion 1544 of the sole defines a wall having a forward sole thickness, $T_{FS}$. The first channel 1550 further includes a rear wall 1554 and upper wall 1556. A first channel opening 1558 is located on the sole region 1508 of the club head.

The third channel 1553 is located immediately rearward of (i.e., away from the striking face 1510 from) the second channel 1551, and is defined by the second channel rear wall 1555, a third channel rear wall 1568, and a third channel upper wall 1569. A third channel opening 1571 is located on the lower surface of the sole bar 1535. The third channel 1553 has a third channel width, W3, a third channel depth, H3, and a third channel length, L3, each of which is measured using substantially the same method used to measure the corresponding parameters of the first channel.

Fillers, Damping, Vibration

In the club head embodiments described above, the described flexible boundary structures include channel and slot designs that define voids or spaces within the club head. In some embodiments, these voids or spaces are left unfilled. In others, such as the embodiments illustrated in FIGS. 2H and 19C, a filler material 223 may be added into the channel, slot, or other flexible boundary structure. One or more fillers may be added to achieve desired performance objectives, including preventing unwanted materials (e.g., water, grass, dirt, etc.) from entering the channel or slot, or obtaining desired changes to the sound and feel of the club head by damping vibrations that occur when the club head strikes a golf ball.

Examples of materials that may be suitable for use as a filler to be placed into a slot, channel, or other flexible boundary structure include, without limitation: viscoelastic elastomers; vinyl copolymers with or without inorganic fillers; polyvinyl acetate with or without mineral fillers such as barium sulfate; acrylics; polyesters; polyurethanes; polyethers; polyamides; polybutadienes; polystyrenes; polyisoprenes; polyethylenes; polyolefins; styrene/isoprene block copolymers; hydrogenated styrenic thermoplastic elastomers; metallized polyesters; metallized acrylics; epoxies; epoxy and graphite composites; natural and synthetic rubbers; piezoelectric ceramics; thermoset and thermoplastic rubbers; foamed polymers; ionomers; low-density fiber glass; bitumen; silicone; and mixtures thereof. The metallized polyesters and acrylics can comprise aluminum as the metal. Commercially available materials include resilient polymeric materials such as Scotchweld™ (e.g., DP105™) and Scotchdamp™ from 3M, Sorbothane™ from Sorbothane, Inc., DYAD™ and GP™ from Soundcoat Company Inc., Dynamat™ from Dynamat Control of North America, Inc., NoViFlex™ Sylomer™ from Pole Star Maritime Group, LLC, Isoplast™ from The Dow Chemical Company, Legetolex™ from Piqua Technologies, Inc., and Hybrar™ from the Kuraray Co., Ltd.

In some embodiments, a solid filler material may be press-fit or adhesively bonded into a slot, channel, or other flexible boundary structure. In other embodiments, a filler material may poured, injected, or otherwise inserted into a slot or channel and allowed to cure in place, forming a sufficiently hardened or resilient outer surface. In still other embodiments, a filler material may be placed into a slot or channel and sealed in place with a resilient cap or other structure formed of a metal, metal alloy, metallic, composite, hard plastic, resilient elastomeric, or other suitable material.

In some embodiments, the portion of the filler 223 or cap that is exposed within the channel 250 has a generally convex shape and is disposed within the channel such that the lowermost portion of the filler 223 or cap is displaced by a gap, $D_F$, below the lowermost surface of the immediately adjacent portions of the body of the club head 200. (See, e.g., FIG. 2H). The gap $D_F$ is preferably sufficiently large to prevent excessive wear and tear on the filler 223 or cap that is exposed within the channel due to striking the ground or other objects. In this way, the filler 223 or cap is not exposed to excessive wear due to contact with the ground during a swing that would otherwise occur if the filler 223 or cap were located flush with the adjacent portions of the club head body.

Figure 19C:
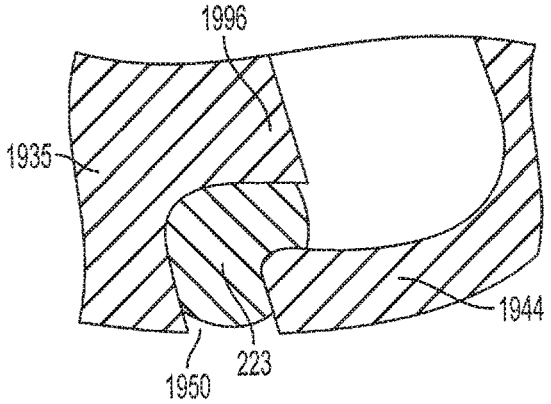
FIG. 19C is a close-up cross-sectional view of a golf club head having a slot including a filler material.

In the embodiment shown in FIG. 19C, the club head 1900 includes a slot 1950 and an overhang 1996. Whereas the slot 1950 provides a passage through the sole 1908 and into a rear void (e.g., a recess 1934 or internal cavity 120) of the club head, the overhang 1996 extends from the sole bar 1935 and partially blocks the passage. In this way, the overhang 1996 serves as a backstop to partially trap or retain a viscous filler material 223 that is injected or otherwise inserted into the slot 1950 during manufacture of the club head. Accordingly, during manufacture, the viscous filler material 223 may be injected through the slot 1950, where it will encounter the overhang 1996 which will stop the generally upward flow of the filler material 223 and redirect the flow generally toward the striking face 1910, thereby reducing the amount of filler material 223 needed to seal the slot 1950.

Golf Club Sets

Figure 16:
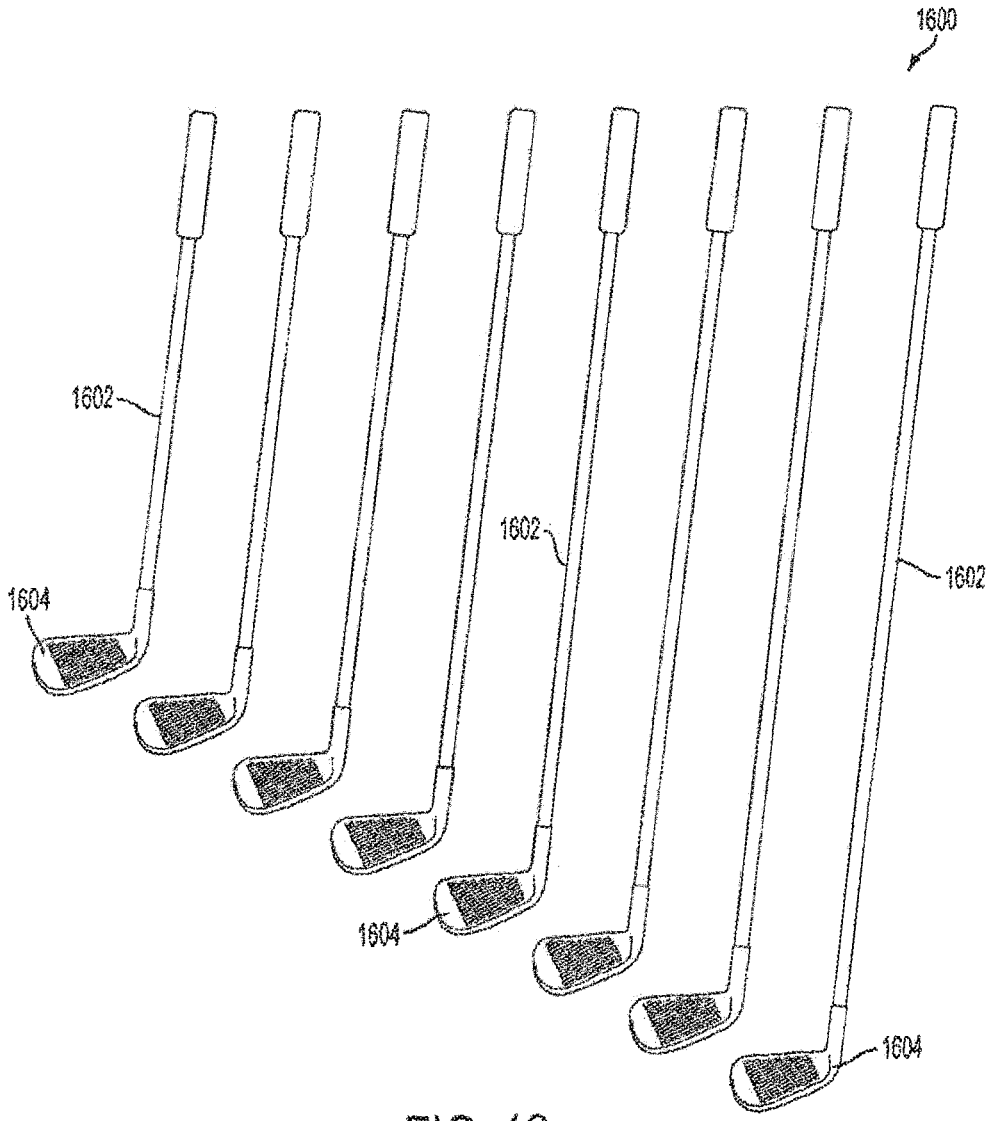
FIG. 16 is an illustration of an embodiment of a golf club set.
Figure 17A:
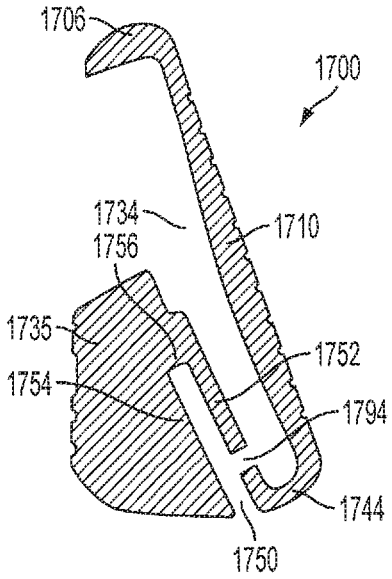
FIG. 17A is a cross-sectional view of another embodiment of a golf club head.
Figure 17B:
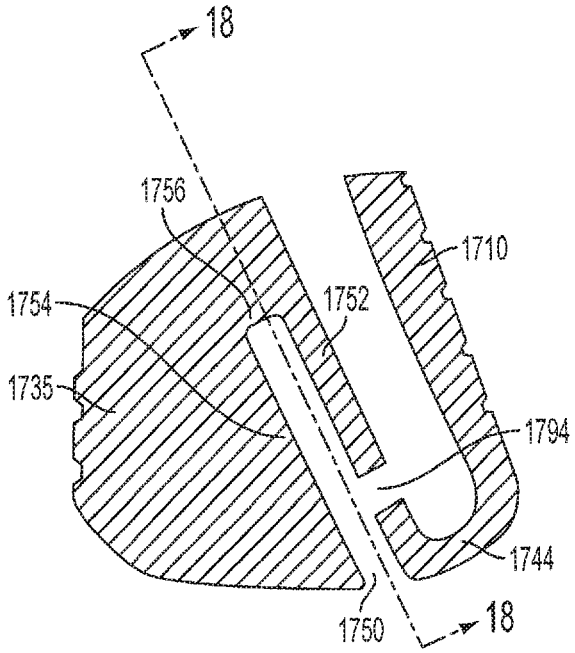
FIG. 17B is a close-up cross-sectional view of a portion of the golf club head shown in FIG. 17A.

Referring now to FIG. 16, there is illustrated a golf club set 1600. The golf club set 1600 may include one or more types of golf club heads 1604, including cavity back, muscleback, blades, hollow clubs or other types of club heads typically used as part of a set. The golf club set 1600 may have varying performance characteristics between clubs. For example, shafts 1602 may vary in length, swing weight may vary, and one or more of the performance characteristics noted above may vary. As one example, at least a portion of the golf clubs of set 1600 may include hollow clubs. Individual hollow clubs may include hollow areas that vary in volume. Furthermore, hollow areas may be filled with foam, polymer or other types of materials, and the particular type of filler materials may vary from club to club. Additionally, the club types within set 1600 may vary, such as by including some hollow clubs, some cavity back clubs and some muscleback clubs within one set.

In several embodiments of the golf club set 1600, at least one of the golf clubs included in the set 1600 has a club head 1604 having a flexible boundary structure, such as a slot, a channel, or other structure, whereas at least one other of the golf clubs included in the set 1600 has a club head 1604 that does not have a flexible boundary structure. For example, in some embodiments, at least one of the golf clubs included in the set 1600 has a club head 1604 having a slot or channel such as one or more of the club head embodiments described herein in reference to FIGS. 2A-H through 15A-C, and at least one other of the golf clubs included in the set 1600 does not have a flexible boundary structure. In some embodiments, a set of 8 or more golf clubs may include up to 2, up to 3, up to 4, up to 5, up to 6, or up to 7 golf clubs with club heads having a flexible boundary structure, with the remainder having no flexible boundary structure.

Tables 7A through 7D illustrate four particular embodiments of golf club sets 1600 having performance characteristics that vary between clubs within the set. However, it is worthwhile to note that these are just four embodiments and the claimed subject matter is not limited in this respect.

TABLE 7A

| Iron # | 3 | 4 | 5 | 6 | 7 | 8 | 9 | PW |
|---|---|---|---|---|---|---|---|---|
| Loft (Range) | 17-19° | 20-21° | 23-24° | 26-28° | 30-32° | 34-36° | 39-41° | 44-46° |
| Head Constr. | Cavity-back | Cavity-back | Cavity-back | Cavity-back | Cavity-back | Cavity-back | Cavity-back | Cavity-back |
| FBS | Y | Y | Y | N | N | N | N | N |
| FBS Type | Channel | Channel | Channel | | | | | |
| FBS Location | Sole | Sole | Sole | | | | | |
| FBS Shape | FIGS. 2A-C | FIGS. 2A-C | FIGS. 2A-C | | | | | |

TABLE 7B

| Iron # | 3 | 4 | 5 | 6 | 7 | 8 | 9 | PW |
|---|---|---|---|---|---|---|---|---|
| Loft (Range) | 17-19° | 20-21° | 23-24° | 26-28° | 30-32° | 34-36° | 39.41° | 44-46° |
| Head Constr. | Hollow | Hollow | Hollow | Cavity-back | Cavity-back | Cavity-back | Cavity-back | Cavity-back |
| FBS | Y | Y | Y | Y | Y | N | N | N |
| FBS Type | Channel | Channel | Channel | Channel | Channel | | | |
| FBS Location | Sole | Sole | Sole | Sole | Sole | | | |
| FBS Shape | FIGS. 2A-C | FIGS. 2A-C | FIGS. 2A-C | FIGS. 2A-C | FIGS. 2A-C | | | |

TABLE 7C

| Iron # | | | | | | | | | | |
|---|---|---|---|---|---|---|---|---|---|---|
| Loft (Range) | 0-21° | 3-24° | 6-28° | 0-32° | 4-36° | 9-41° | 4-46° | 9-51° | 4-56° | 9-61° |
| Head Constr. | ol-low | ol-low | av-back | av-back | av-back | av-back | av-back | av-back | av-back | av-back |
| FBS | Y | Y | Y | Y | Y | Y | Y | Y | N | N |
| FBS Type | han-nel | han-nel | han-nel | han-nel | han-nel | han-nel | han-nel | han-nel | | |
| FBS Location | ole | ole | ole | ole | ole | ole | ole | ole | | |
| FBS Shape | IG. 2A-C | IG. 2A-C | IG. 2A-C | IG. 2A-C | IG. 2A-C | IG. 2A-C | IG. 2A-C | IG. 2A-C | | |

TABLE 7D

| Iron # | | | | | | | | |
|---|---|---|---|---|---|---|---|---|
| Loft (Range) | 7-19° | 0-21° | 3-24° | 6-28° | 0-32° | 4-36° | 9-41° | 4-46° |
| Head Constr. | ol-low | ol-low | ol-low | av-back | av-back | av-back | av-back | av-back |
| FBS | | | | | | | | |
| FBS Type | han-nel | han-nel | han-nel | han-nel | han-nel | | | |
| FBS Location | ole | ole | ole | ole | ole | | | |
| FBS Shape | IG. 2A-C | IG. 2A-C | IG. 2A-C | IG. 2A-C | IG. 2A-C | | | |

As reflected in Tables 7A through 7D, there are unique compositions of golf clubs within a multi-club set, one or more of which include a flexible boundary structure (e.g., a channel) and one or more of which do not include a flexible boundary structure. (It should be understood that the golf club set may have fewer or more irons than set forth in Tables 7A through 7D.) It is generally preferable to achieve a consistent average gapping distance from club to club. In this way, the golfer is provided with a full range of consistent and increasing club shot distances so that the golfer can select a club or iron for the distance required by a particular shot or situation. Typically, the average gapping distance from club to club in a set of irons for an average player is about 8-10 yards. As set forth herein, the unique inclusion of individual clubs having a flexible boundary structure with those not having a flexible boundary structure from the LW to the 3-iron helps provide for an average gapping distance for an average player of about 11-15 yards from club to club, respectively. In this respect, the embodiments herein provide consistency as well as an overall greater range of distances for the golfer.

Other parameters may contribute to overall greater gap distance in the set, and greater ball speed and distance for each individual iron. These parameters include shaft length, face thickness, face area, weight distribution (and resultant club head moment of inertia ("MOI") and center of gravity ("CG") location), and others. In addition, still other parameters may contribute to performance, playability, forgiveness or other features of golf clubs contained within the set. These parameters include topline thicknesses (and topline thickness progression within the set), swing weights, and sole widths. Descriptions of the contributions of these parameters to the performance of golf clubs within a set of golf clubs is provided in United States Published Patent Application No. 2011/0159981, which is hereby incorporated by reference in its entirety.

Club Head Performance

The inventors of the club heads described herein investigated the effect of incorporating channels, slots, and other flexible boundary structures into the perimeter regions of iron type club heads. Iron golf club head designs were modeled using commercially available computer aided modeling and meshing software, such as Pro/Engineer by Parametric Technology Corporation for modeling and Hypermesh by Altair Engineering for meshing. The golf club head designs were analyzed using finite element analysis (FEA) software, such as the finite element analysis features available with many commercially available computer aided design and modeling software programs, or stand-alone FEA software, such as the ABAQUS software suite by ABAQUS, Inc. Under simulation, models of iron type golf club heads having flexible boundary structures incorporated into perimeter regions of the club heads were observed to produce relatively higher values of COR and CT when compared to similarly constructed golf club heads that do not include a flexible boundary structure.

In addition, golf club heads having channels were constructed to determine the effect of incorporating a channel into the perimeter regions of the club heads. COR measurements were taken of two golf club heads. The first club head did not include a flexible boundary structure. The second club head included a straight, continuous channel located in the sole of the club head, and having the following parameters set forth in Table 8:

TABLE 8

| | |
|---|---|
| Face to channel distance (D1) | 8.7 mm |
| Club head depth (DCH) | 27.9 mm |
| Channel width (W1) | 1.5 mm |
| Channel depth (H1) | 12.3 mm |
| First hinge thickness (T1) | 1.0 mm |
| Second hinge thickness (T2) | 1.0 mm |
| Forward sole min thickness (TFS) | 2.0 mm |
| Sole bar max thickness (TSB) | 15.3 mm |
| Channel length (L1) | 54 mm |

TABLE 8-continued

| | |
|---|---|
| Sole Length (LB) | 82.2 mm |
| Ratio D1/DCH | 0.31 |
| Ratio TFS/TSB | 0.13 |
| Ratio L1/LB | 0.66 |

The golf clubs were otherwise identical. For the current disclosure, unless otherwise indicated, COR testing should be understood to be performed following USGA procedure for testing iron COR—notably, with a ball speed of 133 fps. See U.S.G.A. "Interim Procedure for Measuring the Coefficient of Restitution of an Iron Clubhead Relative to a Baseline Plate," Revision 1.2, Nov. 30, 2005. COR testing was performed at several locations on the striking face of each of the club heads, and the following results were obtained:

TABLE 9

| | Without Channel | | With Channel | | |
|---|---|---|---|---|---|
| | Location | Relative COR | Location | Relative COR | COR Gain |
| Toe | −10 mm | −0.045 | −10 mm | −0.026 | 0.019 |
| Toe | −5 mm | −0.017 | −5 mm | −0.004 | 0.013 |
| ISL | 0 | −0.009 | 0 | 0.005 | 0.014 |
| Heel | 5 mm | −0.015 | 5 mm | −0.004 | 0.011 |
| Heel | 10 mm | −0.033 | 10 mm | −0.014 | 0.019 |
| Crown | 5 mm | −0.052 | 5 mm | −0.022 | 0.030 |
| Crown | 2.5 mm | −0.011 | 2.5 mm | 0.002 | 0.013 |
| ISL | 0 | −0.009 | 0 | 0.005 | 0.014 |
| Sole | −2.5 mm | −0.031 | −2.5 mm | −0.004 | 0.027 |
| Sole | −5 mm | −0.045 | −5 mm | −0.014 | 0.031 |

In Table 9, the location "ISL" refers to the ideal striking location. The references to locations at distances toward the "Toe" and "Heel" refer to horizontal distances within the striking face plane from the ISL toward the toe and heel of the club head. The references to locations at distances toward the "Crown" and "Sole" refer to distances toward the crown and sole of the club head along a line defined by the intersection of the striking face plane and a perpendicular vertical plane. Accordingly, the flexible boundary structure was responsible for an increase in the COR of the club head of from about 0.11 to about 0.31, depending upon the location on the striking face of the club head.

Alternative FBS Features and Locations

As previously described, altering the boundary condition of golf club heads—such as those described elsewhere within this disclosure—can alter performance for off-center strikes. Embodiments described elsewhere in this disclosure provide altered performance for off-center strikes in the vertical direction. In particular, embodiments such as golf club head 200 provide notable performance advantages for strikes below the ideal strike location 101, particularly for those on a line passing through the ideal strike location 101 and coincident with the center face (hereinafter the "center line").

However, in many cases, off-center strikes occur at locations other than the center line of the golf club head. In many cases, off-center strikes occur at locations toward the heel or, more often, toward the toe of the golf club head. Off-center strikes result in lower distance and relatively poor performance as discussed elsewhere in this disclosure. One solution is the inclusion of FBS features in locations of the than the sole of the golf club head to promote increased performance on off-center strikes in locations other than those coincident with the center line.

Figure 21:
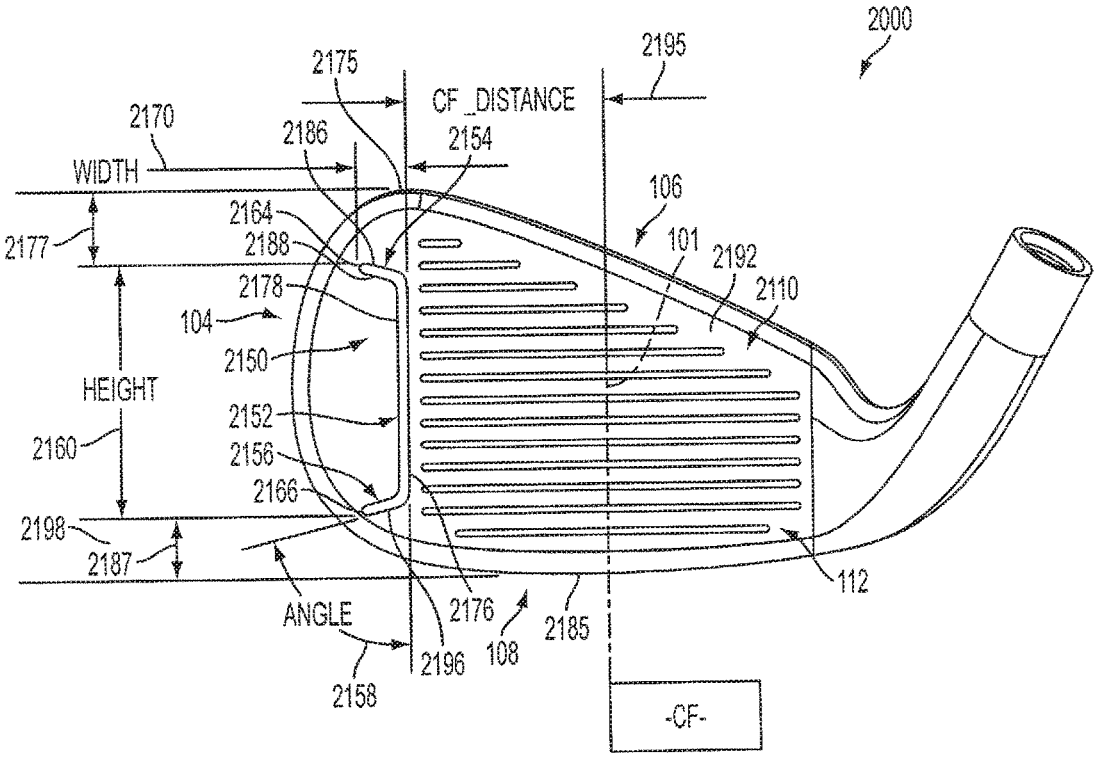
FIG. 21 is a front side view of a golf club head in accord with one embodiment of the current disclosure.

A golf club head 2000 includes features similar to those described elsewhere in this disclosure and is shown with reference to FIG. 21. For the sake of this disclosure, one of skill in the art would understand that similarly drawn features are transferable between and among the various embodiments, and that features described with reference to one embodiment may be imported into other embodiments as would be understood by one of skill in the art.

The golf club head 2000 includes a striking face 2110 similar to those described elsewhere in this disclosure. The striking face 2110 of the current embodiment includes a FBS that is a channel 2150 defined in the striking face 2110 in the current embodiment. The channel 2150 of the current embodiment includes a central portion 2152, a first end portion 2154, and a second end portion 2156. In the current embodiment, the central portion 2152 is oriented with its major length being about perpendicular to the general direction of the grooves 112. The first end portion 2154 and the second end portion 2156 are oriented with respect to the central portion 2152 at an angle 2158. As can be seen, a variety of radii may be used at the junction of the central portion 2152 with the end portions 2154, 2156. In various embodiments, the radius may be 1 mm. In various embodiments, the radius may be 5-10 mm. In various embodiments, the radius may be 10-20 mm. In various embodiments, the radius may be 5-25 mm.

The channel 2150 is defined by an overall height 2160 as measured in the face plane 125 (see FIG. 1B) from a first end 2164 to a second end 2166 in a direction from the sole 108 to the top line 106 generally parallel to a line denoting the center face in the current view (and labeled "CF"). The channel 2150 is also defined by an overall width 2170 as measured perpendicularly to the direction of measurement of the overall height 2160. The overall width 2170 measures from the ends 2164, 2166 to a central portion inner edge 2176. In the current embodiment, the central portion inner edge 2176 is a linear end, although in various embodiments the central portion inner edge 2176 may be of various shapes, including rounded or jagged. A central portion outer edge 2178 is shown as well being opposed to the central portion inner edge 2176. The first end portion 2154 includes a first end portion first edge 2186 and a first end portion second edge 2188. The second end portion 2156 includes a second end portion first edge 2196 and a second end portion second edge 2198. A distance to center face 2195 is measured as the distance from the inner edge 2176 to the center face 101 or CF as measured in a direction parallel with the grooves 112. In the current embodiment and related embodiments, the channel 2150 is arranged such that it is about centered in a vertical direction between a highest point 2175 and a lowest point 2185 such that a first distance 2177 measuring the distance between the highest point 2175 and the first end 2164 is about the same as a second distance 2187 measuring the distance between the lowest point 2185 and the second end 2166.

As can be seen, the first end portion 2154 and the second end portion 2156 provide a terminus of the channel 2150 that is disposed distal to the intended ideal strike location 101. In various embodiments, toeward strikes on the golf club head 2000 can produce deflection of the channel 2150. In various embodiments, deflection may cause failure, particularly at various ends of the channel 2150 in various configurations. As such, the first end portion 2154 and second end portion 2156 move the ends 2164, 2166 to a location that is more remote from the striking location, reducing stress concentrations on the channel 2150 and providing a more gradual reduction in stress along the channel 2150.

By providing the channel 2150 in the toe portion 104 of the golf club head 2000, performance can be improved for off-center hits in locations approaching the toe portion 104 of the golf club head.

Figure 22A:
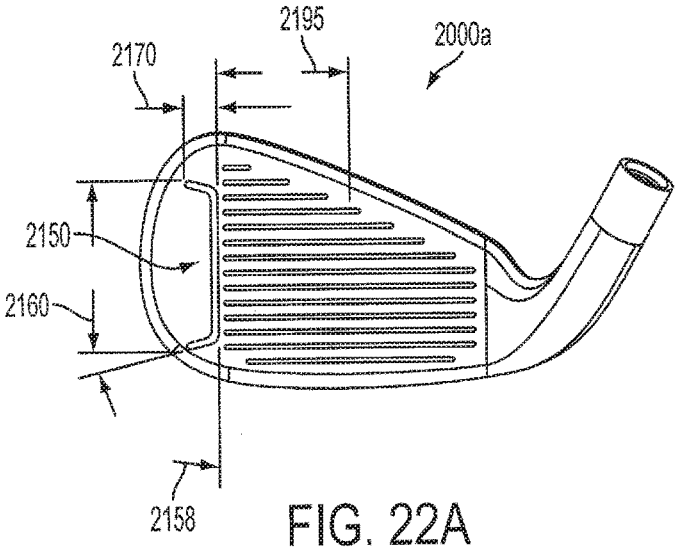
FIG. 22A is a front side view of one exemplary embodiment of the golf club head of FIG. 21.
Figure 22B:
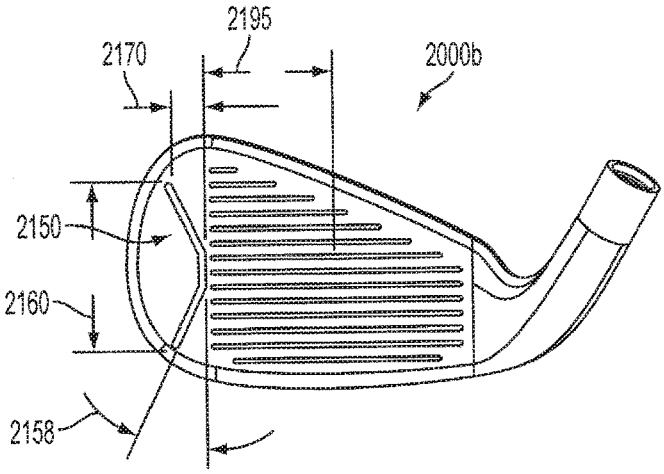
FIG. 22B is a front side view of one exemplary embodiment of the golf club head of FIG. 21.
Figure 22C:
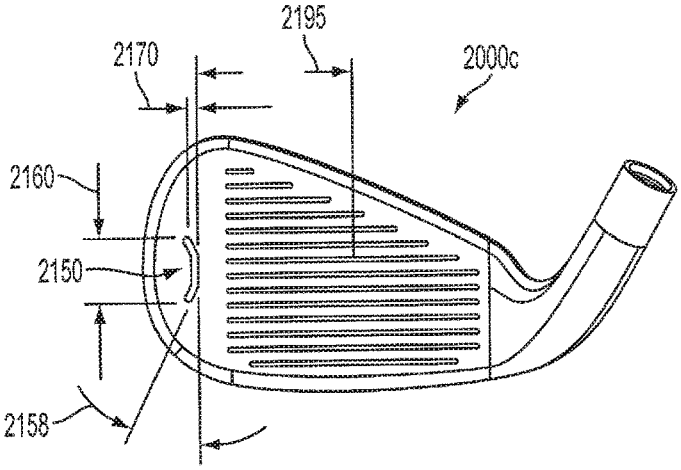
FIG. 22C is a front side view of one exemplary embodiment of the golf club head of FIG. 21.
Figure 22D:
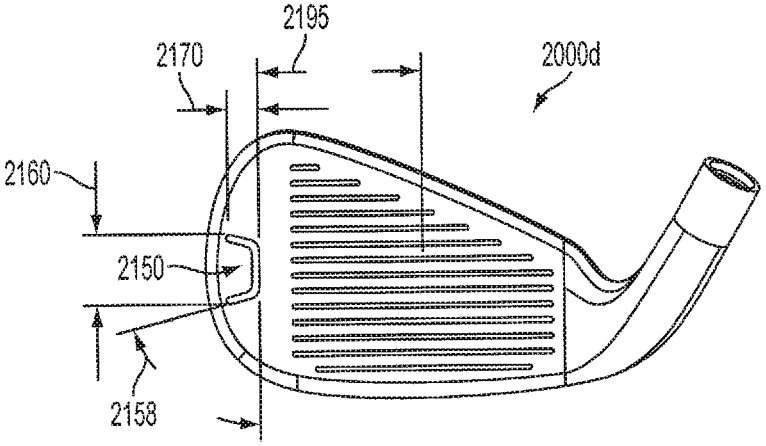
FIG. 22D is a front side view of one exemplary embodiment of the golf club head of FIG. 21.
Figure 22E:
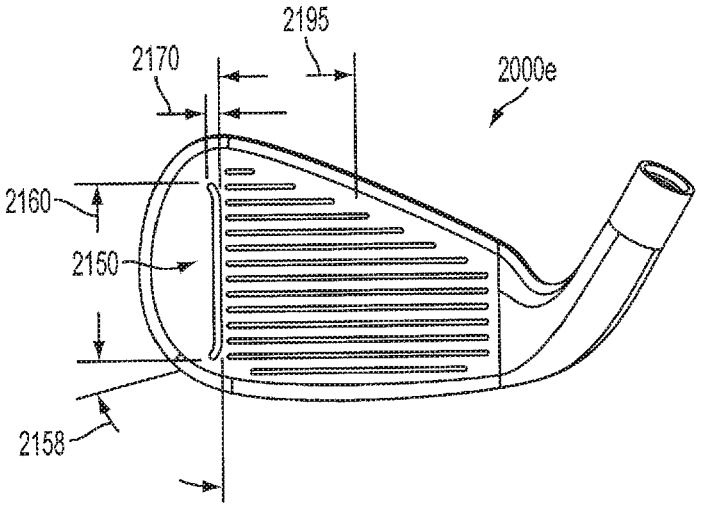
FIG. 22E is a front side view of one exemplary embodiment of the golf club head of FIG. 21.

Various embodiments of the golf club head 2000 can be seen with reference to FIGS. 22A-22E. FIG. 22A displays a golf club head 2000*a* wherein the distance to center face 2195 is 30 mm, the overall width 2170 is 7 mm, the overall height 2160 is 38 mm, and the angle 2158 is 75°. FIG. 22B displays a golf club head 2000*b* wherein the distance to center face 2195 is 30 mm, the overall width 2170 is 7 mm, the overall height 2160 is 38 mm, and the angle 2158 is 25°. FIG. 22C displays a golf club head 2000*c* wherein the distance to center face 2195 is 35 mm, the overall width 2170 is 2 mm, the overall height 2160 is 15 mm, and the angle 2158 is 25°. FIG. 22D displays a golf club head 2000*d* wherein the distance to center face 2195 is 35 mm, the overall width 2170 is 7 mm, the overall height 2160 is 15 mm, and the angle 2158 is 75°. FIG. 22E displays a golf club head 2000*e* wherein the distance to center face 2195 is 30 mm, the overall width 2170 is 2 mm, the overall height 2160 is 38 mm, and the angle 2158 is 75°. As such, the variance in design parameters can greatly alter the appearance and shape of the channel 2150. One of skill in the art would understand that the various parameters may be interchanged amongst the various embodiments and may vary to lengths and angles other than those specified in this disclosure. The embodiments disclosed should not be considered limiting, and parameters between those disclosed may be utilized in varying embodiments as well.

As can be seen, a variety of shapes can be formed by varying the features of the channel 2150 as desired within the parameters described elsewhere herein. In varying the features of the channel 2150, performance of the channel 2150 as a FBS feature changes.

TABLE 10

| Overall Height Ref. No. 2160 | Distance to Center Face Ref. No. 2195 | Overall Width Ref. No. 2170 | Angle Ref. No. 2158 | COR at Ideal Strike Loc | COR 15 mm Toeward | COR Difference |
|---|---|---|---|---|---|---|
| 15 mm | 30 mm | 2 mm | 25° | 0.847 | 0.776 | 0.072 |
| 38 mm | 30 mm | 2 mm | 25° | 0.840 | 0.771 | 0.069 |
| 15 mm | 35 mm | 2 mm | 25° | 0.832 | 0.752 | 0.080 |
| 38 mm | 35 mm | 2 mm | 25° | 0.844 | 0.775 | 0.069 |
| 15 mm | 30 mm | 7 mm | 25° | 0.831 | 0.752 | 0.079 |
| 38 mm | 30 mm | 7 mm | 25° | 0.843 | 0.775 | 0.068 |
| 15 mm | 35 mm | 7 mm | 25° | 0.847 | 0.776 | 0.071 |
| 38 mm | 35 mm | 7 mm | 25° | 0.845 | 0.776 | 0.069 |
| 15 mm | 30 mm | 2 mm | 75° | 0.847 | 0.776 | 0.071 |
| 38 mm | 30 mm | 2 mm | 75° | 0.839 | 0.770 | 0.069 |
| 15 mm | 35 mm | 2 mm | 75° | 0.847 | 0.775 | 0.071 |
| 38 mm | 35 mm | 2 mm | 75° | 0.830 | 0.756 | 0.074 |
| 15 mm | 30 mm | 7 mm | 75° | 0.846 | 0.776 | 0.070 |
| 38 mm | 30 mm | 7 mm | 75° | 0.839 | 0.772 | 0.067 |
| 15 mm | 35 mm | 7 mm | 75° | 0.849 | 0.781 | 0.068 |
| 38 mm | 35 mm | 7 mm | 75° | 0.844 | 0.762 | 0.082 |

As noted above for all COR testing of the current disclosure, Table 10 was determined using USGA procedure for measuring iron COR. See U.S.G.A. "Interim Procedure for Measuring the Coefficient of Restitution of an Iron Clubhead Relative to a Baseline Plate," Revision 1.2, Nov. 30, 2005. Table 10 displays various performance results for the various changing design parameters. As can be seen, COR at the ideal strike location 101 varies from about 0.830 to about 0.849. Similarly, COR at a location 15 mm toeward from the ideal strike location 101 varies from about 0.770 to about 0.781. As measured, the difference between COR for ideal strike location and COR for 15 mm toeward varies from about 0.082 to about 0.067. As such, changing the parameters of the channel 2150 can vary the performance of both center and off-center strikes. As can be seen for all embodiments referenced in Table 10, COR at 15 mm toeward location never falls below 0.752 for all embodiments. In various embodiments, COR at 15 mm toeward is not less than 0.770. In various embodiments, COR at 15 mm toeward is not less than 0.775. In various embodiments, COR at 15 mm toeward is not less than 0.780.

Figure 23:
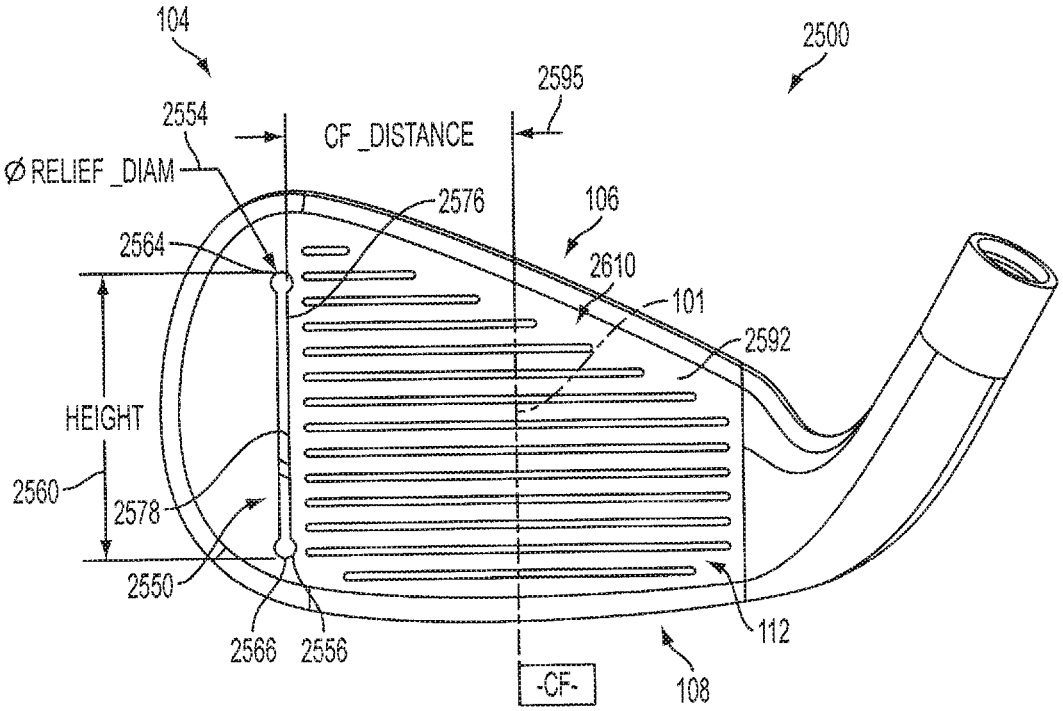
FIG. 23 is a front side view of a golf club head in accord with one embodiment of the current disclosure.

Another embodiment of a golf club head 2500 is seen with reference to FIG. 23. The golf club head 2500 includes a channel 2550 in the toe portion 104. The channel 2550 includes an overall height 2560 as measured along the full extent of the channel 2550. The channel 2550 includes an inner edge 2576 and an outer edge 2578. A distance to center face 2595 is measured from an ideal strike location 101 coinciding with a center line to the inner edge 2576. The channel 2550 includes an upper relief 2554 leading to a first end 2564 of the channel 2550 and a lower relief 2556 leading to a second end 2566 of the channel 2550. The ends 2564, 2566 define the extent of the channel 2550.

In the current embodiment, the channel 2550 is straight and does not deviate substantially from a vertical path that is about parallel to a center line of the golf club head and about perpendicular to the grooves 112. Although stress concentrations would normally be seen at the ends 2564 and 2566, the reliefs 2554, 2556 provide a portion of increased width of the channel 2550 in the form of a circular aperture that is larger in diameter than the width of the channel 2550. In various embodiments, each relief 2554, 2556 may be of a diameter equal to the width of the channel 2550, in which case the ends 2564, 2566 would simply rounded or filleted. However, in the current embodiment, each relief 2554, 2556 is noticeably rounded at a diameter larger than the width of the channel 2550. Such an arrangement allows for gradual reduction in the stress over the ends 2564, 2566 thereby reducing concentrations of stress at end points of the channel 2550.

Figure 24A:
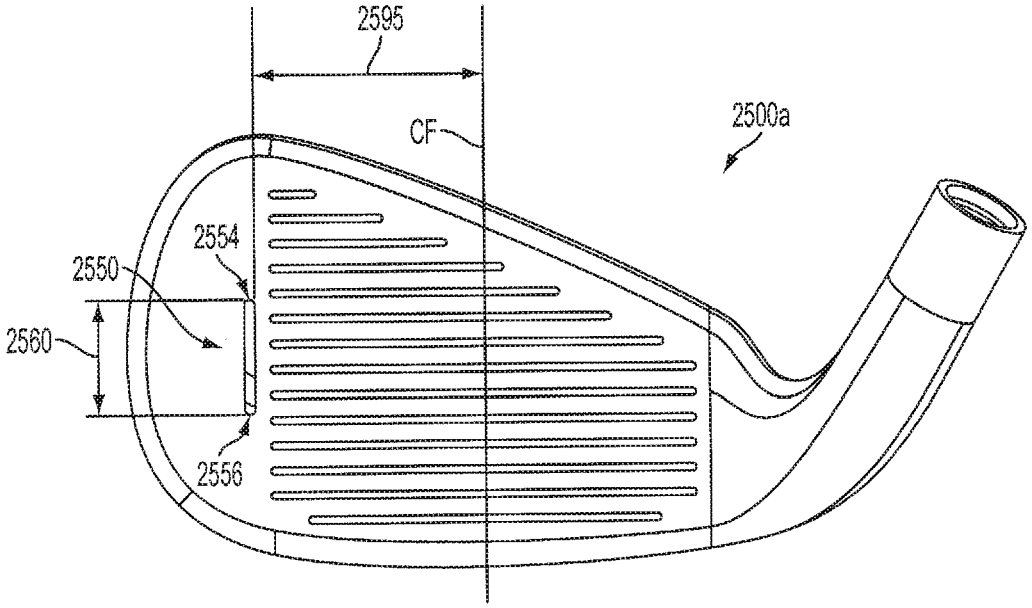
FIG. 24A is a front side view of one exemplary embodiment of the golf club head of FIG. 23.
Figure 24B:
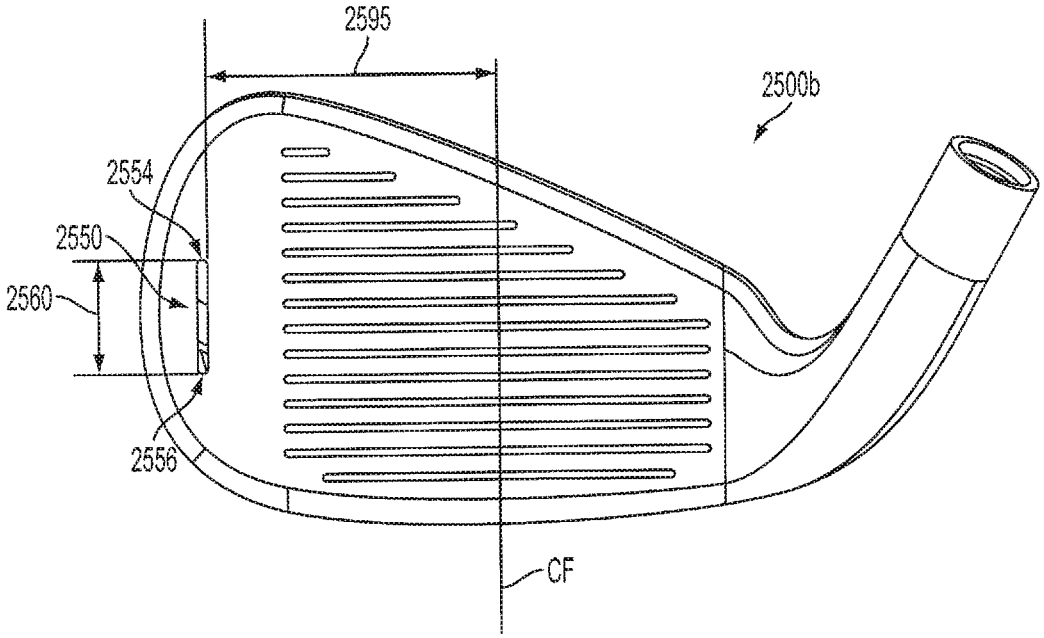
FIG. 24B is a front side view of one exemplary embodiment of the golf club head of FIG. 23.
Figure 24C:
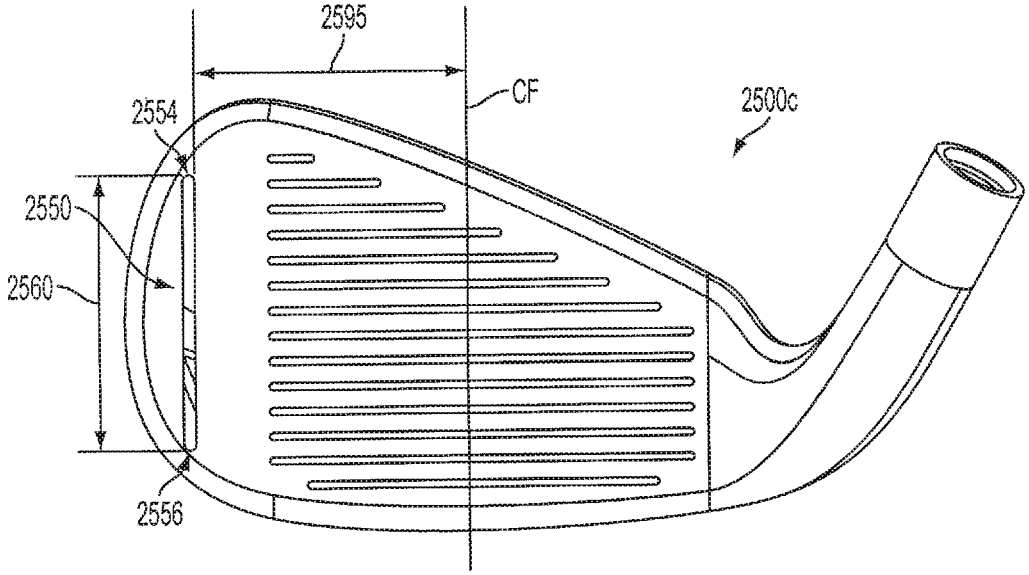
FIG. 24C is a front side view of one exemplary embodiment of the golf club head of FIG. 23.
Figure 24D:
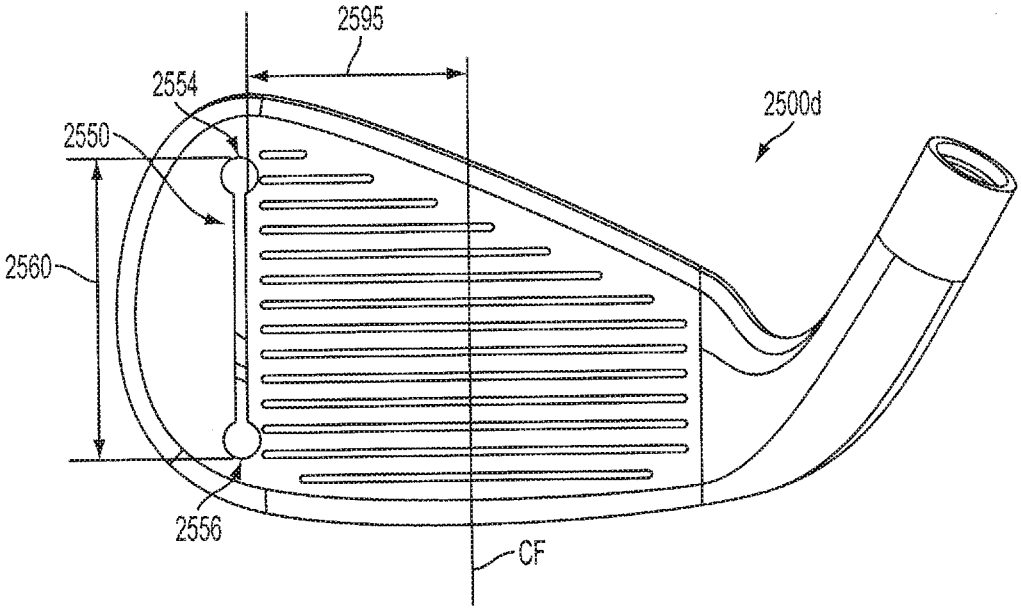
FIG. 24D is a front side view of one exemplary embodiment of the golf club head of FIG. 23.
Figure 24E:
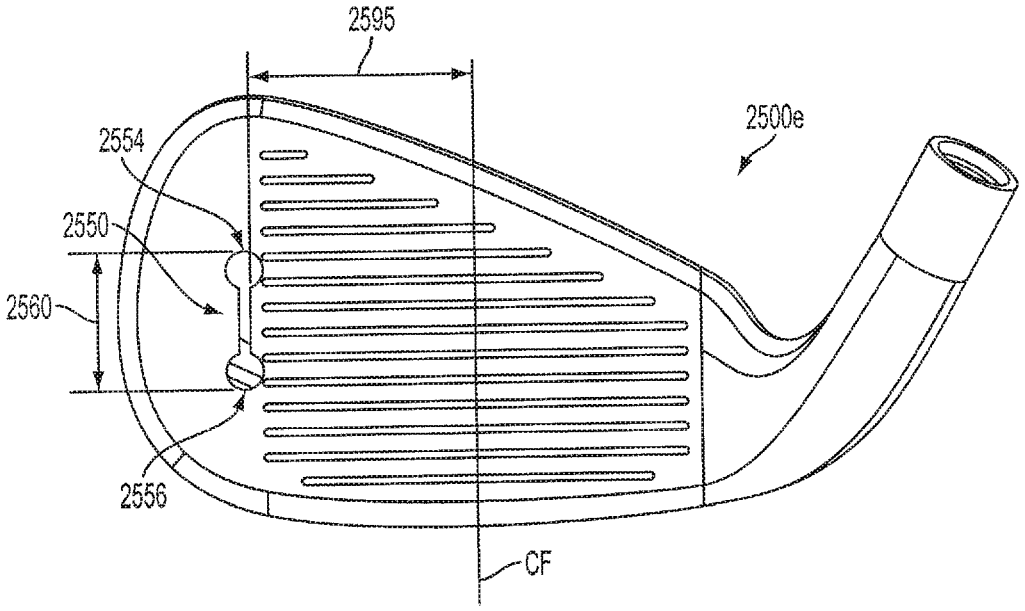
FIG. 24E is a front side view of one exemplary embodiment of the golf club head of FIG. 23.

As seen with reference to FIGS. 24A-24E, varying parameters of the channel 2550 can change the appearance and shape of the channel 2550 and can alter the performance characteristics of the channel 2550 in application. FIG. 24A displays a golf club head 2500*a* wherein the distance to center face 2595 is 30 mm, each relief 2554, 2556 is 2 mm in diameter, and the overall height 2560 is 15 mm. FIG. 24B displays a golf club head 2500*b* wherein the distance to center face 2595 is 38 mm, each relief 2554, 2556 is 2 mm in diameter, and the overall height 2560 is 15 mm. FIG. 24C displays a golf club head 2500*c* wherein the distance to center face 2595 is 38 mm, each relief 2554, 2556 is 2 mm in diameter, and the overall height 2560 is 38 mm. FIG. 24D displays a golf club head 2500*d* wherein the distance to center face 2595 is 30 mm, each relief 2554, 2556 is 5 mm in diameter, and the overall height 2560 is 38 mm. FIG. 24E displays a golf club head 2500*e* wherein the distance to center face 2595 is 30 mm, each relief 2554, 2556 is 5 mm in diameter, and the overall height 2560 is 15 mm. As such, the variance in design parameters can greatly alter the appearance and shape of the channel 2550. One of skill in the art would understand that the various parameters may be interchanged amongst the various embodiments and may vary to lengths and angles other than those specified in this disclosure. The embodiments disclosed should not be considered limiting, and parameters between those disclosed may be utilized in varying embodiments as well.

TABLE 11

| Overall Height Ref. No. 2560 | Distance to Center Face Ref. No. 2595 | Diameter of Relief Ref. Nos. 2554, 2556 | COR at Ideal Strike Loc | COR 15 mm Toeward | CORDif-ference |
|---|---|---|---|---|---|
| 38 mm | 30 mm | 5 mm | 0.828 | 0.758 | 0.070 |
| 38 mm | 30 mm | 2 mm | 0.828 | 0.757 | 0.071 |
| 38 mm | 38 mm | 5 mm | 0.830 | 0.754 | 0.076 |
| 15 mm | 38 mm | 5 mm | 0.831 | 0.752 | 0.080 |
| 15 mm | 30 mm | 5 mm | 0.831 | 0.751 | 0.079 |
| 15 mm | 38 mm | 2 mm | 0.831 | 0.751 | 0.080 |
| 38 mm | 38 mm | 2 mm | 0.830 | 0.753 | 0.077 |
| 15 mm | 30 mm | 2 mm | 0.831 | 0.751 | 0.080 |

Table 11 displays various performance results for the various changing design parameters. As can be seen with reference to Table 11, COR at the ideal strike location 101 varies from about 0.828 to about 0.831 Similarly, COR at a location 15 mm toeward from the ideal strike location 101 varies from about 0.751 to about 0.758. As measured, the difference between COR for ideal strike location and COR for 15 mm toeward varies from about 0.080 to about 0.070. As such, changing the parameters of the channel 2550 can vary the performance of both center and off-center strikes. As can be seen for all embodiments referenced in Table 11, COR at 15 mm toeward location never falls below 0.751 for all embodiments. In various embodiments, COR at 15 mm toeward is not less than 0.754. In various embodiments, COR at 15 mm toeward is not less than 0.757.

In various arrangements, the embodiments of golf club head 2000 and golf club head 2500 may be varied to alter performance characteristics, and one of skill in the art would understand that the embodiments disclosed herein are but examples of modifications. In various embodiments, features may be ported from one embodiment to another or may be combined with other features of the disclosure as described herein. The location, orientation, size, width, length, height, and arrangement of various features may be altered in various embodiments. For the sake of the disclosure, the relief ends 2554, 2556 and the end portions 2154, 2156 function as stress reliefs features. In the current embodiments, the FBS features are channels 2150, 2550 that extend from a striking surface 2192, 2592 of the golf club head 2000, 2500, respectively, through an entire thickness of the striking face 2110, 2610. However, in various embodiments, FBS features may be included that do not extend entirely through the striking face 2110, 2610. In various embodiments, FBS features may be included on a rear surface of the striking face 2110, 2610 to provide some performance benefits as discussed herein without having an aperture in the golf club head 2000, 2500. Examples of such designs may be seen elsewhere within this disclosure. In various embodiments, the FBS features of the current embodiments may be combined with those of the various embodiments to provide performance characteristics to address different types of off-center shots.

Figure 25A:
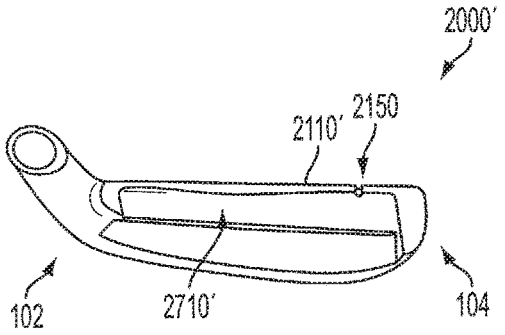
FIG. 25A is a cross-sectional view from the top a golf club head in accord with one embodiment of the current disclosure.
Figure 25B:
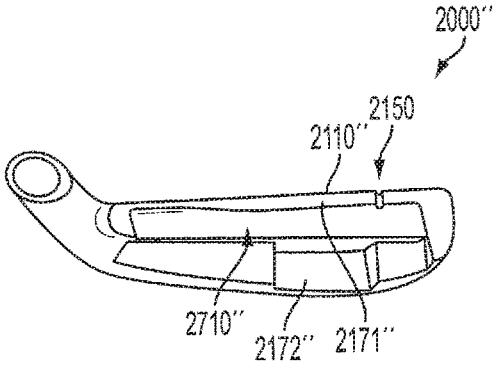
FIG. 25B is a cross-sectional view from the top a golf club head in accord with one embodiment of the current disclosure.

As seen with reference to FIG. 25A-25B, golf club heads of the current disclosure—including golf club heads 2000, 2500—may include variable thickness of the striking face 2110'. Variable thickness and the benefits associated therewith are described in more detail with reference to U.S. Pat. No. 8,353,786, entitled "GOLF CLUB HEAD," filed Dec. 28, 2007. As seen with reference to the cutaway view of FIG. 25A, a golf club head such as golf club head 2000' includes the features described for the golf club head 2000 and includes a variable face thickness (VFT) pattern 2710'. In the current embodiment, the VFT pattern 2710' is an inverted cone as described in U.S. Pat. No. 8,353,786, entitled "GOLF CLUB HEAD," filed Dec. 28, 2007. The VFT pattern 2170' is about symmetrical and about centered along the face 2110' of the golf club head such that portions of the face 2110' proximate the toe portion 104 are about the same thickness as portions proximate the heel portion 102. Although the VFT pattern 2710' can provide more consistent COR across the face of a golf club head that does not include a FBS feature, the golf club head 2000' includes channel 2150. In various embodiments, high dispersion may be seen from shots struck off-center for golf club heads that include an FBS feature such as golf club head 2000' because, in some embodiments, the portions of the striking face 2110' proximate the channel 2150 flex unpredictably. To combat dispersion, a VFT pattern 2170" includes a thickened toe portion 2171" that extends a thickened region outside of the center face and proximate the channel 2150. Such an arrangement allows for reduced dispersion because the toe portion 2171" is not as unpredictably flexible. In various embodiments, a mass notch 2172" may be defined in the golf club head 2000" to compensate by reducing mass of the golf club head 2000" in proportion to the mass that is increased due to increased face thickness. In the current embodiment, the notch 2172" is defined in a rear portion of the golf club head but may be defined in various elements of the golf club head 2000".

Figure 26A:
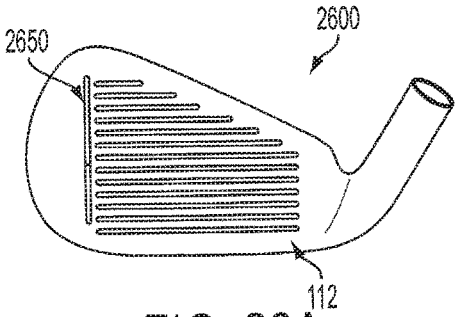
FIG. 26A is a front side view of a golf club head in accord with one embodiment of the current disclosure.
Figure 26B:
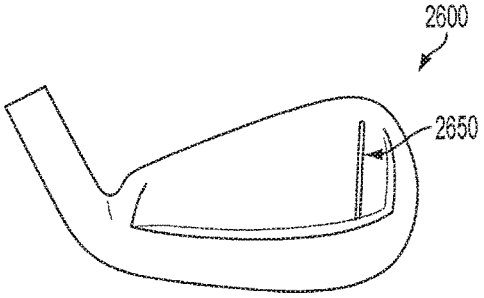
FIG. 26B is a back side view of the golf club head of FIG. 26A.

Additional embodiments are disclosed and referenced herein below. As shown with reference to FIGS. 26A-26B, a golf club head 2600 includes a channel 2650 that does not include various stress reduction features as described with reference to prior embodiments. In the current embodiment, the channel 2650 is a straight channel that is about parallel to the center line of the golf club head 2600 and about perpendicular to the grooves 112. In various embodiments, the length of the channel 2650 may vary but is about the same as the size of the grooves 112 in the direction of the channel 2650.

Figure 27A:
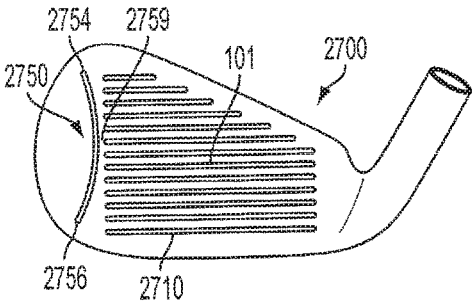
FIG. 27A is a front side view of a golf club head in accord with one embodiment of the current disclosure.

An embodiment of a golf club head 2700 is shown with reference to FIG. 27A. The golf club head 2700 includes a channel 2750. In the current embodiment, the channel 2750 is curvilinear in shape and has an about constant radius of curvature. In the current embodiment, the curvature is about 5 inches in radius, although various curvatures from 1 to 15 inches in radius may be used. In various embodiments, the curvature need not be of constant radius. In the current embodiment, end points 2754 and 2756 are disposed such that the end points 2754, 2756 are the farthest elements from the grooves 112 and the ideal strike location 101. In the current embodiment, a nearest point 2759 is a point of the channel 2750 that is nearest to the grooves 112 and the ideal strike location 101. In the current embodiment, the nearest point 2759 is above the ideal strike location 101 by a distance of 8 mm. The nearest point 2759 occurs at about the middle of the channel 2750. In various embodiments of the disclosure—including those that are not curvilinear—midpoints of the various channels may also be between 0 mm and 12 mm above the ideal strike location. In various embodiments, the nearest point 2759 may be aligned with the ideal strike location 101 or may be arranged below the ideal strike location 101. In various embodiments, the end points 2754, 2756 may be arranged such that they are not about equidistant from the grooves 112. In various embodiments, the channel 2750 may be shifted in space such that it is closer or further from the grooves 112 and/or arranged higher or lower on the face 2710.

Figure 27B:
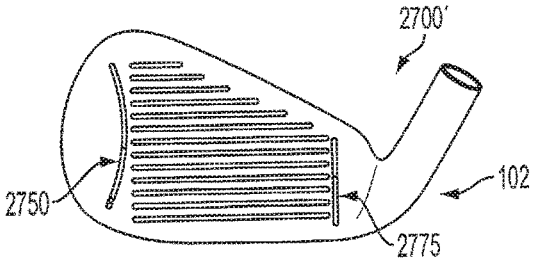
FIG. 27B is a front side view of a golf club head in accord with one embodiment of the current disclosure.

A golf club head 2700' disclosed with reference to FIG. 27B includes the channel 2750 of the golf club head 2700 but includes a second channel 2775 in accord with one embodiment of the current disclosure. In the current embodiment, the second channel 2775 is located proximate the heel portion 102 of the golf club head 2700'. The second channel 2775 is effective for providing some of the benefits discussed elsewhere herein with respect to various channels but for shots struck off-center toward the heel portion 102 of the golf club head 2700'. In the current embodiment, the second channel 2775 is a straight, linear channel similar to channel 2650, although of a different size. However, as would be understood by one of ordinary skill in the art, any shape channel as disclosed herein may be utilized in the location of the second channel 2775.

Figure 28A:
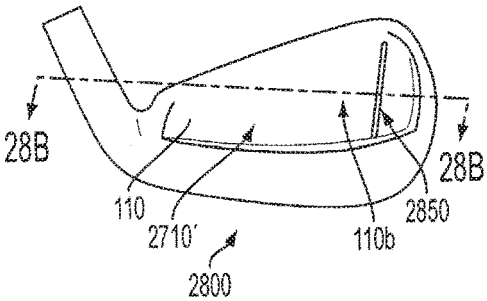
FIG. 28A is a back side view of a golf club head in accord with one embodiment of the current disclosure.
Figure 28B:
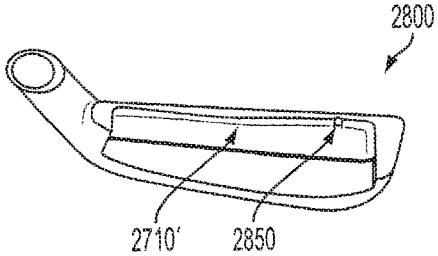
FIG. 28B is a cross-sectional view of the golf club head of FIG. 28A taken in the plane indicated by line 28B-28B.

A golf club head 2800 is seen with reference to FIGS. 28A-28B. The golf club head 2800 includes an FBS feature that is a score line 2850 defined in a rear surface 110*b* of the face 110. The score line 2850 is defined a location of the golf club head 2800 and in an arrangement similar to the location and arrangement of the channel 2650 on the golf club head 2600. The VFT pattern 2710' can be seen in the arrangement of the current embodiment, although various VFT patterns may be utilized with the current embodiment, including VFT pattern 2710", among others.

Figure 29A:
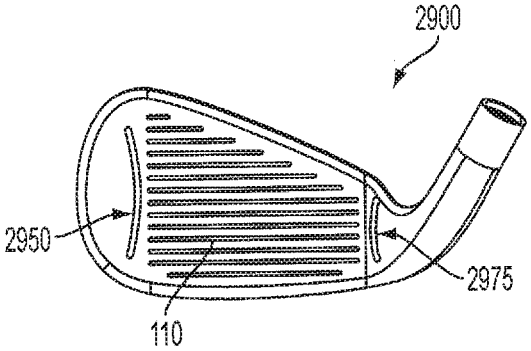
FIG. 29A is a front side view of a golf club head in accord with one embodiment of the current disclosure.
Figure 29B:
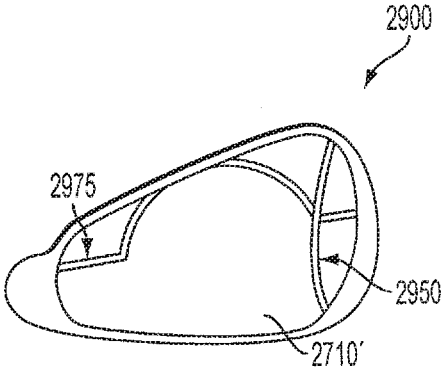
FIG. 29B is a back side view of the golf club head of FIG. 29A.
Figure 29C:
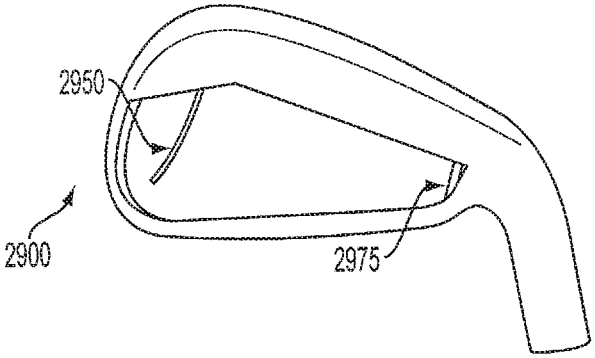
FIG. 29C is an alternate back side view of the golf club head of FIG. 29A.

A golf club head 2900 is seen with reference to FIGS. 29A-29C. The golf club head 2900 includes a channel 2950 and a second channel 2975. In the current embodiment, the channel 2950 is curved similarly to channel 2750 but with a different radius of 8 in. The second channel 2975 of the current embodiment is also curved with a radius of XX in. As can be seen, the VFT pattern 2710' is included with the golf club head 2900. As with some previously described embodiments, the channel 2950 and second channel 2975 extend through an entire thickness of the face 110.

Multiple Flexible Boundary Features

Figure 30A:
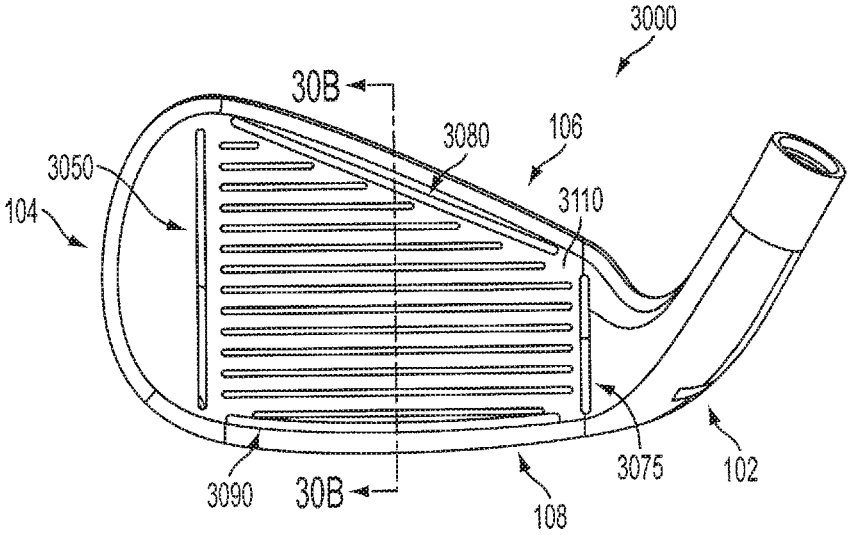
FIG. 30A is a front side view of a golf club head in accord with one embodiment of the current disclosure.
Figure 30B:
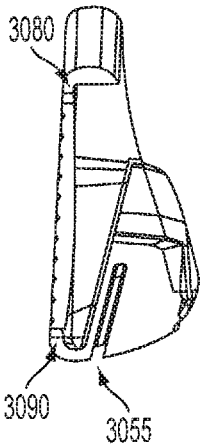
FIG. 30B is a cross-sectional view of the golf club head of FIG. 30A taken in the plane indicated by line 30B-30B.
Figure 30C:
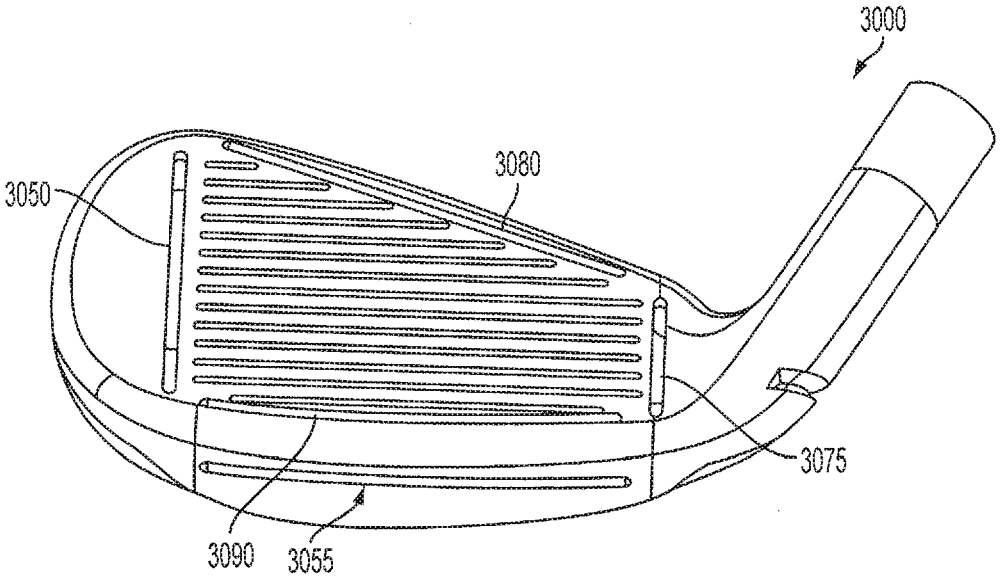
FIG. 30C is a perspective view of the golf club head of FIG. 30A.

A golf club head 3000 is seen with reference to FIGS. 30A-30C including multiple FBS features of the current disclosure. The golf club head 3000 includes a first channel 3050 or "toe side channel" proximate the toe portion 104, a second channel 3075 or "heel side channel" proximate the heel portion 102, a third channel 3080 or "top line channel" proximate the top line portion 106, and a fourth channel 3090 or "sole side channel" proximate the sole portion 108. All of the first channel 3050, second channel 3075, third channel 3080, and fourth channel 3090 are defined through a striking face 3110 of the golf club head 3000, thereby providing FBS features along each end of the striking face 3110. As can be seen with specific reference to FIG. 30B, a FBS feature is also defined in the sole portion 108 of the golf club head 3000 and includes a sole channel 3055 that is defined similarly to other channels of the current disclosure, for example, channel 150. In the current embodiment, each of the first channel 3050, the second channel 3075, the third channel 3080, and the fourth channel 3090 are linear channels similar to channel 2650 (seen in FIGS. 26A-26B).

Figure 31A:
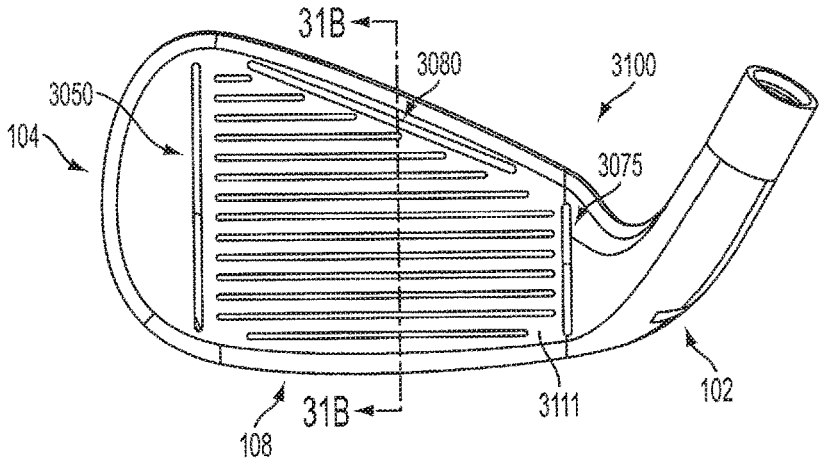
FIG. 31A is a front side view of a golf club head in accord with one embodiment of the current disclosure.
Figure 31B:
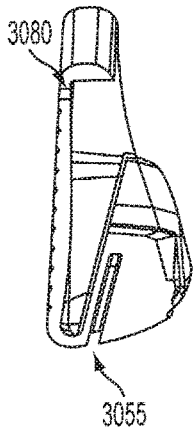
FIG. 31B is a cross-sectional view of the golf club head of FIG. 31A taken in the plane indicated by line 31B-31B.
Figure 31C:
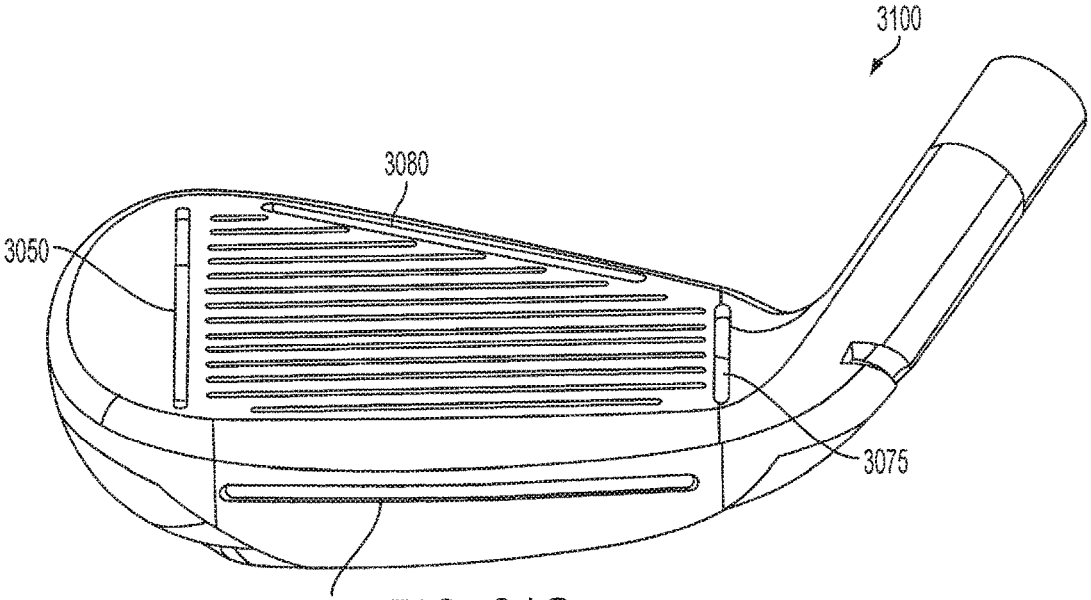
FIG. 31C is a perspective view of the golf club head of FIG. 31A.

An embodiment of a golf club head 3100 is seen with reference to FIGS. 31A-31C. The golf club head 3100 includes the features of golf club head 3000 but omits the fourth channel 3090 (seen in FIGS. 30A-30B), including the remaining features of golf club head 3000. As can be seen, the first channel 3050, the second channel 3075, and the third channel 3080 are defined through a striking face 3111, and the sole channel 3055 is defined in the sole portion 108.

Figure 32A:
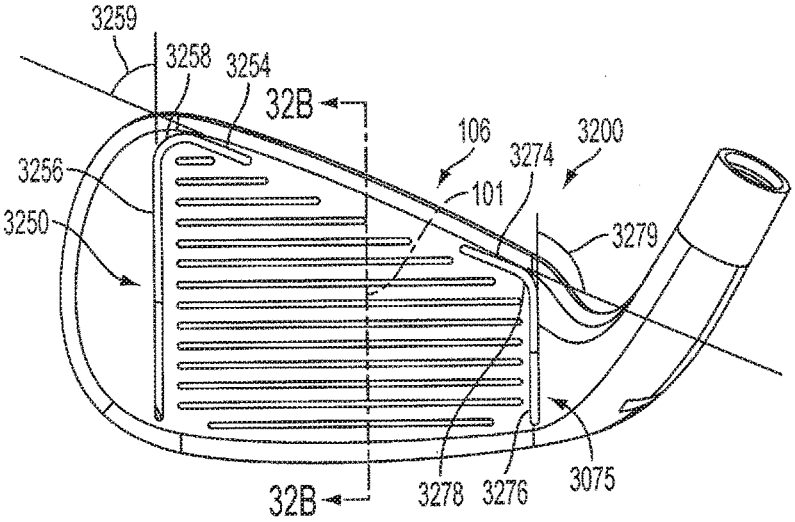
FIG. 32A is a front side view of a golf club head in accord with one embodiment of the current disclosure.
Figure 32B:
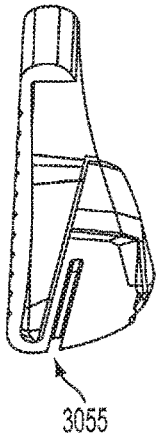
FIG. 32B is a cross-sectional view of the golf club head of FIG. 32A taken in the plane indicated by line 32B-32B.
Figure 32C:
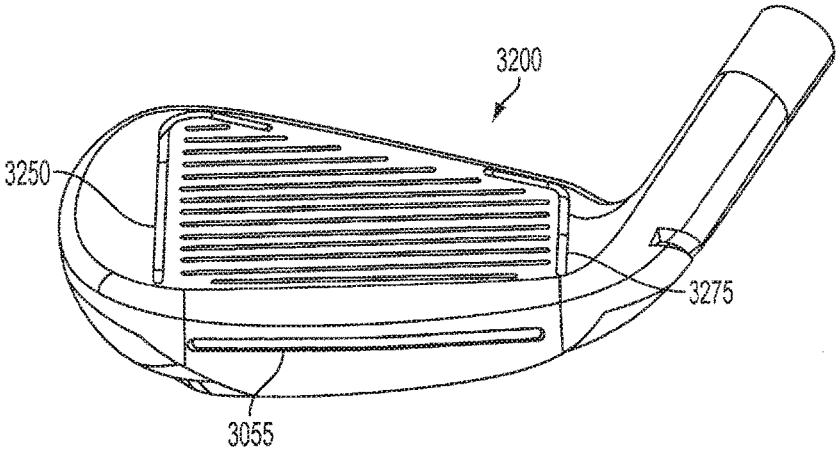
FIG. 32C is a perspective view of the golf club head of FIG. 32A.

An embodiment of a golf club head 3200 is seen with reference to FIGS. 32A-32C. The golf club head 3200 includes a first channel 3250 and a second channel 3275. In the current embodiment, each of the first channel 3250 and the second channel 3275 includes at least one portion proximate the top line 106 and one portion distal to the top line 106.

In the current embodiment, the first channel 3250 includes a first portion 3254 proximate the top line 106 and a second portion 3256 proximate the toe portion 104. The first portion 3254 and the second portion 3256 are adjoined by a radius 3258. In the current embodiment, the radius 3258 is between about 4-12 mm. The radius 3258 aids in preventing stress concentrations in the channel 3254. In general, a large radius 3258 prevents stress concentrations more effectively than a small radius 3258. However, in various embodiments, material considerations may obviate the need for a particularly large radius. In the current embodiment, the first portion 3254 generally follows the top line 106 and the second portion 3256 is generally parallel to the center line (as defined previously as a line coincident with the ideal striking location 101). As such, the first portion 3254 is arranged with respect to the second portion 3256 at an angle 3259. In the current embodiment, the angle 3259 may be between about 75° and 45°, and the angle 3259 is acute, although various embodiments may include various angles. However, in various embodiments, the angle 3259 may be of varying degrees and may be obtuse or square in various embodiments.

Similarly, the second channel 3275 includes a first portion 3274 and a second portion 3276. The first portion 3274 and the second portion 3276 are adjoined by a radius 3278. In the current embodiment, the radius 3278 is between about 4-12 mm. In general, features of the radius 3278 are similar to those previously discussed with respect to radius 3258. The first portion 3274 generally follows the top line 106 and the second portion 3276 is generally parallel to the center line (as defined previously as a line coincident with the ideal striking location 101). As such, the first portion 3274 is arranged with respect to the second portion 3276 at an angle 3279. In the current embodiment, the angle 3279 is about 180° minus the angle 3259, and the angle 3279 is obtuse. As such, the angle 3279 may be between about 135° and 105°, although various embodiments may include various angles. However, in various embodiments, the angle 3279 may be of varying degrees and may be acute or square in various embodiments. In various embodiments, neither the first portion 3254 nor the first portion 3274 need follow the top line 106, although such an arrangement may provide ideal performance in various embodiments.

Figure 33A:
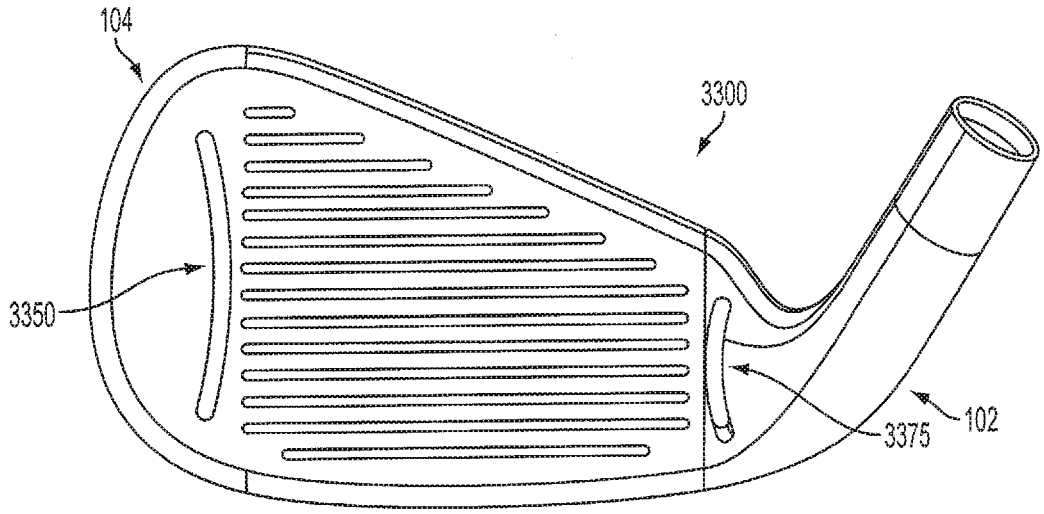
FIG. 33A is a front side view of a golf club head in accord with one embodiment of the current disclosure.
Figure 33B:
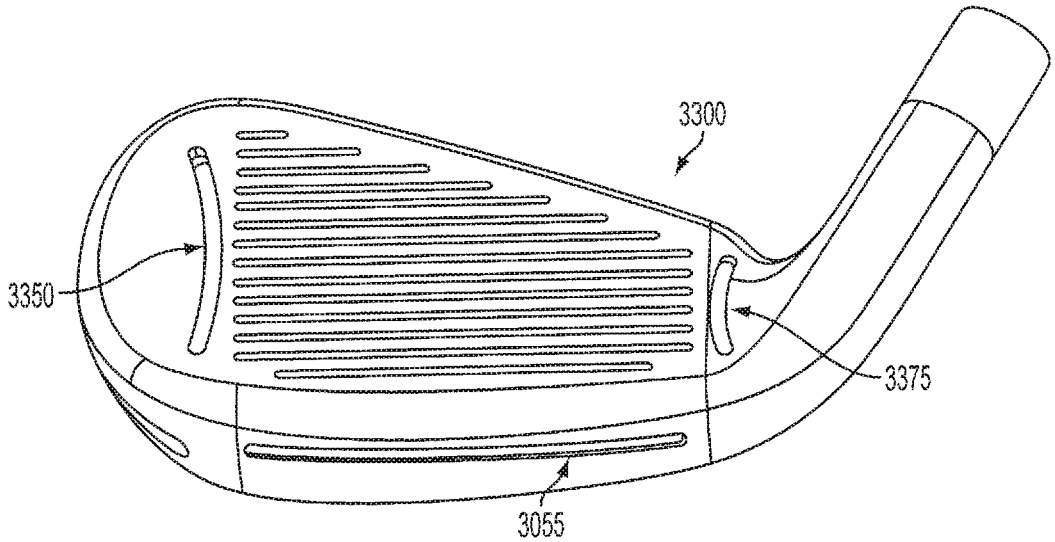
FIG. 33B is a perspective view of the golf club head of FIG. 33A.

Another embodiment of a golf club head 3300 is seen with reference to FIGS. 33A-33B. The golf club head 3300 includes a first channel 3350 proximate the toe portion 104 a second channel 3375 proximate the heel portion 102. In the current embodiment, each channel 3350, 3375 is curvilinear similar to channel 2750. In the current embodiment, the radii of curvature of both channels 3350, 3375 is about the same, although in various embodiments the radii may be different and may be nonconstant. In the current embodiment, the second channel 3375 is smaller than the first channel 3350 because its location proximate the heel portion 102 provides a physical limit to the size of the second channel 3375. However, in various embodiments the channels 3350, 3375 may be about the same size.

Figure 34A:
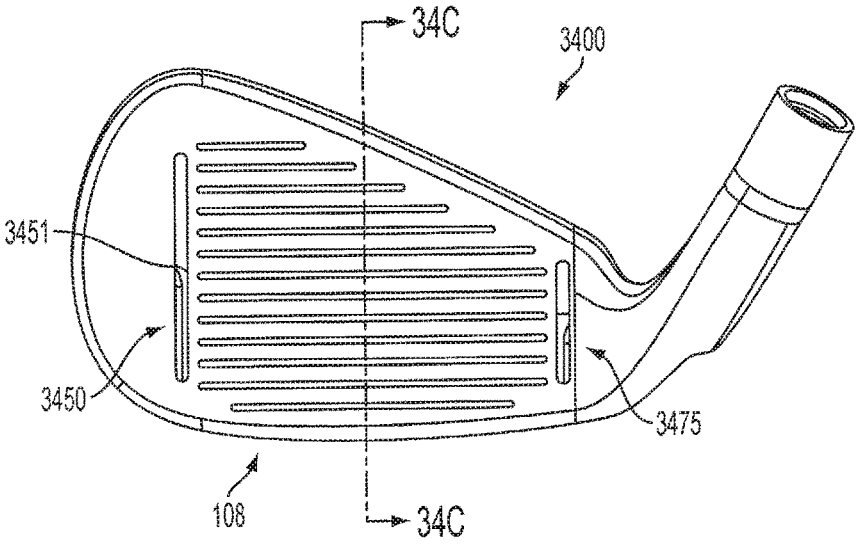
FIG. 34A is a front side view of a golf club head in accord with one embodiment of the current disclosure.
Figure 34C:
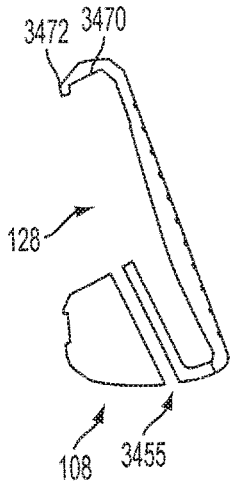
FIG. 34C is a cross-sectional view of the golf club head of FIG. 34A taken in the plane indicated by line 34C-34C.
Figure 34B:
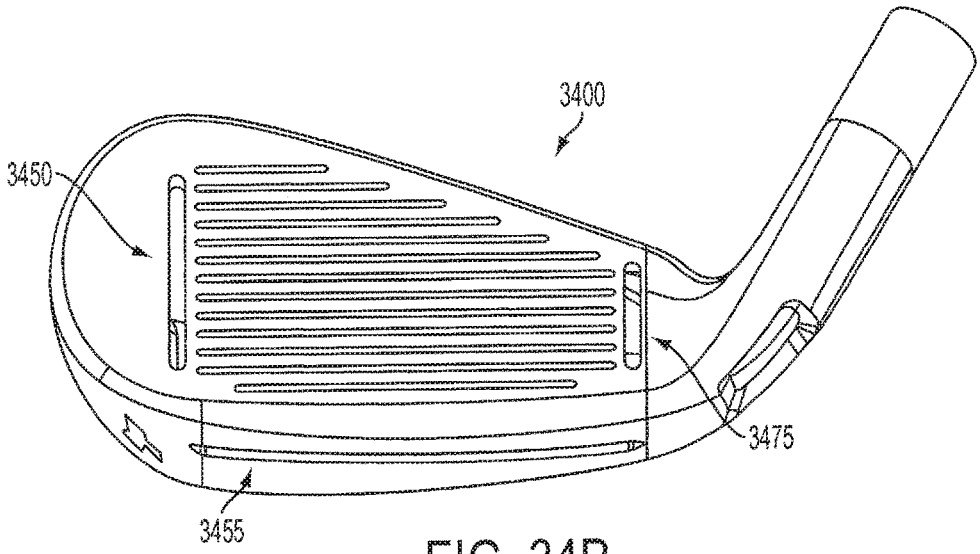
FIG. 34B is a perspective view of the golf club head of FIG. 34A.

Another embodiment of a golf club head 3400 is seen with reference to FIGS. 34A-34C. The golf club head 3400 includes a first channel 3450 and a second channel 3475. The first channel 3450 and second channel 3475 are similar to first channel 3050 and second channel 3075 as seen in FIG. 30A, but with altered dimensions. For example, the channel 3450 is smaller in overall length and is placed such that a point 3451 located the center of the channel 3450 is located more proximate the sole portion 108 than would be seen with the first channel 3050.

Returning to the current embodiment, the golf club head 3400 includes a sole channel 3455 that extends through the sole portion 108 such that the sole channel 3455 substantially connects from a sole portion 108 to a back portion 128 of the golf club head 3400. In the current embodiment, the back portion 128 includes an undercut recess 3470 defined by a back portion lip 3472 that extends around the entirety of the back portion 128 thereby defining an undercut channel around a periphery of the golf club head in the cavity portion. By arranging the undercut channel such that it is continuous around the entirety of the golf club head 3400, the golf club head 3400 can provide reduced mass in varying arrangements to located the center of gravity precisely in the golf club head 3400 without increasing weight. Additionally, the undercut channel may provide increased COR in varying embodiments, may provide more consistent COR in varying embodiments, and may provide higher moment of inertia in varying embodiments, all of which enhance performance of the golf club head 3400.

Isolated Face

Another embodiment of the current disclosure is seen with reference to FIGS. 35A-35D. A golf club head 3500 includes a plurality of channels 3550 disposed around a perimeter of a striking face 3510 of the golf club head 3500. The plurality of channels 3550 are arranged to substantially isolate the striking face 3510 from a main body 3513. In the current embodiment, the plurality of channels 3550 functions as a FBS feature to allow the golf club head 3500 the advantages described from FBS features described elsewhere in this disclosure for strikes along a wider range of the striking face 3510.

In the current embodiment, the plurality of channels 3550 are arranged such that a first row of channels 3552 is disposed proximate the striking face 3510 and a second row of channels 3554 is disposed proximate the main body 3513. In the current embodiment, the individual channels within each row of channels 3552, 3554 are separated from other individual channels by a plurality of stanchion 3555 disposed at periodic intervals throughout the row of channels 3552, 3554. The plurality stanchions 3555 provide mechanical attachment between the striking face 3510 and the main body 3513 while providing ample FBS features around a perimeter of the golf club head 3500. In the current embodiment, the first row of channels 3552 is about parallel to the second row of channels 3554, although in various embodiments the arrangement of the rows of channels 3552, 3554 may be rearranged or in different orientations. In various embodiments, the size, location, and number of the various individual channels and stanchions within the plurality of channels 3550 may be altered as would be understood by one of ordinary skill in the art. In the current embodiment, the plurality of channels 3550 extends around a periphery of the golf club head 3500 proximate the top line portion 106, the sole portion 108, and the toe portion 104. In those regions, the plurality of channels 3550 does not extend through the striking face 3510, although one of skill in the art would understand that such an arrangement may be modified in various embodiments. In the current embodiment, the plurality of channels 3550 extends through the striking face proximate the heel portion 102. In the current embodiment, the plurality of channels 3550 extend from the top line portion 106 and the sole portion 108 into the striking face 3510, effectively providing a "wrap" effect wherein at least one individual channel extends across multiple portions of the golf club head 3500.

Figure 35A:
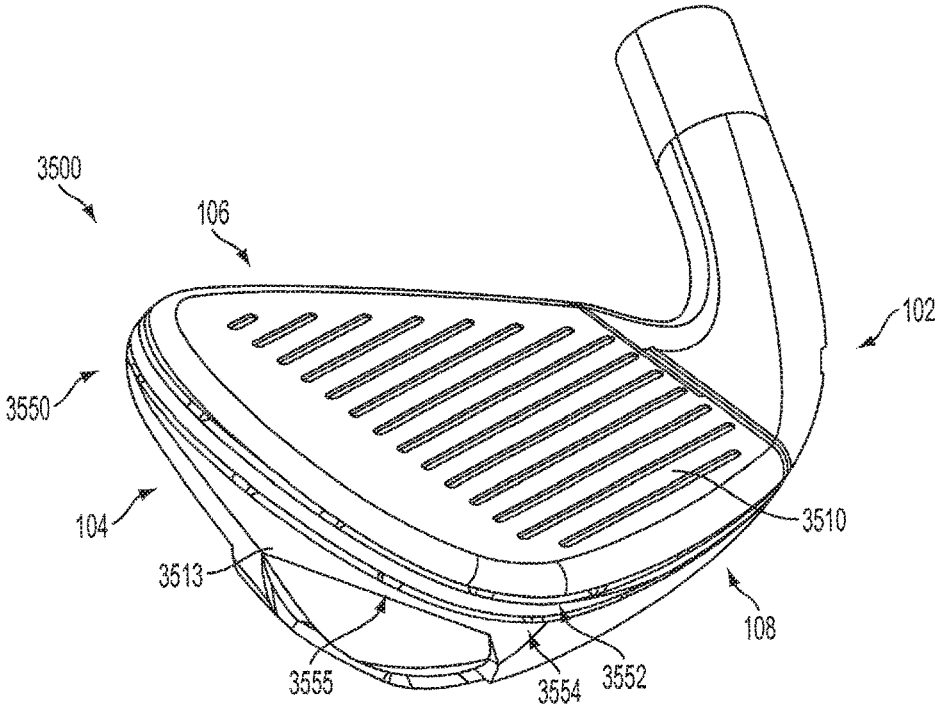
FIG. 35A is a perspective view of a golf club head in accord with one embodiment of the current disclosure.
Figure 35B:
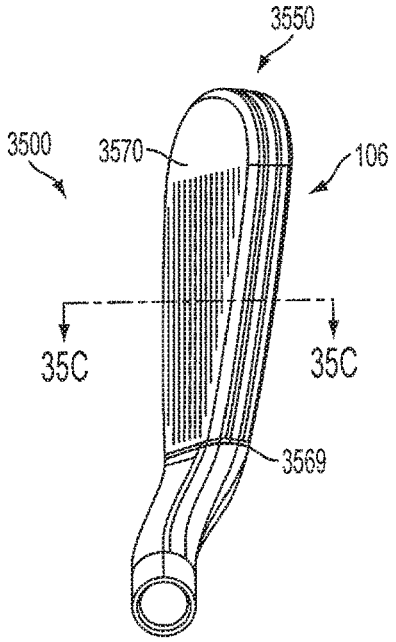
FIG. 35B is a top view of the golf club head of FIG. 35A.
Figure 35C:
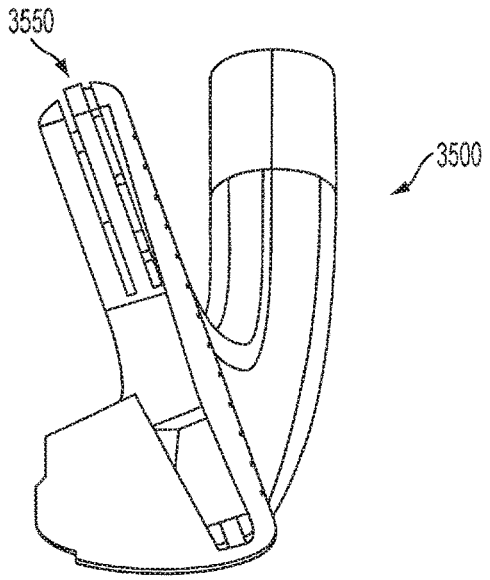
FIG. 35C is a cross-sectional view of the golf club head of FIG. 35A taken in the plane indicated by line 35C-35C in FIG. 35B.
Figure 35D:
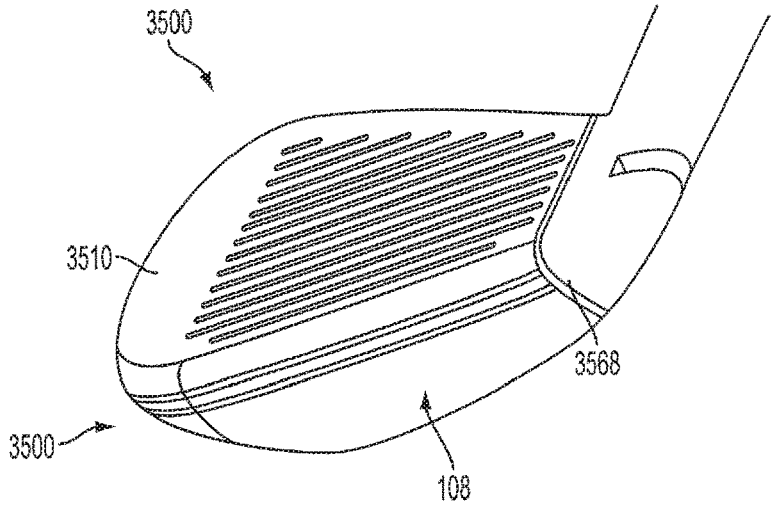
FIG. 35D is a perspective view of the golf club head of FIG. 35A.

As seen with specific reference to FIG. 35D, a sole side wrap point 3568 indicates the location where the plurality of channels 3550 transitions from the perimeter of the golf club head 3500 along the main body 3513 to the striking face 3510. As seem with reference to FIG. 35B, a top line wrap point 3569 indicates the point on the top line portion 106 analogous to the sole side wrap point 3568. As such, the golf club head 3500 includes a FBS feature encapsulating the striking face 3510, providing a flexible boundary along all portions of the striking face 3510. In various embodiments, the location of the FBS feature on the golf club head 3500 may vary. For example, in various embodiments, the plurality of channels 3550 may extend only along the perimeter of the golf club head 3500. In various embodiments, the FBS may be a structure similar to the plurality of channels 3500 but without the same arrangement. For example, in the current embodiment, the stanchions 3555 alternate in location between the first row of channels 3552 and the second row of channels 3554. In various embodiments, the stanchions 3555 may be aligned or may be nonanalogous between the various individual channels. In various embodiments, the golf club head 3500 may include an undercut portion similar to those discussed elsewhere in the current disclosure.

Channel Wrap

Figure 36B:
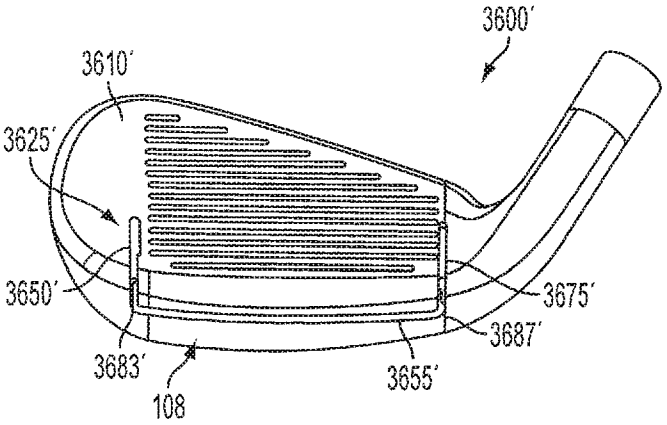
FIG. 36B is a perspective view of a golf club head in accord with one embodiment of the current disclosure.
Figure 36A:
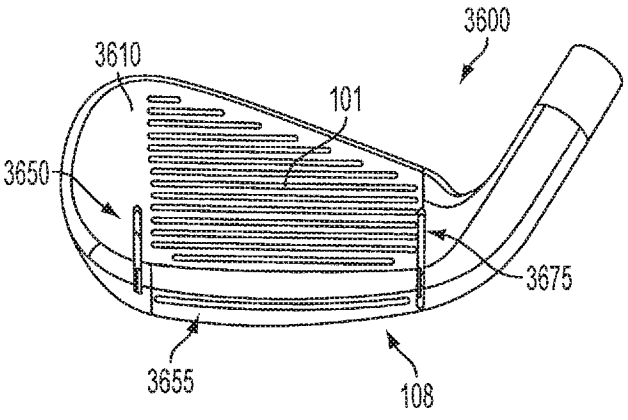
FIG. 36A is a perspective view of a golf club head in accord with one embodiment of the current disclosure.

Embodiments of golf club heads 3600 and 3600' are seen with reference to FIGS. 36A-36B. With specific reference to FIG. 36A, golf club head 3600 includes a FBS feature that includes a first channel 3650, a second channel 3675, and a sole channel 3655 or third channel. In the current embodiment, each of the first channel 3650 and the second channel 3675 is a linear channel that does not extend above the ideal strike location 101. However, each of the first channel 3650 and the second channel 3675 extends from a striking face 3610 into the sole portion 108 of the golf club head. In the current embodiment, each of the first channel 3650, the second channel 3675, and the sole channel 3655 are defined separately in the golf club head 3600. Golf club head 3600'—shown in FIG. 36B—provides an example of a modification as described with reference to the various embodiments of the current disclosure. The golf club head 3600' includes a FBS feature that is a single channel 3625' that includes a first portion 3650', a second portion 3675', and a sole portion 3655' or third portion that arranged similarly to the various channels of the golf club head 3600.

The golf club head 3600' provides an exemplary embodiment of a single channel wrapping from a striking face 3610' to the sole portion 108. The golf club head 3600' also provides an exemplary embodiment of a modification that would be understood by one of skill in the art. Similar modifications are referenced elsewhere in the current disclosure as modifications of the several embodiments described herein. As discussed with reference to previous embodiments, a first wrap point 3683' and a second wrap point 3687' define the portions of the channel 3625' that transition from the sole portion 108 to the striking face 3610'.

Figure 37B:
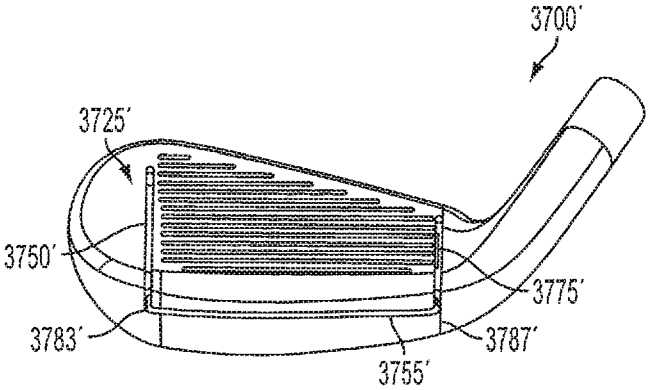
FIG. 37B is a perspective view of a golf club head in accord with one embodiment of the current disclosure.
Figure 37A:
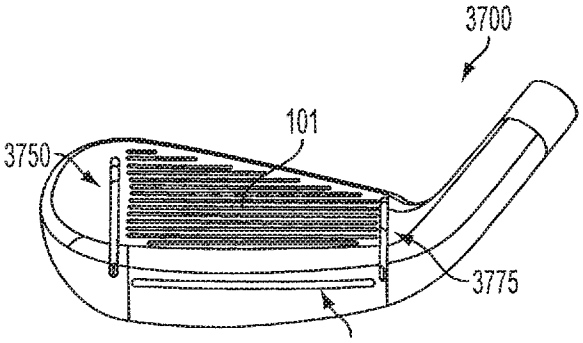
FIG. 37A is a perspective view of a golf club head in accord with one embodiment of the current disclosure.

Similarly, embodiments of golf club heads 3700 and 3700' are seen with reference to FIGS. 37A-37B. Golf club head 3700 includes a configuration similar to golf club head 3600 with the exception being that a first channel 3750 and a second channel 3775 extend above the ideal strike location 101. A sole channel 3755 or third channel is substantially the same as sole channel 3655. In analog, golf club head 3700' includes a single channel 3725' with a first portion 3750', a second portion 3775', and a sole portion 3755' or third portion. The channel 3725' includes a first wrap point 3783' and a second wrap point 3787'.

Figure 38:
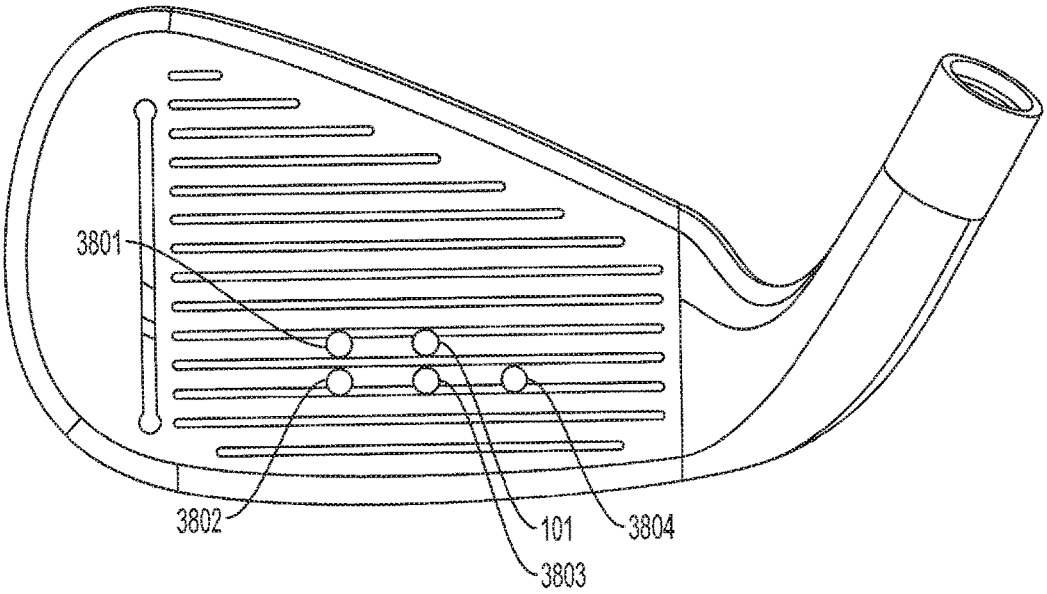
FIG. 38 is a front side view of various embodiments of golf club heads of the current disclosure indicating various strike locations.

FIG. 38 shows a face map for a golf club head such as those described herein. The face map shows the ideal strike location 101 along with other strike locations for testing, the strike locations being measured as related to the ideal strike location 101. Point 3801 is located 10 mm toward of the ideal strike location 101, which is coincident with a balance point of the golf club head. Point 3802 is located 5 mm below point 3801 as measured along a dimension parallel to the face plane. Point 3802 is, therefore, located 10 mm toeward and 5 mm below the ideal strike location 101. Point 3803 is located 5 mm below the ideal strike location and along the center line of the golf club head. Point 3804 is located 5 mm below the ideal strike location and 10 mm heelward.

Golf club heads described in the current disclosure were tested with strikes at the various points 101 and 3801-3804. The results are shown with reference to Table 12.

TABLE 12

| | COR CHART Point Location: | | | | |
|---|---|---|---|---|---|
| Golf Club Head: | Ref. No. 101 | Ref. No. 3801 | Ref. No. 3802 | Ref. No. 3803 | Ref. No. 3804 |
| Ref. No. 3400 | 0.828 | 0.793 | 0.747 | 0.784 | 0.757 |
| Ref. No. 3700' | 0.810 | 0.766 | 0.720 | 0.773 | 0.747 |
| Ref. No. 3700 | 0.824 | 0.792 | 0.748 | 0.781 | 0.754 |
| Ref. No. 3600' | 0.826 | 0.791 | 0.751 | 0.786 | 0.756 |
| Ref. No. 3600 | 0.829 | 0.792 | 0.747 | 0.785 | 0.756 |

As shown in Table 12, the various embodiments of the golf club heads 3400, 3600, 3600', 3700, 3700' show different COR responses for ideal and off-center strike locations 101, 3801, 3802, 3803, 3804. For example, golf club head 3700' at point 3801 was tested to have a COR of 0.766. As can be seen, the COR at the ideal strike location 101 for at least two embodiments does not fall below 0.828. For a plurality of embodiments, COR at the ideal strike location 1010 does not fall below 0.82. For all embodiments, COR at the ideal strike location 101 does not fall below 0.81. For strikes at point 3801, COR does not fall below 0.79 for a plurality of embodiments. For all embodiments, COR at point 3801 does not fall below 0.76. For strikes at point 3802, for at least one embodiment (golf club head 3600') COR does not fall below 0.75. For a plurality of embodiments, COR at point 3802 does not fall below 0.745 or 0.74. For all embodiments, COR at point 3802 does not fall below 0.72. For at least two embodiments, COR at point 3803 does not fall below 0.785. For a plurality of embodiments, COR at point 3803 does not fall below 0.78. For all embodiments, COR at point 3803 does not fall below 0.77. For at least three embodiments, COR at point 3804 does not fall below 0.755. For a plurality of embodiments, COR at point 3804 does not fall below 0.75. For all embodiments, COR at point 3804 does not fall below 0.745.

Data Validation

For comparison of various features, production model golf club heads were compared by machining various FBS features into the golf club heads. A baseline head model was used, and FBS features were machined in various locations about the various golf club heads with COR testing before and after. The embodiments are shown and the results plotted among FIGS. 39A-41B for the various embodiments. For the various plots shown, COR is measured verses heelward strike location, with 0.0 being a strike at the ideal strike location 101, heelward being indicated with positive horizontal axis values, toeward being indicated with negative horizontal axis values, and COR drop indicated along the vertical axis. The various embodiments were tested at ideal strike location 101, 5 mm heelward, 5 mm toeward, and 10 mm toeward.

Figure 39A:
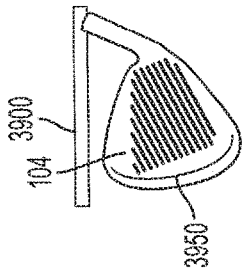
FIG. 39A is a perspective view of an experimental golf club head in accord with one embodiment of the current disclosure.
Figure 39B:
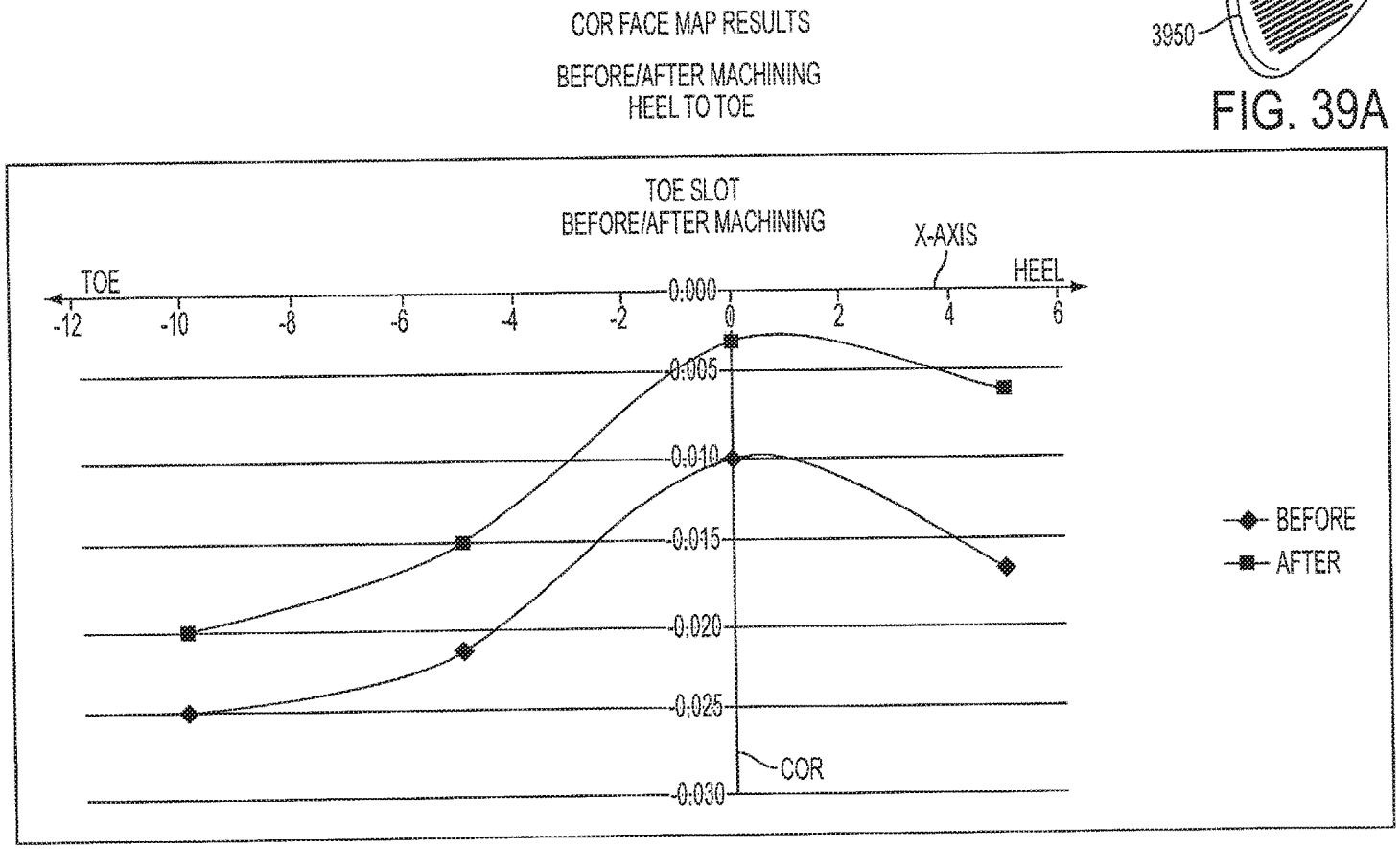
FIG. 39B is a graph indicating COR of strikes at various locations of the golf club head of FIG. 39A.

As can be seen with reference to FIGS. 39A-39B, a golf club head 3900 includes a channel 3950 machined into the toe portion 104. The COR difference becomes less dramatic as the strike location approaches the FBS (machined into the toe portion 104). As such, the most substantial COR difference occurs at a heelwardmost strike (about 0.011) and the least substantial COR difference occurs at a toewardmost strike (about 0.005). COR gain at center face strike was about 0.007. COR gain at 5 mm heelward was about 0.010. COR gain at 5 mm toeward was about 0.007. COR gain at 10 mm toeward was about 0.005.

Figure 40A:
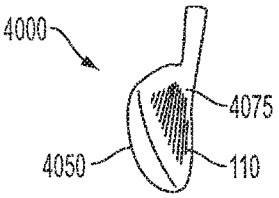
FIG. 40A is a perspective view of an experimental golf club head in accord with one embodiment of the current disclosure.
Figure 40B:
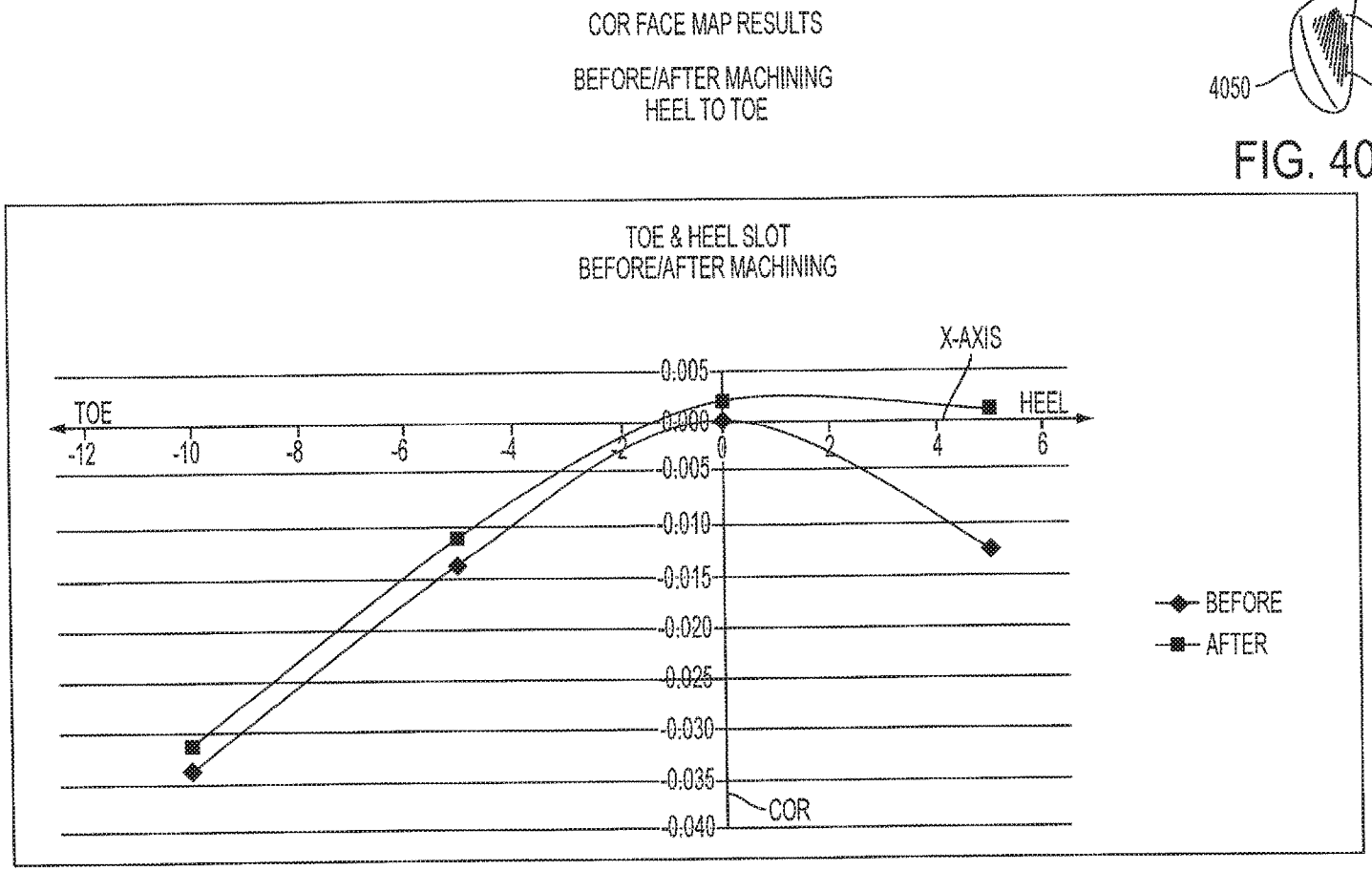
FIG. 40B is a graph indicating COR of strikes at various locations of the golf club head of FIG. 40B.

With reference to FIGS. 40A-40B, a golf club head 4000 includes a first channel 4050 machined into the toe portion 104 similar to the channel 3950 of golf club head 3900. Additionally, the golf club head 4000 includes a second channel 4075 machined into a heel portion 102 of the golf club head on the striking face 110. As can be seen, COR performance for most locations was about the same, although some performance gains were seen with heelward strike COR having about the same COR as center strike COR. COR gain at center face strike was about 0.002. COR gain at 5 mm heelward was about 0.012. COR gains at 5 mm and 10 mm toeward were each about 0.002.

Figure 41A:
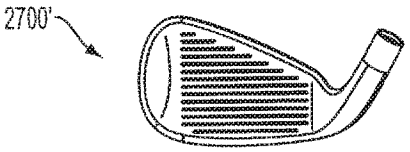
FIG. 41A is a perspective view of an experimental golf club head in accord with one embodiment of the current disclosure.
Figure 41B:
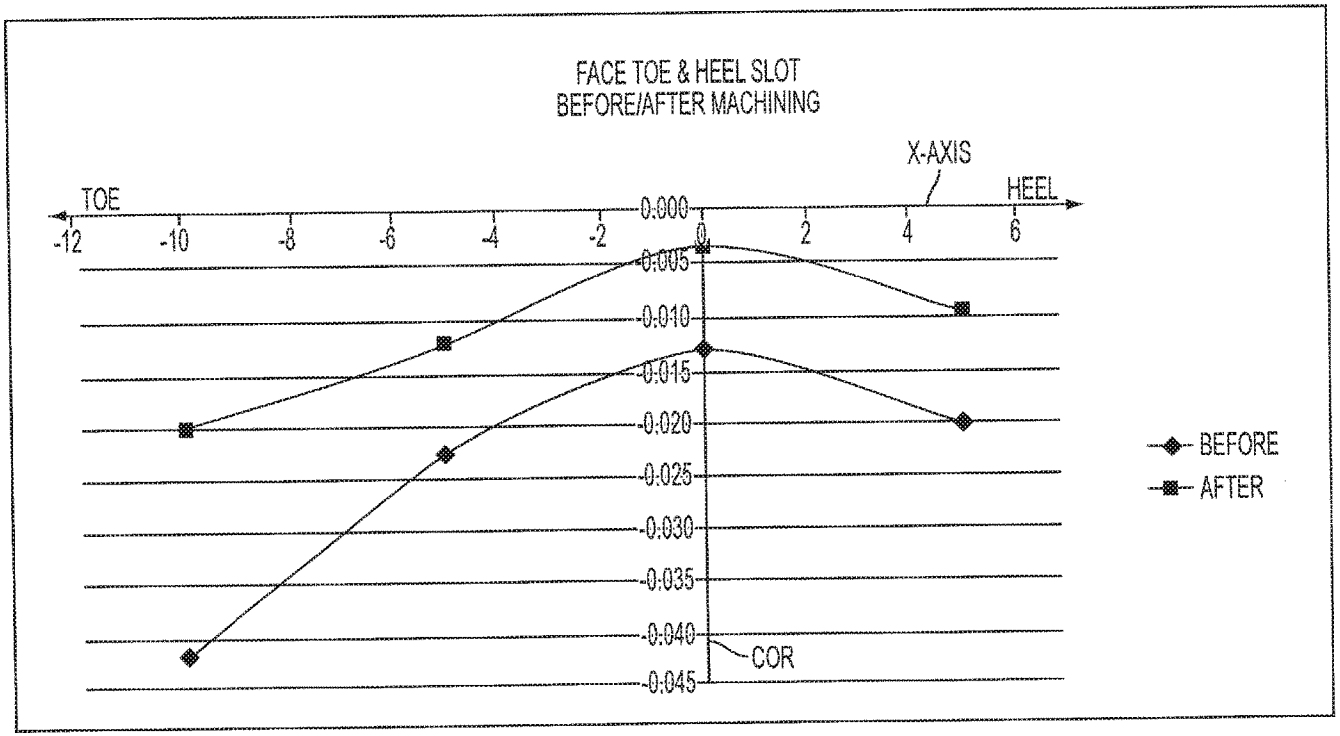
FIG. 41B is a graph indicating COR of strikes at various locations of the golf club head of FIG. 41A.

By contrast, with reference to FIGS. 41A-41B, the golf club head 2700' was produced by machining and compared with performance before machining. In the embodiment of the golf club head 2700', substantial performance gains were seen with 10 mm toeward strikes, showing COR improvement of more than 0.020. As such, the golf club head 2700' would show less substantial reduction in distance with the channels 2750, 2775 as compared to the same golf club head without channels. COR gain at center face strike was about 0.010. COR gain at 5 mm heelward was about 0.011. COR gain at 5 mm toeward was about 0.011. COR gain at 10 mm toeward was about 0.022.

Variation of Sound Performance

Various features of golf club heads of the current disclosure provide performance benefits in various aspects of golf club design and performance. Yet another performance advantage is the modification of sound characteristics.

Figure 42:
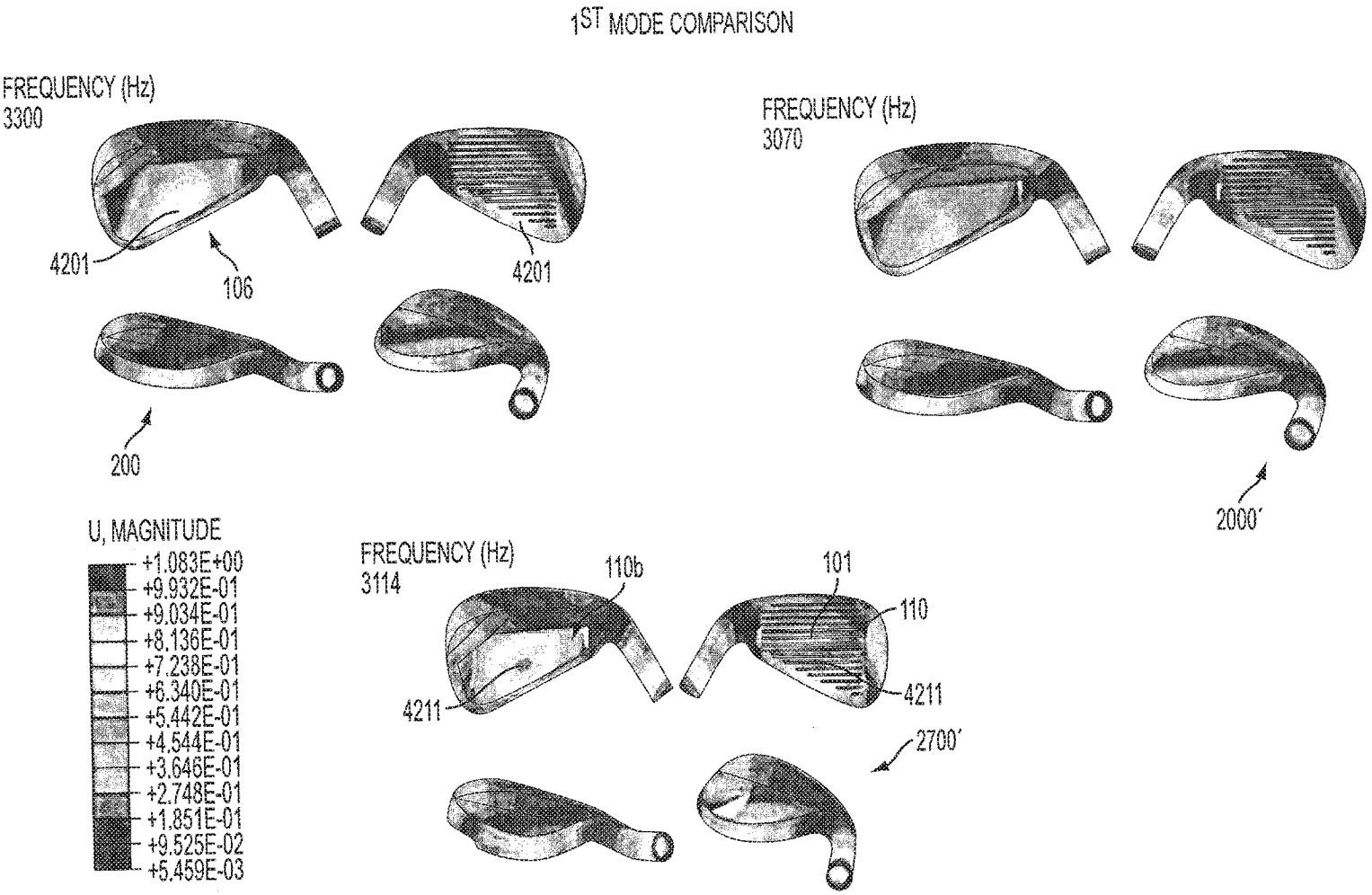
FIG. 42 is a modal comparison of various embodiments of golf club heads in accord with embodiments of the current disclosure.

In some embodiments of golf club heads, sound features can be difficult to modify. Although such features do not alter the performance characteristics described elsewhere in this disclosure including ball speed, COR, spin, and various other performance attributes, sound can affect the golfer's perception of the performance by positively or negatively reinforcing a particular shot and associating that sound with a particular result. Particularly with certain frequency ranges and high amplitude, golfers may perceive shots to be poorly-struck even though no mishit has occurred. For example, with reference to FIG. 42, golf club head 200 is shown in modal analysis to illustrate a particular frequency mode shape and amplitude. In the embodiment of golf club head 200 shown, the primary face mode 4201 is about 3300 Hz and is located with a peak amplitude proximate the top line portion 106 of the golf club head 200.

Particularly with reference to golf club heads of the current disclosure, more active face modes allow for potential damping of undesirable modes and amplitudes of particular frequency. Better damping can lead to a better sounding and feeling golf club with nearly identical performance. Desired modes and frequencies are based on energy, mode shape, location, frequency, duration, and amplitude of the associated modes. Modal analysis provides insight into where peak frequencies occur and how one might modify the design to address such undesirable modes/frequencies.

In general, movement of the peak modes onto the face allows the peak mode to be controlled by damping, whereas a mode on the top line is not as easily damped. As can be seen with additional reference to FIG. 42—and with further reference to the embodiments of the golf club head 2700' and a golf club head 2600' having a single channel proximate the heel portion 102 of the golf club head 2600'—the introduction of slot technology on the face (heel and toe slots, specifically) shifts the modes from a location that is not easily damped to a location more proximate center face, which is more easily damped. In particular, with reference to golf club head 2700', the primary face mode 4211 is moved proximate the ideal strike location 101. As can be seen from the view of FIG. 42, the rear surface 110*b* of the striking face 110 is accessible, and a damper or badge may be adhesively secured or otherwise mechanically attached or connected to the rear surface 110*b* of the striking face 110. Although such an arrangement is possible with the golf club head 200, the proximity of the primary mode 4201 to the top line portion 106 of the golf club head 200 creates a challenge when attempting to dampen the primary mode. As such, the particular embodiment of golf club head 200 shown may not be dampened effectively.

One advantage of the designs of the current disclose is the ability to move the primary mode of the golf club head to a location that is closer to the ideal strike location than to the top line of the golf club head. In various embodiments, the primary mode may not be close to the ideal strike location than to the top line portion but still may be effectively dampened by introduction of a badge.

With continuing reference to golf club head 2700', a central point of the primary mode 4211 is seen within 20 mm of the ideal strike location 101 in various embodiments. In the current embodiment, the central point of the primary mode is about 6 mm from the ideal strike location 101, and various size and arrangement of channels may move the primary mode 4211 within 3-15 mm of the ideal strike location 101.

Exemplary Embodiment

A golf club head 5000 is shown in FIGS. 43A-43G and includes features of various embodiments disclosed herein and is exemplary in combining elements of the various embodiments for performance. With specific reference to FIG. 43A, the golf club head 5000 includes the first channel 3050 and the second channel 3075 on the striking face 110 as well as sole channel 3455 (shown in FIGS. 43C-43D) as disclosed elsewhere herein. As seen with reference to FIG. 43B, a damper 5050 is included in the cavity of the golf club head 5000. The damper 5050 in the current embodiment may be of rubber, silicone, elastomer, and/or other relatively low modulus materials as well as various metals and other materials known in the art. In the current embodiment, the damper 5050 does not extend over the first channel 3050 and is seen only in the perspective from the cutaway portion. It should be noted that the cutting plane for FIG. 43B does not pass through the center of the sole channel 3455 and, as such, the sole channel 3455 is seen in better view with reference to FIGS. 43C-43G. For FIGS. 43C-43G, the damper 5050 has been removed from view to ease in identifying the features of golf club head 5000.

Figure 43A:
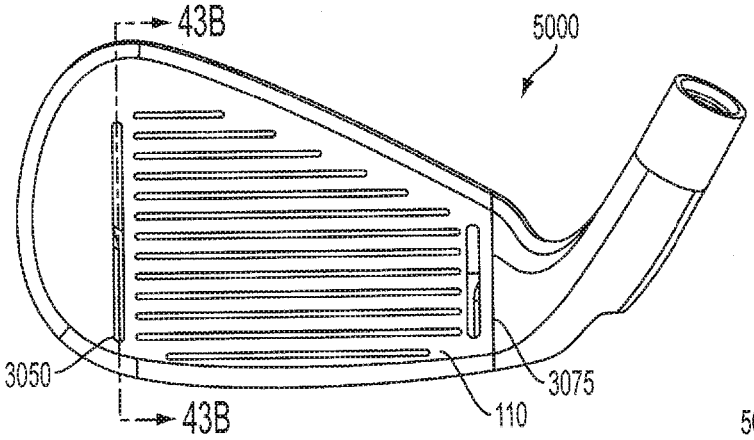
FIG. 43A is a front side view of a golf club head in accord with one embodiment of the current disclosure.
Figure 43B:
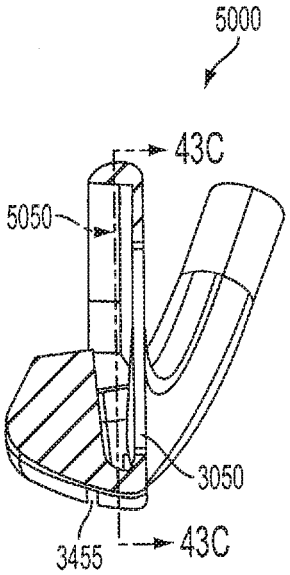
FIG. 43B is a cross-sectional view of the golf club head of FIG. 43A taken along the plane indicated by line 43B-43B.
Figure 43C:
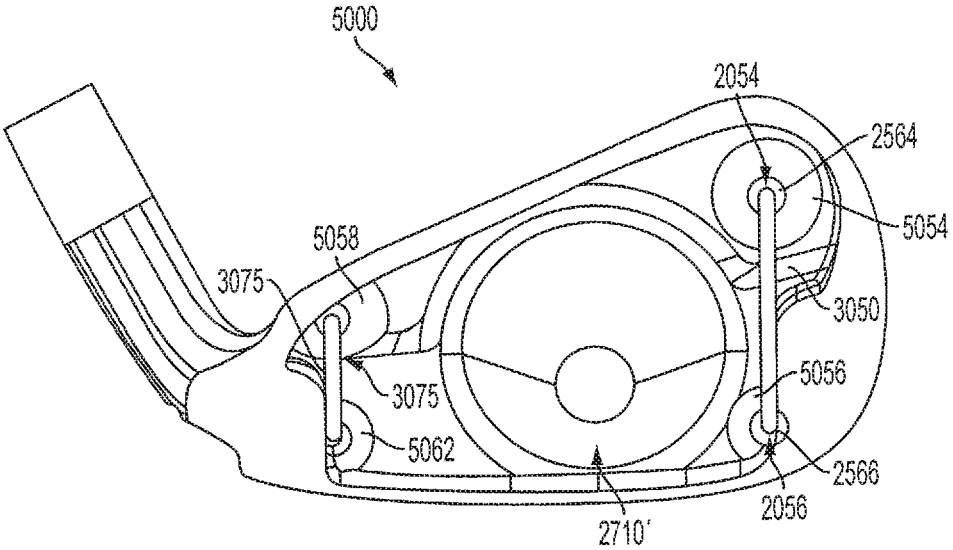
FIG. 43C is a cross-sectional view of the golf club head of FIG. 43A taken along the plane indicated by line 43C-43C in FIG. 43B.

As seen with reference to FIG. 43C, the golf club head 5000 includes VFT pattern 2710'. As can be seen, the first end 2564 and the second end 2566 have upper relief 2554 and lower relief 2556, respectively, that are of a diameter the same as the width of the channel, about 2 mm for the current embodiment. As such, an upper relief 5054 and a lower relief 5056 are provided to enhance the ability of the golf club head 5000 to withstand stress concentrations at ends of the channel 3050. The reliefs 5054, 5056 include thickened region proximate to ends of the channel 3050. Stress durability increases proportionally to the cubic of the thickness of the profile under stress. As such, increasing thickness of the striking face 110—particularly in regions proximate the channels 3050, 3075 and, more particularly, proximate the ends 2564, 2566—may help increase durability while maintaining performance of the channels 3050, 3075. In the current embodiment, the thickened region reliefs 5054, 5056 provide increased thickness of about twice the mean thickness of the striking face 101 absent the reliefs 5054, 5056. In various embodiments, the reliefs 5054, 5056 may provide increased thickness of about 1.5 times the mean thickness of the striking face 101 absent the reliefs 5054, 5056. Similar reliefs 5058, 5062 are provided for channel 3075.

Figure 43D:
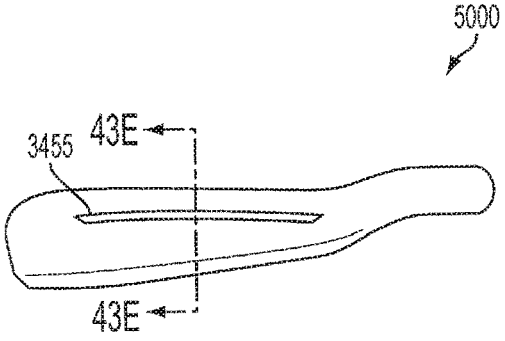
FIG. 43D is a bottom side view of the golf club head of FIG. 43A.
Figure 43E:
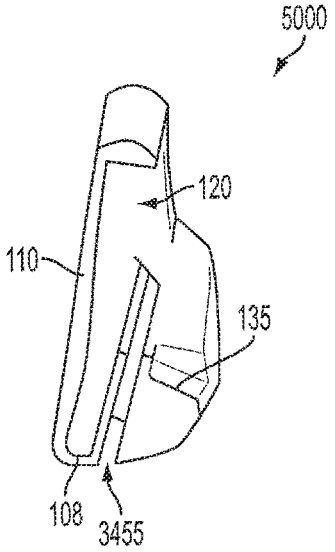
FIG. 43E is a cross-sectional view of the golf club head of FIG. 43A taken along the plane indicated by line 43E-43E in FIG. 43D.
Figure 43F:
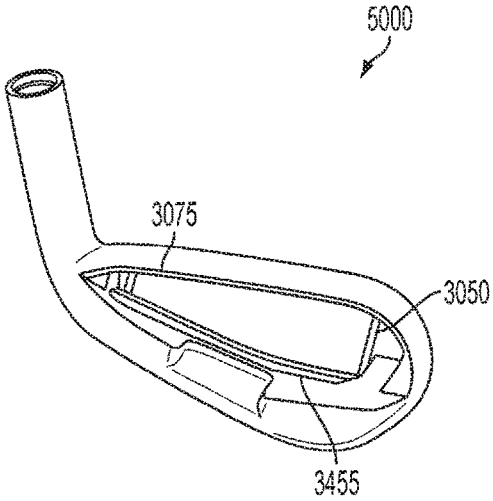
FIG. 43F is a perspective view of the golf club head of FIG. 43A.
Figure 43G:
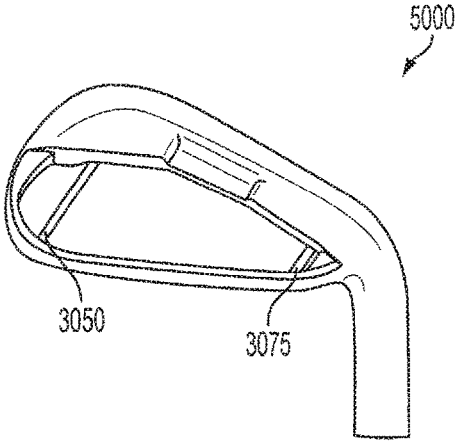
FIG. 43G is a back side view of the golf club head of FIG. 43A.

FIGS. 43D, 43E, and 43F provide additional views of the sole channel 3455 and its physical relation to the golf club head 5000. As can be seen with specific reference to FIG. 43E, the sole channel 3455 is defined through an entirety of the sole bar 135. However, in various embodiments, the channel 3455 may be defined such that it extends through the sole portion 108 in a location other than the sole bar 135, and the channel 3455 may extend directly from the sole portion 108 into the cavity 120. FIG. 43G provides a rear side view of the golf club head 5000 without the damper 5050.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A golf club head for an iron-type club, the golf club head comprising:

a cavity-back iron-type body including a heel portion, a sole portion, a toe portion, a top-line portion, and a face portion, wherein the sole portion extends rearwardly from a lower end of the face portion and the body defines an open cavity behind the face portion;

wherein the face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin;

wherein the club head includes a central region in which $-25\ \text{mm}<x<25\ \text{mm}$ and the central region of the face portions is devoid of channels;

wherein at least one face channel is defined in the face portion in a location outside of the central region and proximate to at least one of the toe portion, heel portion and top line portion, the at least one channel being defined through an entire thickness of the face portion;

wherein at least one sole channel is defined in the sole portion, the at least one sole channel being defined through an entire thickness of the sole portion into the open cavity of the golf club head;

wherein a damper is included in the open cavity of the golf club head, wherein the damper does not extend over the at least one face channel; and wherein at least one point on the face having an x-axis coordinate of −30 mm has a contact time that is at most 130 microseconds less than a contact time at the ideal striking location.

2. The golf club head of claim 1, wherein the face portion is of variable thickness.

3. The golf head of claim 2, wherein the variable thickness is asymmetrical such that the thickness of the face portion proximate to the at least one channel is greater than the thickness of the face portion distal to the at least one channel.

4. The golf club head of claim 1, wherein at least one stress relief is included with the at least one channel.

5. A golf club head for an iron-type golf club, the golf club head comprising:

a cavity-back iron-type body including a heel portion, a sole portion, a toe portion, a top-line portion, and a face portion, wherein the sole portion extends rearwardly from a lower end of the face portion and the body defines a cavity behind the face portion;

wherein the face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin;

wherein at least one channel is defined in the sole portion between a sole bar and the face portion, the at least one channel being defined through an entire thickness of the sole portion into a rear void of the golf club head, wherein an overhang member extends from the sole bar over a mouth of the at least one channel;

wherein a damper is provided on a rear surface of the face portion, the damper provided at least in part between the face portion and the sole bar;

wherein the ideal striking location is a point on the face portion that coincides with a center of gravity of the club head along the x-axis, the face portion including at least one non-ideal striking location; and wherein a coefficient of restitution at the ideal striking location is not more than 0.035 greater than the coefficient of restitution at the at least one non-ideal striking location.

6. The golf club head of claim 5, wherein the body includes at least one back portion and the at least one back portion defines a continuous undercut recess around a periphery of the golf club head in the cavity.

7. The golf club head of claim 5, wherein at least two channels are defined in the face portion respectively proximate to the toe portion and heel portion.

8. The golf club head of claim 5, wherein the damper is adhesively secured to the rear surface of the face portion.

9. The golf club head of claim 5, wherein the body includes a rear wall enclosing the cavity to form a hollow region.

10. The golf club head of claim 5, wherein the face portion is of variable thickness.

11. The golf club head of claim 10, wherein the variable thickness is asymmetrical such that the thickness of the face portion proximate to the at least one channel is greater than the thickness of the face portion distal to the at least one channel.

12. A golf club head for an iron-type golf club, the golf club head comprising:

a cavity-back iron-type body including a heel portion, a sole portion, a toe portion, a top-line portion, and a face portion, wherein the sole portion extends rearwardly from a lower end of the face portion and the body defines a cavity behind the face portion;

wherein the face portion includes an ideal striking location that defines the origin of a coordinate system in which an x-axis is tangential to the face portion at the ideal striking location and is parallel to a ground plane when the body is in a normal address position, a y-axis extends perpendicular to the x-axis and is also parallel to the ground plane, and a z-axis extends perpendicular to the ground plane, wherein a positive x-axis extends toward the heel portion from the origin, a positive y-axis extends rearwardly from the origin, and a positive z-axis extends upwardly from the origin;

wherein at least one face channel is defined in the face portion in a location outside of the central region and proximate to the toe portion or the heel portion, wherein the at least one face channel shifts a damping location closer to the ideal striking location than to the top-line portion;

wherein at least one sole channel is defined in the sole portion; and wherein a damper is included in the cavity of the golf club head, wherein the damper does not extend over the at least one face channel.

13. The golf club head of claim 12, wherein the at least one sole channel is defined through an entire thickness of the sole portion.

14. The golf club head of claim 12, wherein the face portion includes at least one non-ideal striking location, each non-ideal striking location being about 10 mm from the ideal striking location on an x-axis defined parallel to a ground plane and passing through the ideal striking location, wherein the coefficient of restitution at the ideal striking location is not more than 0.035 greater than the coefficient of restitution at each non-ideal striking location.

15. The golf club head of claim 14, wherein the coefficient of restitution at the ideal striking location is not more than 0.010 greater than the coefficient of restitution at each non-ideal striking location.

* * * * *